US008528373B2

(12) United States Patent
Hyatt, Jr. et al.

(10) Patent No.: US 8,528,373 B2
(45) Date of Patent: Sep. 10, 2013

(54) ELECTRONIC CAM ASSEMBLY

(76) Inventors: Richard G. Hyatt, Jr., Blacksburg, VA (US); Douglas E. Trent, Roanoke, VA (US)

( * ) Notice: Subject to any disclaimer, the term of this patent is extended or adjusted under 35 U.S.C. 154(b) by 1761 days.

(21) Appl. No.: 10/440,304

(22) Filed: May 19, 2003

(65) Prior Publication Data

US 2003/0221466 A1 Dec. 4, 2003

Related U.S. Application Data

(60) Continuation of application No. 09/463,420, filed as application No. PCT/US00/00518 on Feb. 4, 2000, now Pat. No. 6,588,243, and a division of application No. 09/092,080, filed on Jun. 5, 1998, now Pat. No. 6,209,367, said application No. 09/463,420 is a division of application No. 09/092,080.

(60) Provisional application No. 60/050,941, filed on Jun. 6, 1997.

(51) Int. Cl.
*E05B 49/00* (2006.01)

(52) U.S. Cl.
USPC ..... 70/278.2; 70/278.1; 70/278.3; 70/278.7; 340/5.52

(58) Field of Classification Search
USPC ..... 70/278.1–278.3, 278.7; 340/5.52, 340/5.54
See application file for complete search history.

(56) References Cited

U.S. PATENT DOCUMENTS

| | | | | |
|---|---|---|---|---|
| 1,695,518 A | 12/1928 | Watson | ..... | 70/277 |
| 3,241,344 A | 3/1966 | Peters | | |
| 3,336,770 A | 8/1967 | Parsons | ..... | 70/141 |
| 3,539,991 A | 11/1970 | Irazoqui | ..... | 370/5.73 |
| 3,748,878 A | 7/1973 | Balzano et al. | ..... | 70/218 |
| 3,979,647 A | 9/1976 | Perron et al. | | |
| 4,053,939 A | 10/1977 | Nakauchi et al. | | |
| 4,073,527 A | 2/1978 | Schlage | | |

(Continued)

FOREIGN PATENT DOCUMENTS

| | | |
|---|---|---|
| DE | 559158 | 9/1932 |
| DE | 2546542 | 4/1977 |

(Continued)

OTHER PUBLICATIONS

"Physics", 4th Edition. vol. 1, by Robert Resnick, David Halliday & Kenneth S. Krane: John Wiley & Sons, Inc. 1992. Chapter 5-2 Newton's First Law, pp. 78-79.

(Continued)

*Primary Examiner* — Suzanne Barrett
(74) *Attorney, Agent, or Firm* — Robert E. Bushnell, Esq.

(57) ABSTRACT

A cam assembly may be constructed with lock cylinder perforated by a centrally positioned keyway, and having an exposed circumferential surface surrounding the keyway rotatably fitted within a centrally positioned keyhole of a housing, and rotated within the centrally positioned keyhole in response to rotational force applied by a key conformingly corresponding to the lock cylinder through an arc. An electronic circuit containing a memory and a microprocessor, is mounted upon and supported by the cam to rotate with the cam through the arc, operationally responds to digital data carried by the key that is in electronic conformance to data stored within the memory, by electrically energizing a release mechanism that is spaced-apart from the axis of rotation of the cylinder plug, to move from a deployed position preventing rotation of the cam relative to the housing.

17 Claims, 82 Drawing Sheets

(56) References Cited

U.S. PATENT DOCUMENTS

| | | | | |
|---|---|---|---|---|
| 4,414,831 | A | 11/1983 | Perkut | |
| 4,458,512 | A | 7/1984 | Gelhard | |
| 4,496,948 | A | 1/1985 | Ishizuka | 340/5.6 |
| 4,509,093 | A | 4/1985 | Stellberger | |
| 4,514,001 | A | 4/1985 | Garcia | 292/311 |
| 4,562,343 | A | 12/1985 | Wiik et al. | |
| 4,602,253 | A | 7/1986 | Kreft | |
| 4,603,564 | A | 8/1986 | Kleinhany et al. | 70/277 |
| 4,686,358 | A | 8/1987 | Seckinger et al. | |
| 4,712,398 | A | 12/1987 | Clarkson et al. | |
| 4,745,784 | A | 5/1988 | Gartner | 70/277 |
| 4,761,976 | A | 8/1988 | Kleinhany | 70/277 |
| 4,798,068 | A | 1/1989 | Nakauchi | |
| 4,807,455 | A | 2/1989 | Mauer | 70/277 |
| 4,854,619 | A | 8/1989 | Nakauchi | |
| 4,856,310 | A | 8/1989 | Parienti | |
| 4,864,292 | A | 9/1989 | Nieuwkoop | |
| 4,909,053 | A | 3/1990 | Zipf, III et al. | 70/283 |
| 4,979,647 | A | 12/1990 | Hassell | |
| 4,984,441 | A | 1/1991 | Mauer | 70/277 |
| 5,094,093 | A | 3/1992 | Ben-Asher | 70/278.2 |
| 5,140,317 | A | 8/1992 | Hyatt, Jr. et al. | 340/5.25 |
| 5,206,637 | A | 4/1993 | Warren | |
| 5,228,730 | A | 7/1993 | Gokcebay et al. | 292/144 |
| 5,367,295 | A | 11/1994 | Gokcebay et al. | 340/5.65 |
| 5,423,198 | A | 6/1995 | DiVito et al. | 70/278.3 |
| 5,469,727 | A | 11/1995 | Spahn et al. | |
| 5,477,213 | A | 12/1995 | Atarashi | |
| 5,495,733 | A | 3/1996 | Yen et al. | 70/278.3 |
| 5,540,068 | A | 7/1996 | Gartner et al. | 70/277 |
| 5,541,581 | A | 7/1996 | Trent | 340/5.55 |
| 5,542,272 | A | 8/1996 | Heinemann | 70/278.6 |
| 5,542,274 | A * | 8/1996 | Thordmark et al. | 70/495 |
| 5,551,263 | A | 9/1996 | Myers et al. | 70/86 |
| 5,552,777 | A * | 9/1996 | Gokcebay et al. | 340/5.54 |
| 5,605,066 | A | 2/1997 | Hurskainen | |
| 5,745,044 | A | 4/1998 | Hyatt, Jr. et al. | 340/5.23 |
| 5,845,523 | A | 12/1998 | Butterweck et al. | 70/278.1 |
| 6,082,153 | A | 7/2000 | Schoell | 70/1.5 |
| 6,209,367 | B1 | 4/2001 | Hyatt, Jr. et al. | 70/278.2 |
| 6,227,020 | B1 * | 5/2001 | Lerchner | 70/278.3 |
| 6,564,601 | B2 * | 5/2003 | Hyatt, Jr. | 70/278.3 |
| 6,588,243 | B1 * | 7/2003 | Hyatt et al. | 70/278.1 |
| 6,615,625 | B2 * | 9/2003 | Davis | 70/278.3 |
| 6,684,671 | B2 | 2/2004 | Beylotte et al. | |

FOREIGN PATENT DOCUMENTS

| | | |
|---|---|---|
| DE | 2557637 | 7/1977 |
| DE | 3031405 | 4/1982 |
| DE | 3218112 | 11/1983 |
| DE | 3225754 | 1/1984 |
| DE | 3331357 | 3/1984 |
| DE | 3244566 | 6/1984 |
| DE | 3313098 | 10/1984 |
| DE | 3507871 | 11/1985 |
| DE | 3515888 | 11/1986 |
| DE | 3602989 | 11/1987 |
| DE | 4036575 | 6/1991 |
| DE | 4314854 | 11/1994 |
| EP | 0 059 874 | 9/1982 |
| EP | 0 094 592 | 11/1983 |
| EP | 0 115 747 | 8/1984 |
| EP | 0 243 586 | 11/1987 |
| EP | 0 290 330 | 11/1988 |
| EP | 0 324 096 | 7/1989 |
| EP | 0 497 040 | 8/1992 |
| EP | 0 559 158 | 9/1993 |
| EP | 0 597 373 | 5/1994 |
| EP | 0 848 122 B1 | 6/2006 |
| FR | 2607545 | 6/1988 |
| GB | 1531951 | 11/1978 |
| GB | 2124808 | 2/1984 |
| GB | 2155988 | 10/1985 |
| GB | 2174452 | 11/1986 |
| GB | 2 221 714 | 7/1990 |
| GB | 2 226 593 | 7/1990 |
| GB | 2 250 052 | 7/1990 |
| GB | 2 259 737 | 7/1990 |
| GB | 2239673 | 7/1991 |
| GB | 2 243 185 | 10/1991 |
| JP | 63-032072 | 2/1988 |
| JP | 63-093977 | 4/1988 |
| JP | 63-138080 | 6/1988 |
| JP | 63-206581 | 8/1988 |
| JP | 01-219269 | 9/1989 |
| JP | 01-219270 | 9/1989 |
| JP | 02-200979 | 8/1990 |
| JP | 06-073929 | 3/1994 |
| JP | 06-073930 | 3/1994 |
| JP | 06-073931 | 3/1994 |
| JP | 07-317385 | 12/1995 |
| JP | 08-218690 | 8/1996 |
| JP | 09-132977 | 5/1997 |
| WO | WO 81/00586 | 3/1981 |
| WO | WO 87/03640 | 6/1987 |
| WO | WO 96/18014 | 6/1996 |

OTHER PUBLICATIONS

A first Office action issued on Jun. 30, 2006 by the European Patent Office to the European patent application No. 00 917 597.7-1267 corresponding to the above-captioned U.S. patent application.

US 5,722,274, 03/1998, Nakauchi et al. (withdrawn)

* cited by examiner

CAM SHOWN IN UNLOCKED AND ROTATED POSITION WITH SOLENOID ENERGIZED.

CAM SHOWN IN LOCKED POSITION WITH SOLENOID DE-ENERGIZED.

ELECTRONIC CAM ASSEMBLY

CLAIM FOR PRIORITY

This application is a divisional application of parent application Ser. No. 09/092,080, and a continuation of Ser. No. 09/463,420, that makes reference to, incorporates the same herein, and claims all right accruing from our earlier filing of a provisional patent application entitled Electronic Cam Assembly filed in the United States Patent & Trademark Office on the 6 Jun. 1997 and there assigned Ser. No. 60/050,941, and our patent application entitled ELECTRONIC CAM ASSEMBLY filed in the United States patent & Trademark Office on the 5 Jun. 1998 and there assigned Ser. No. 09/092,080, and issued on the 3 Apr. 2001 as U.S. Pat. No. 6,209,367.

BACKGROUND OF THE INVENTION

1. Field of the Invention

The present invention relates to access control, and, more particularly, to manually operated, electronically keyed locks and locking processes suitable for retrofitting existing appliances.

2. Description of the Related Art

Current designs for maintaining security of containers such as bank safe deposit boxes require attended access and, all too frequently, dual keys, to allow access to the various containers maintained. We have found that the use of dual keys has become increasingly expensive in terms of man hours consumed by the employees of the bank providing attendance to the customers of the bank. Historically, safe deposit locks as well as other locks, have used a keyed cylinder that is offset from the centerline of the casing for the lock, within the body immediately behind the front plate of the safe deposit door. It was the object of this design to accommodate a full sized set of mechanical tumblers within the casing immediately behind the front plate of the door. The economics of safe deposit box rental require that the casing of the lock be made narrow in order to provide a high degree of security for the door while minimizing the loss of volume of the door due to the presence of the casing for the lock. The offsetting of the centerline of the keyway in turn allows the use of a more conventional and secure design within the very narrow compartment doors, as well as within taller doors. By the expedient of placing the cylinder of the lock in the lower portion of the casing, below the centerline of the casing and vault, the key could lift a set of larger tumblers without requiring an undesirably larger lock casing. The economy of providing uniform lock design, over the years, for differing applications has resulted in an existing installed base of millions of these locks. While not all of these locks rely upon offset keyed cylinders (referred to as "noses" in the trade), many do.

Four major lock manufacturers currently continue to produce locks with offset keyed cylinders, while at least two other manufacturer that have discontinued production, continue to have a large installed base. One of the most popular offset locks in the current market is the 4440 series left hand and right hand model manufactured by Sargent and Greenleaf. We have noticed a need to retrofit existing offset keyed cylinder locks with electro-mechanical locks, without expensive and inconvenient replacement of the doors, in order to minimize the man hours consumed by employees of banks that provide attendance to the customers, while the customers open their safe deposit doors, with a mechanical enhancement of blocking strength as well as an improvement of security over other processes, without a complex electrical contact system.

We have also noticed that authorized service mechanics often open locked mechanical safe deposit locks by first drilling a hole through the face of the cylinder plug, threading a sheet metal or self tapping screw into the hole and pulling the inserted screw with either a nose puller or claw hammer until the face of the cylinder breaks away to allow removal of the cylinder plug. The removal of the cylinder plug allows direct and immediate frontal manipulation of the tumblers until the lock is unlocked. Consequently, even though the faceplate of the safe deposit door may itself be strong enough to resist casual tampering, the susceptibility of the cylinder plug to quick removal by a single application of brute force deleteriously reduces the security of the entire drawer.

The Electronic Security System of U.S. Pat. No. 5,745,044 and U.S. Pat. No. 5,140,317 issued to Hyatt et al., is currently used to lock pay telephones. This design blocks a locking bolt, but does so from what we believe is a geometrically disadvantageous point. By virtue of the separate direct blocking of a bolt by a solenoid, the bolt is blocked off center from the centerline of the bolt. Moreover, the physically large lock cylinder and the inter-device discrete wiring between the solenoid and the other components inside the casing, as well as the electrical contact system for the lock cylinder, create several problems in our opinion. Furthermore, the difficulty of manufacture and installation of wiring, and the absence of both miniaturization and offsetting of the bolt blocking, suggest that there is little practical prospect of retrofitting the many existing offset nose locks. In addition, the routing and use of discrete wires causes problems of reliability and quality during manufacture and usage, absent tedious careful and consistent monitoring.

The rotatable keypad operated solenoid lock of Butterweck, et al, U.S. Pat. No. 5,845,523 for an Electronic Input And Dial Entry Lock, and the other various locks mentioned in that patent such as U.S. Pat. No. 4,831,851 for a Combination/electronic Lock System by Larson, U.S. Pat. No. 4,967,577 for an Electronic Lock With Manual Override by Gartner, et al, U.S. Pat. No. 4,899,562 for an Electronic Door Lock by Gartner, and U.S. Pat. No. 4,904,984 for a Combination Lock With An Additional Security Lock by Gartner, are variations of a dial operated combination lock, and lack the security, reliability and economy traditionally demanded for safe deposit boxes and drawers, while the Lock For A Safe-Deposit Box of Chieh-Chen Yen, et al., U.S. Pat. No. 5,495,733 inconveniently relies upon different keys for the renter of the safe deposit box and for the clerk of the bank, as well as a manually operated keypad.

SUMMARY OF THE INVENTION

It is therefore, an object of the present invention to provide an improved lock and process for restricting access to containers.

It is another object to provide a lock and process suitable for retrofitting containers previously secured by bitted and unbitted locks.

It is yet another object to provide a lock and process able to enhance the security of containers against unauthorized entry.

It is still another object to provide a lock and process able to electronically control access to the interior of secured containers.

It is still yet another object to provide a lock and process for electronically monitoring access to secured containers.

It is a further object to provide an electronically key controlled process and a cam assembly that may be configured as a single integrated electromechanical unit operable with an electronically controlled key, mated with either the existing lock cylinders of containers or with new lock cylinders, and retroactively fitted to secure those containers.

It is a still further object to provide an electronically key controlled process and integrated electromechanical cam assembly that may either be installed as a retroactively fitted component part of an existing locking mechanism with a minimum of modifications of the locking mechanism, or alternatively, be incorporated into a complete locking mechanism.

It is still yet a further object to provide an electronically key controlled process and integrated electromechanical cam assembly that may be retroactively installed as a component part of locking mechanisms previously installed in lockable containers by using existing screw patterns and key holes of those containers.

It is an additional object to provide an electronically key controlled process and integrated electromechanical cam assembly able to be mated with either bitted lock cylinders or with unbitted cylinder plugs.

It is a still additional object to provide an electronic cam and cam locking process endowed with simplified interconnections between the components of the lock, and that is amenable to simplified manufacture.

It is a yet additional object to provide an electronic cam and cam locking process endowed with an enhanced mechanical strength.

It is still yet an additional object to provide an electronic cam and cam locking process that indirectly blocks the cam.

It is also an object to provide a locking cam and cam locking process that drives and locks the bolt from its relative center.

These and other objects may be achieved with a process requiring either electronic conformance of a key to an electronic circuit carried by a cam driving a bolt or both mechanical conformance and electronic conformance of the key to both a cylinder plug and to the electronic circuit in order to enable the cam to drive the bolt between a locked position and an unlocked position. One embodiment may be constructed with a housing bearing an optimally positioned hole centered upon a first axis, a bolt supported by the housing and moving transversely relative to the first axis to protrude beyond the housing to an extended, and locked, position and to retract within the housing to a retracted, and unlocked, position, and the cylinder plug of the lock cylinder perforated by a centrally positioned keyway, having an exposed circumferential surface surrounding the keyway rotatably fitted within the optimally positioned hole, and rotating within the optimally positioned hole in response to rotational force applied by a key conformingly corresponding to the lock through an arc centered upon the first axis. A cam is positioned within the housing to rotate with the cylinder plug as the key conformingly corresponding to the lock manually applies a rotational force to the cylinder plug as the key is manually rotated through the arc. A member eccentrically positioned relative to the first axis, extends between the cam and the bolt to drive the bolt between the extended and the retracted positions as the cylinder plug is rotated through the arc. An electronic circuit containing a memory and a microprocessor, that is mounted upon and supported by the cam to rotate with the cam through the arc, determines electronic conformance of the key and operationally responds to digital data carried by the key to electronically activate a release mechanism that is spaced-apart from the cylinder and eccentrically positioned away from the first axis. The circuit is functionally activated by the electronic circuit in response to mechanical and electronic conformance between the key and both the cylinder plug and the electronic circuit, to move between a deployed position preventing rotation of the cam relative to the housing, and a released position accommodating the rotation of the cam relative to the housing. Optionally, the first axis may be positioned to locate the cylinder plug off-center and toward one side of the lock's casing while the cam is positioned to rotate around a second and different axis in response to rotation of the cylinder plug and either electronic conformance to an electronic circuit carried by the cam, or both mechanical conformance to the cylinder plug and electronic conformance to the electronic circuit.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings in which like reference symbols indicate the same or similar components, wherein.

DETAILED DESCRIPTION OF THE PREFERRED EMBODIMENTS

Figure 1A:
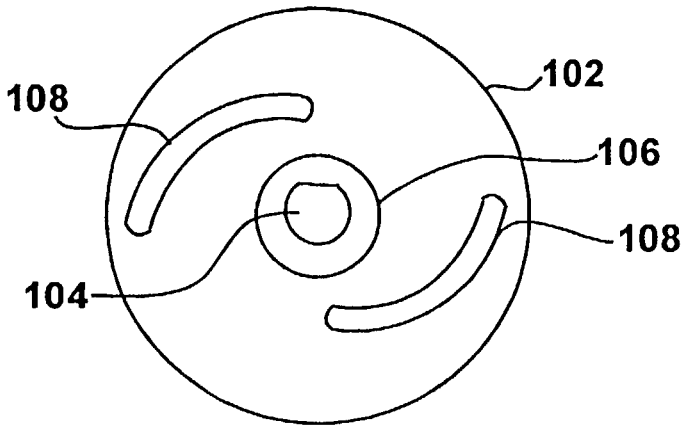
FIG. 1A shows a plan view of a contemporary arrangement for a parking meter lock.
Figure 1B:
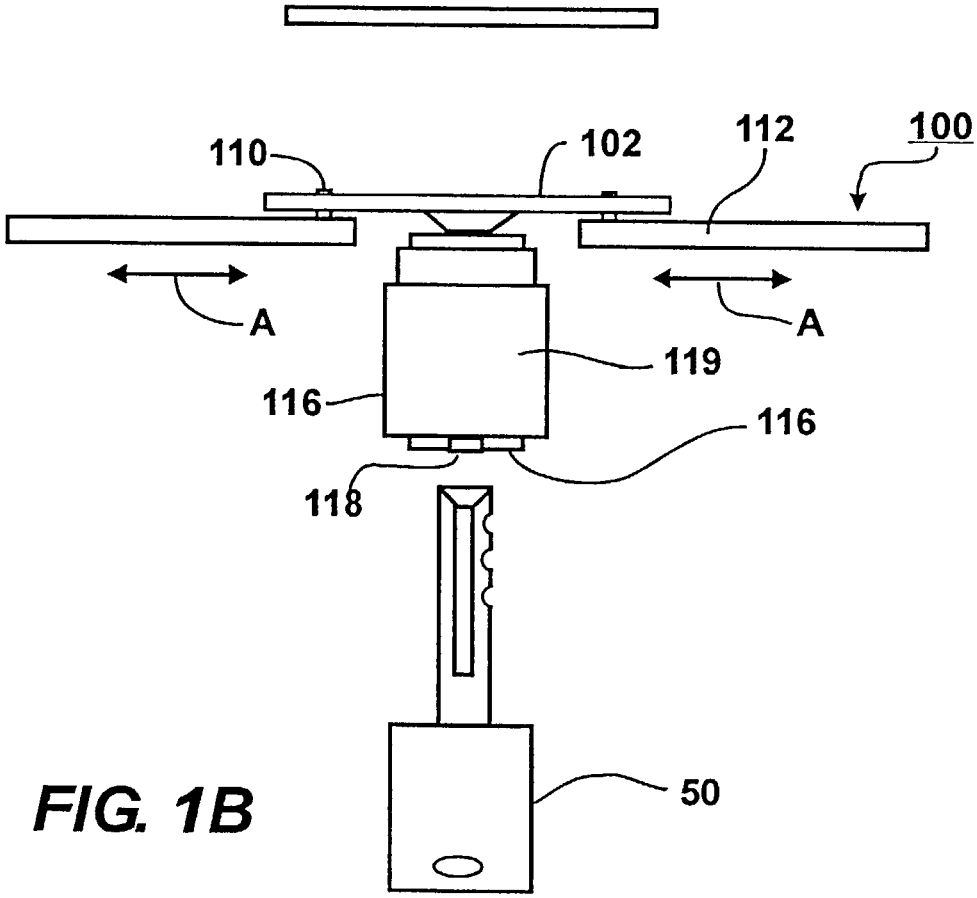
FIG. 1B shows a side view of a cam customarily used in a contemporary parking meter lock.

Turning now to the drawings, FIG. 1A, 1B illustrate the salient features of a hypothetical, conventional parking meter lock 100. A metal cam plate 102 formed with a circular shape perforated by a D-shaped hole 104 engages a D-shaped extension of a locking cylinder plug 116. A conically shaped, concave depression 106 extends toward the cylinder plug 116, to enable D-shaped hole 104 to engage the extension. A pair of radially opposite helically spiral slots 108 equally distantly radially spaced-apart from D-shaped hole 104, perforate plate 102 to engage and direct the travel of connecting pins 110, thereby alternately withdrawing and projecting bolts 112 in opposite reciprocation in the opposite directions indicated by arrows A. Typically, a mechanically bitted key 50 is inserted into keyway 118 that axially perforates a cylinder plug 116 that is coaxially fitted inside the cylindrical shell 119 that surrounds plug 116. Shell 119 is fitted into a re-enforced door (not shown) such as the circular door of a municipal parking meter. Correct correspondence between the lands and peaks of the bits of key 50 and the tumblers (not shown) within plug 116 create a shear line that enables the torque that is manually applied to the handle of key 50 to rotate plug 116 relative to shell 119, thereby drawing pins 110 from a radially outwardly position shown in FIG. 1A, to a radially inward position closer to the center of cam plate 102. Once bolts 112 have been withdrawn, the door into which lock assembly 100 has been fitted can be removed, or opened. Rotation of key 50 in the opposite direction causes extension of bolts 112, thereby locking the door.

Figure 2:
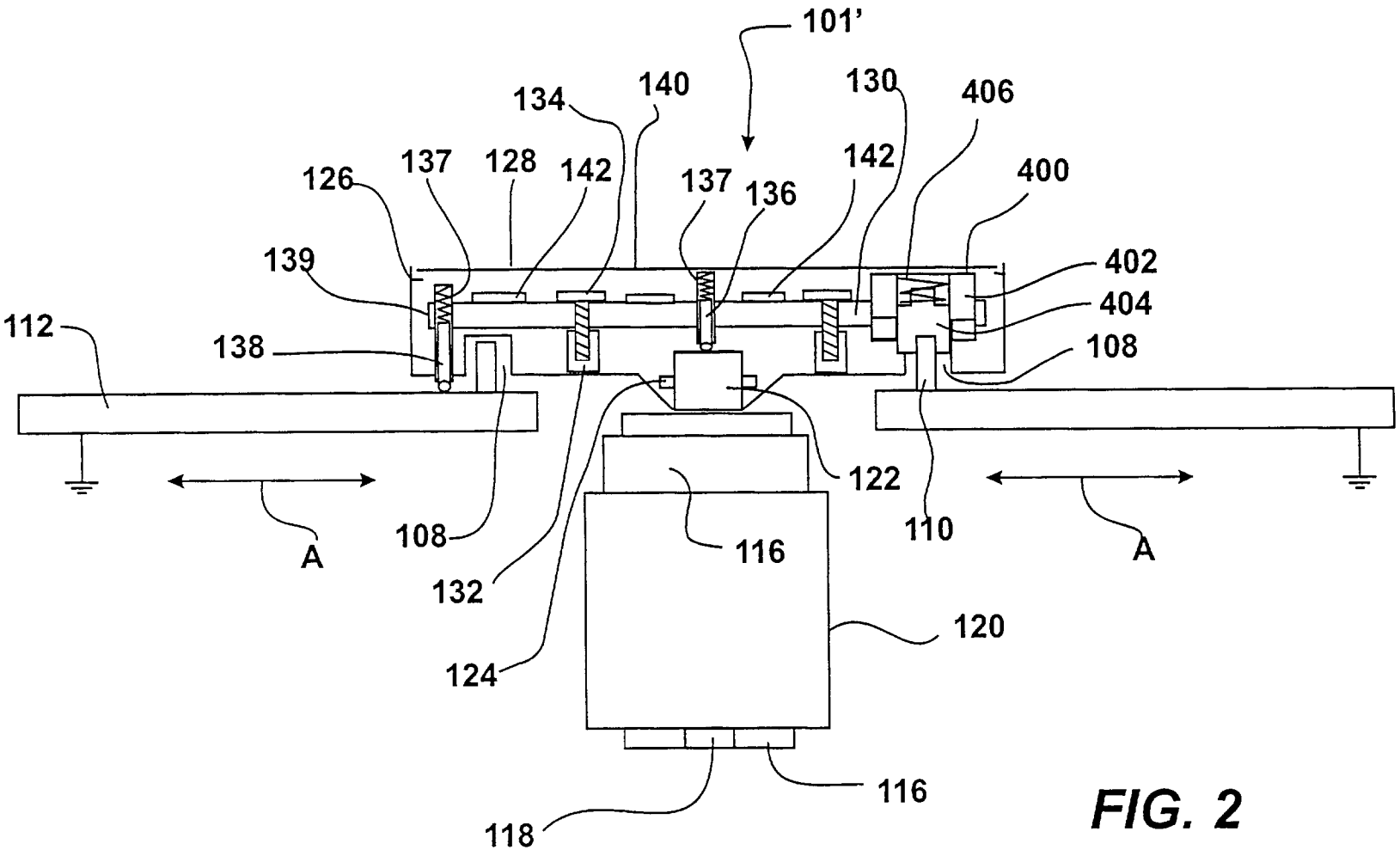
FIG. 2 shows a detailed side elevational view of one embodiment of the present invention designed for retrofitting a parking meter lock.

In the embodiment of the invention shown in FIG. 2, cylinder plug 116 is encased in a cylindrical shell 120 made of a non-electrically conductive material. This shell electrically insulates plug 116 from the metal door into which lock assembly 101 has been installed. An extension 122 of cylinder plug 116 passes through D-shaped hole 104 in cam plate housing 126, and makes mechanical and electrical contact with a board mounted spring biased electrical contact pin 136. Compression spring 137 biases pin 136 toward the axial dimension of cylindrical plug 116, thereby assuring electrical contact between pin 138 and extension 122 as plug 116 rotates within shell 120. Electronic cam assembly 140 contains a second board mounted spring biased pin 138 forming mechanical and continuous electrical contact with at least one of the reciprocally sliding bolts 112.

Cam plate 126 (having a base with a shape substantially identical to the top view of cam plate 102 shown in FIG. 1B), and cover 128 are preferably made of an electrically insulating material such as a plastic. Circuit board 139 supports a plurality of integrated circuits 142 and other electrical components, as well as electrical contacts 136, 138. Bosses 132, formed in a base of the cam plate housing 126, receive threaded fasteners 134 extending through circuit board 139, thereby securing circuit board 139 within cam plate housing 126.

Figure 3:
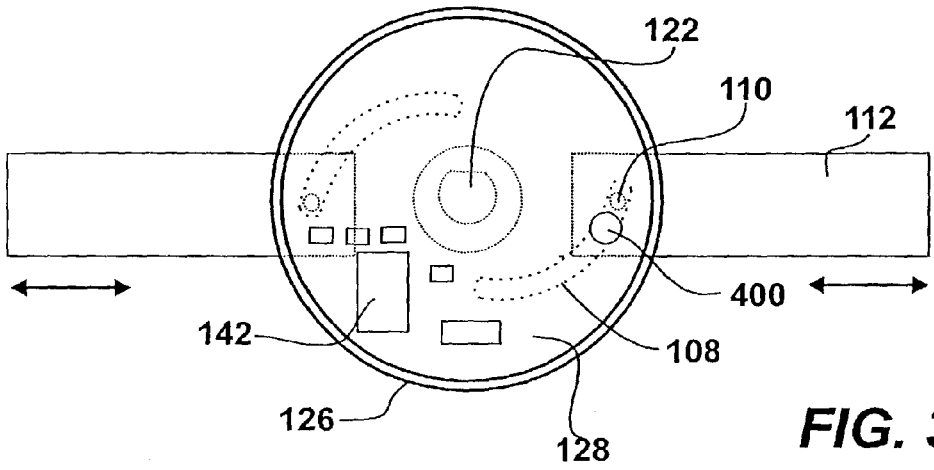
FIG. 3 shows a top detailed view of a cam which may be used in the embodiment of FIG. 2.
Figure 4:
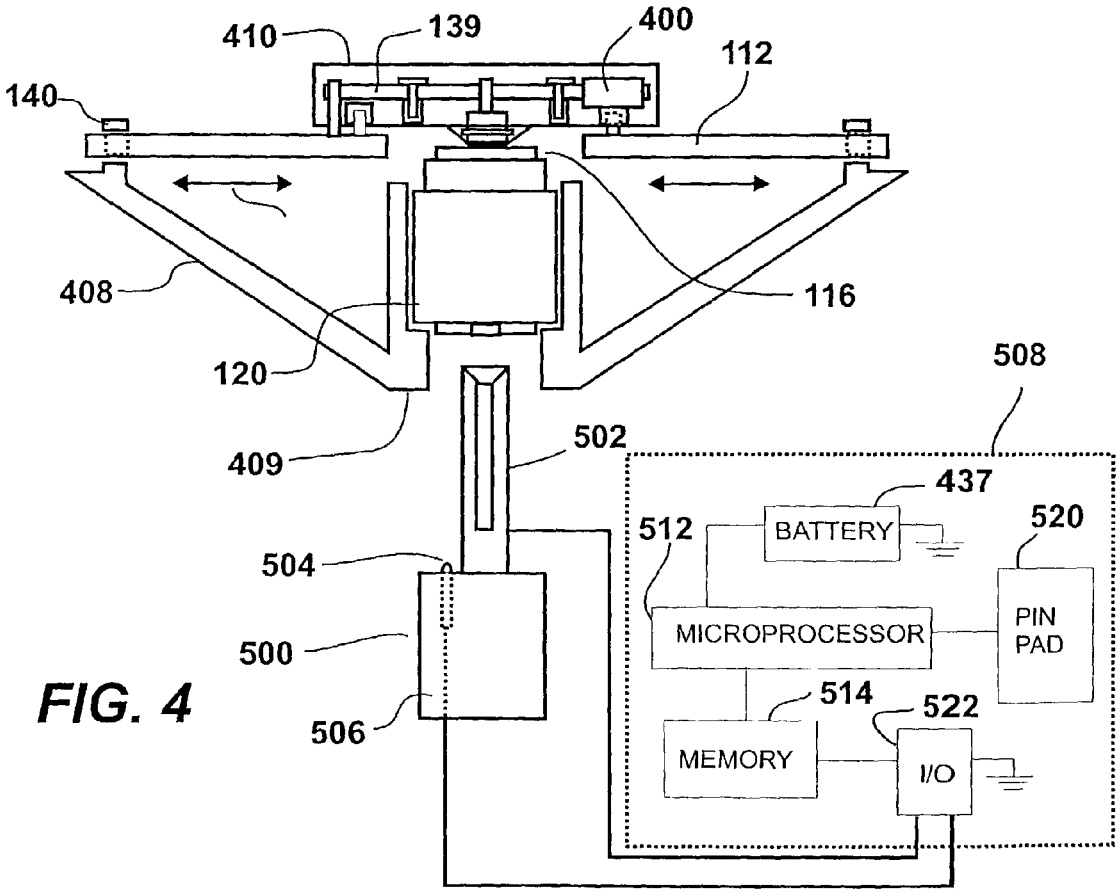
FIG. 4 shows a side elevational view of a contemporary parking meter fitted with an embodiment of the present invention.

Turning to FIGS. 3 and 4, in conjunction with FIG. 2, when a key 500 corresponding to the security features (i.e., correctly bitted teeth, if the key is in fact bitted), is inserted into keyway 118 so that the blade 502 of the key serves as an electrical contact for transmission of data and power to contact 136, while a spring loaded electrical contact 504 mounted on the other side of the head 506 of key 500 engages the circumferential exposed surface (often the exposed surface of a re-enforced insert) 409 of door 408, thereby completing the electrical circuit between the electronic control circuit 508 of key 500 and electronic circuit 130 mounted on circuit board 139 via contacts 136, 138. Assuming correct electrical conformity established through the power and data transferred between circuits 508 (including the supply of power to circuit 130 from circuit 508 via key 500 and cylinder plug 116), the logic and control components of circuit 130 will electrically activate solenoid release assembly 400 with the electrical current flowing through solenoid coil 402, thereby withdrawing solenoid armature 404 upwardly in the drawing shown in FIG. 2, and thus removing armature 404 from slot 108. This frees the length of slot 108, thereby enabling pins 110 to travel along the arcuate lengths of corresponding slots 108 as a manual torque applied to key 500 rotates plug 116 and cam assembly 140. In the normal locked position, shown in FIGS. 2 and 3, armature 404 obstructs one of the two slots 108, thus preventing cam 126 from rotating and drawing bolts 112 inwardly. Solenoid assembly 400 may be mounted upon and supported by circuit board 139. Cover 128 encases circuit 139 within the housing provided by the inner side of cam plate 126, while pins 110 protrude into grooves 108. Bolts 112 slide between guides 410 and the adjoining portion of door 408.

Figure 5:
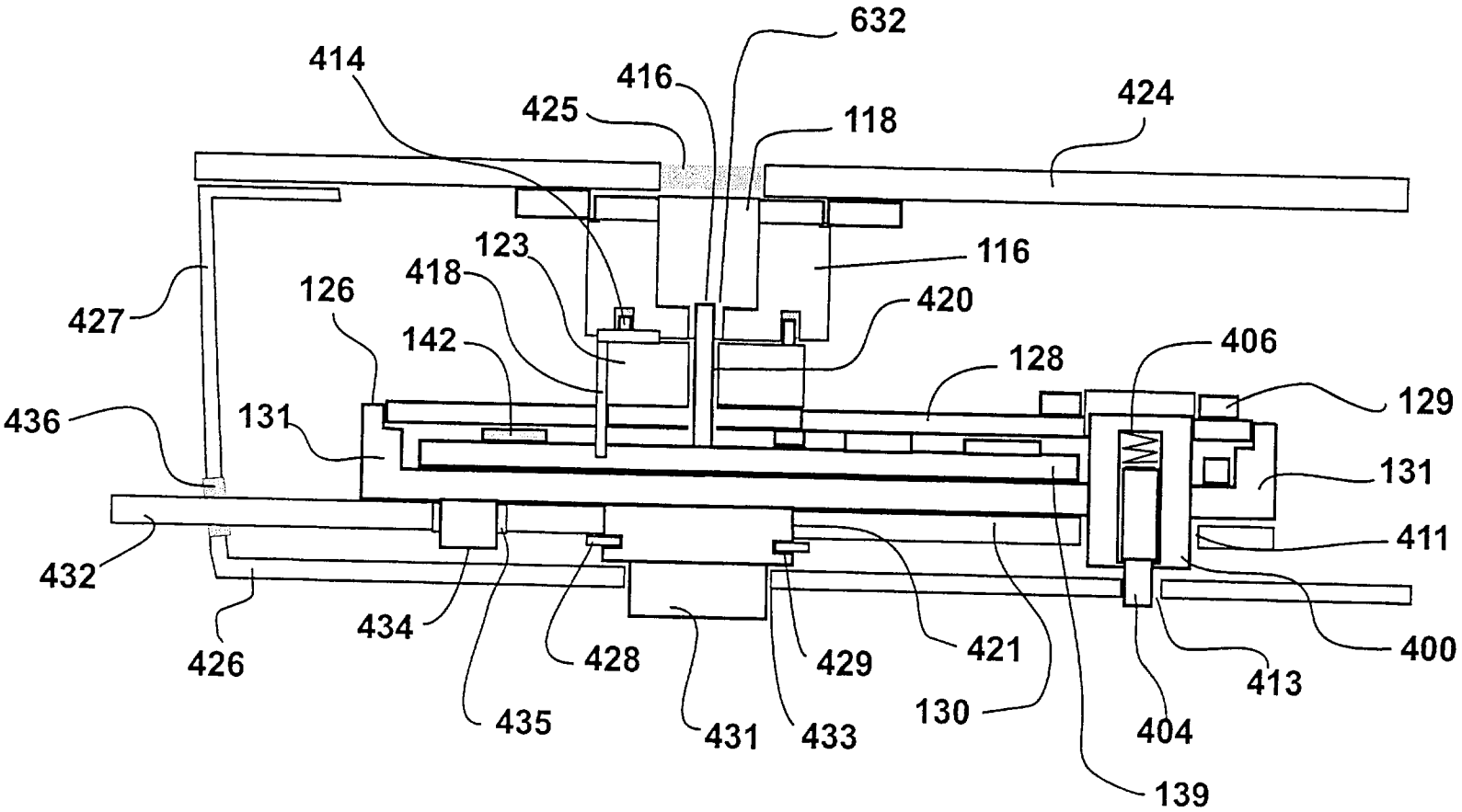
FIG. 5 shows a cut-away side view of another embodiment of the present invention suitable for use with metal office furniture.
Figure 6:
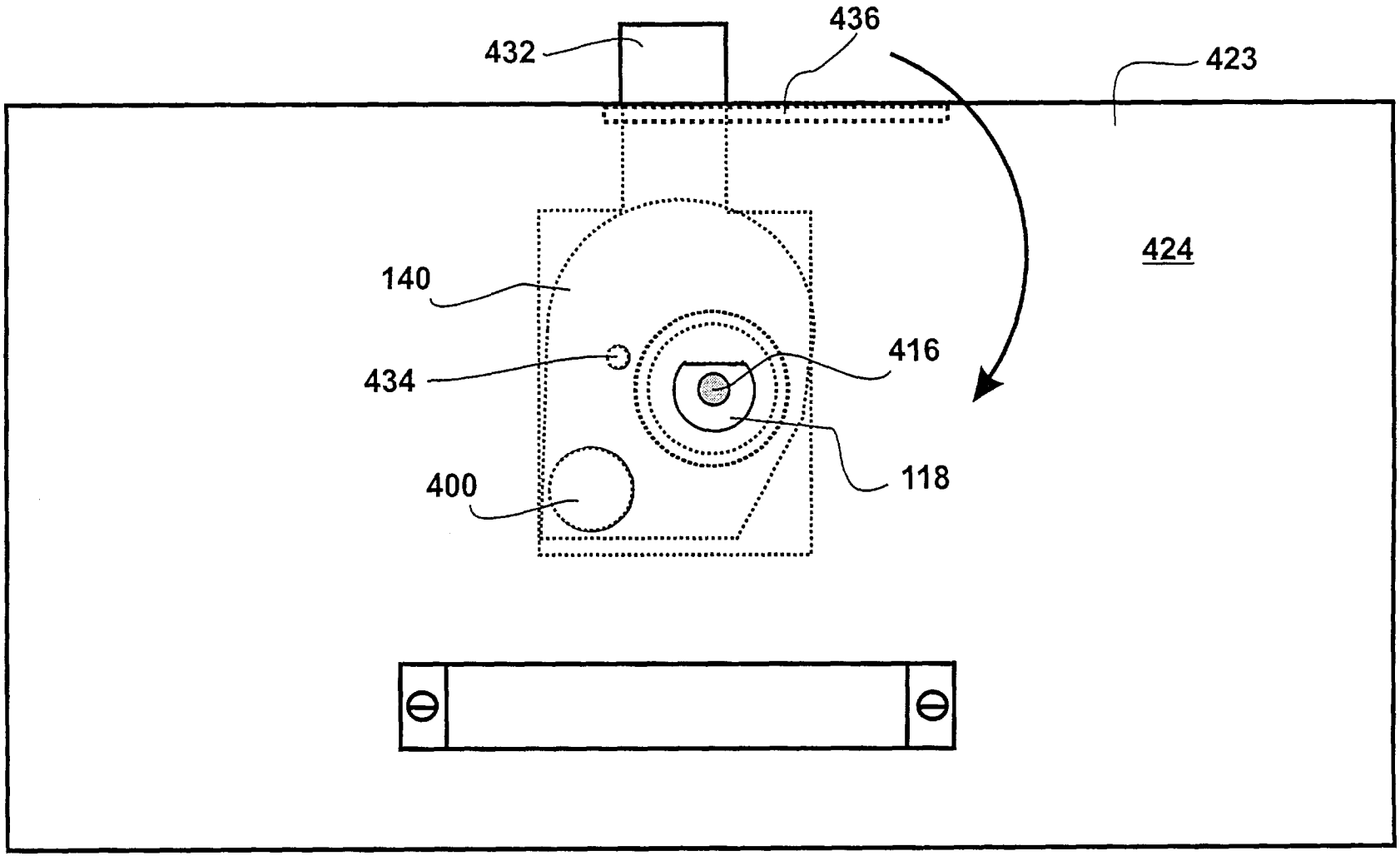
FIG. 6 shows a front elevational view of a drawer for office furniture fitted with the embodiment shown in FIG. 5.
Figure 9:
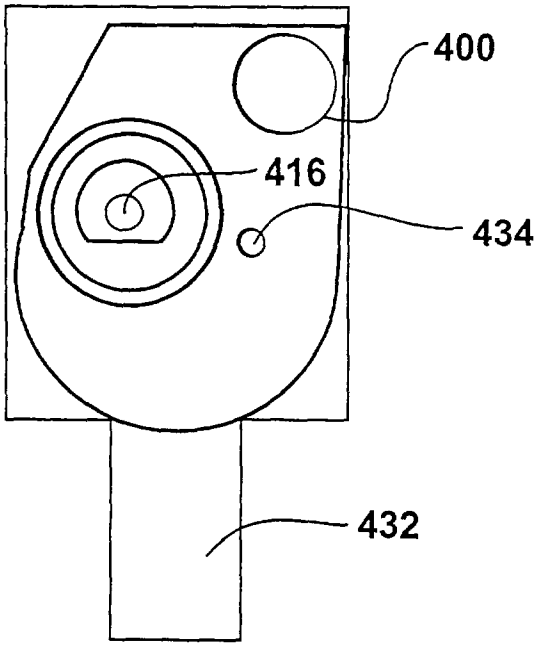
FIG. 9 shows an assembly of the conversion plate and electric cam incorporated into the embodiment of FIG. 5.
Figure 8:
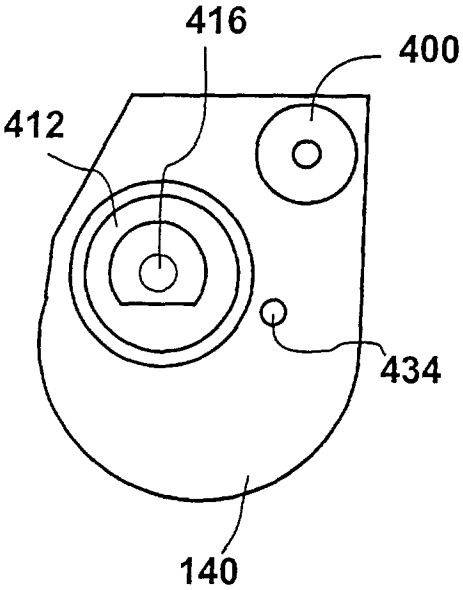
FIG. 8 shows an electronic cam incorporated into the embodiment of FIG. 5.
Figure 7:
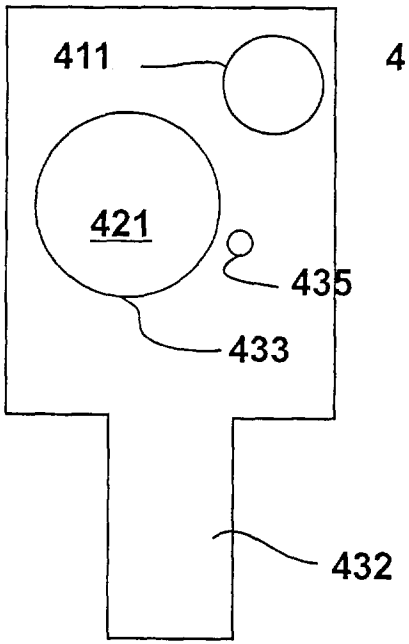
FIG. 7 shows a conversion plate incorporated into the embodiment of FIG. 5.
Figure 10:
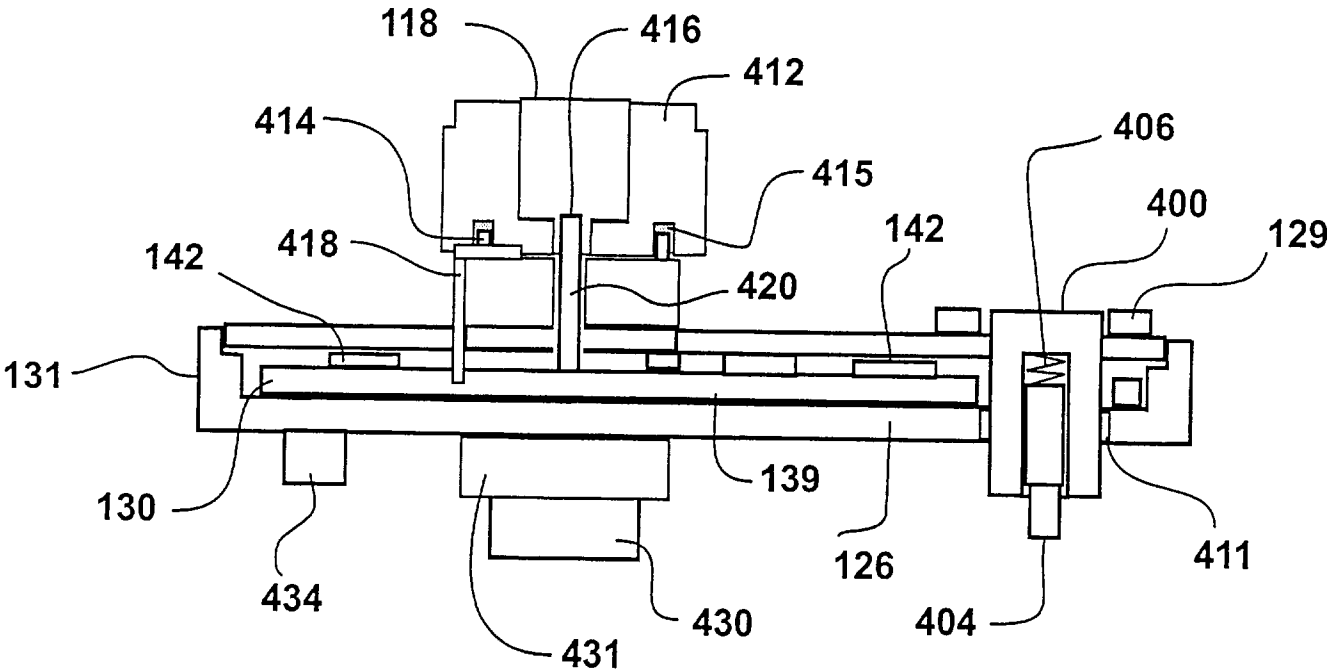
FIG. 10 shows a side elevational view of a cam assembly suitable for installation into the container illustrated by FIG. 5.

Turning now to FIG. 5, an alternative embodiment is illustrated with a cam plate and housing 126 preferably made of an electrically insulating material, installed between a cylinder plug 412 and the rear wall 426 of the door of the item of furniture. Plug 412 is mounted with washer 422, and is in contact with the front wall 424 of the door of the item of furniture, with keyway 118 aligned with hole 425 in front wall 424. A pair of shear pins 414 extend between an extension 123 of cam plate 126 and fit into conforming apertures 415 in the base of cylinder plug 412, thereby linking rotation of plug 412 with rotation of plate 126. A single hole 413 is formed within rear wall 426, in alignment with the armature 404 of solenoid 400. In its inactive, normally inoperative state as shown in FIG. 5, armature 404 rests within aperture 413 under the bias of spring 406.

A second hole 433 is formed in rear wall 426, in substantial coaxial alignment with keyway 118, to accommodate pivot post 430 of cam spacer post 431, which serves to support cam plate 126 upon post 430, thereby fastening the entire assembly against the rear wall 426. A Truarc® ring 428 holds post 431, together with plate 126, against cam plate extension 432. Drive pin 434 protrudes from the underside of cam plate 126 opposite circuit board 139, and is received by a conforming aperture 435 within extension plate 432.

Turning now to FIGS. 6 through 10 in conjunction with FIG. 5, extension plate 432 protrudes beyond a slot 436 cut into the flange 427 extending between front wall 424 and rear wall 426. When a hand held key conforming in shape to the interior of keyway 118 is fully inserted into keyway 118, the blade of the key makes electrical contact with contact wiper 416 mounted upon circuit board 139 while an electrically separate contact pin spaced radially apart from the blade of the key makes electrical contact with the adjoining exposed surface of front wall 424 and, via electrical conduction through plug 412, with contact wiper 418 also mounted upon circuit board 139. Upon determination of electrical and logical compatibility of the key with circuit 130 mounted upon circuit board 139, solenoid 400 is electrically charged to withdraw armature 404 from aperture 413, thereby releasing cam plate 126 and plug 412 to rotate under the torque manually applied to the key, thereby enabling post 430 to rotate within aperture 433, thus allowing drive pin 434 to rotate about the axis of post 430 and thereby drawing extension plate 432 in a direction of arrow B shown in FIG. 6, through slot 436, thereby allowing door assembly 423 to be opened.

Figure 11A:
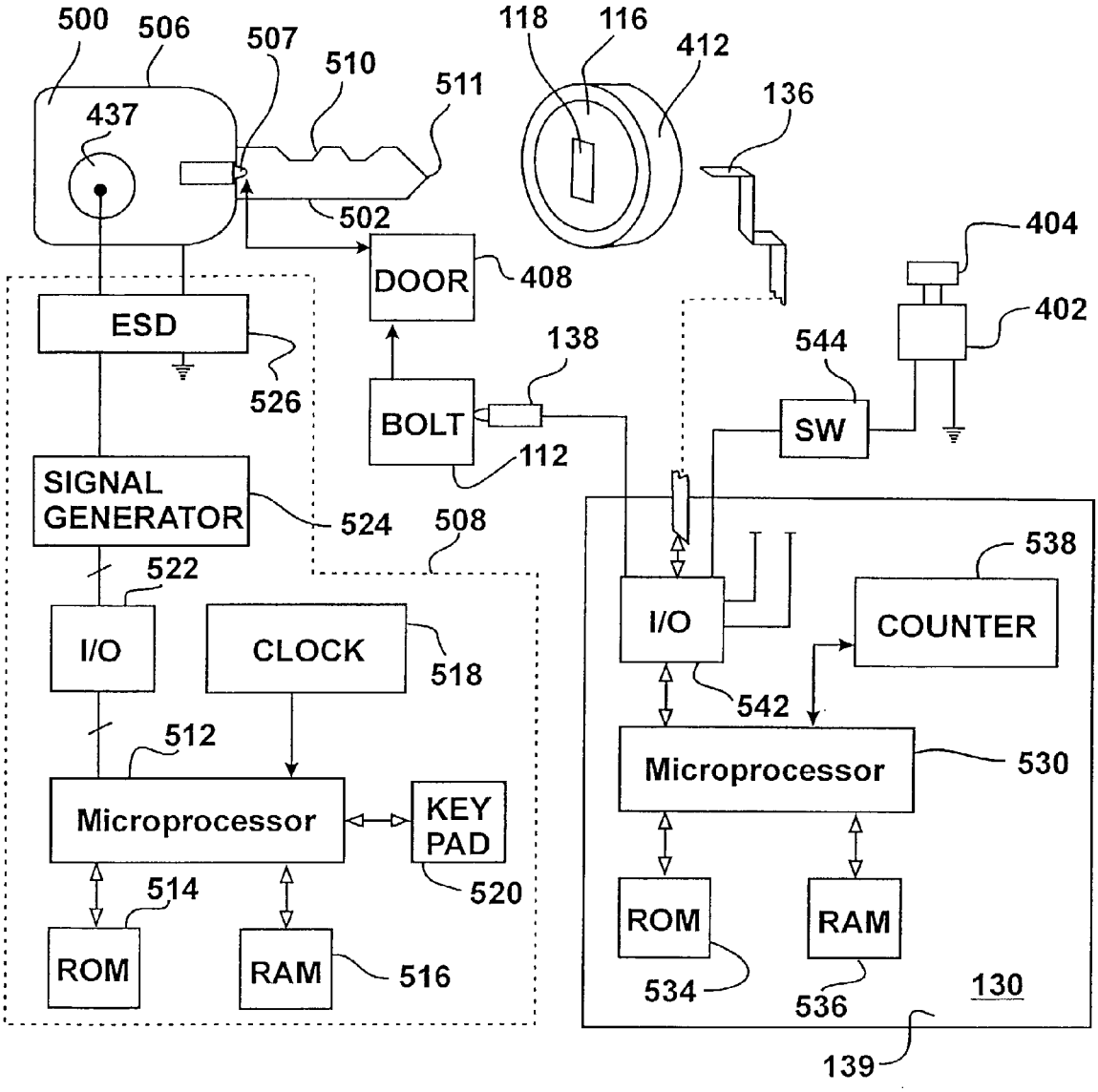
FIG. 11A is a block diagram schematic illustrating electrical circuits that may be incorporated into the practice of the present invention.

Turning now to FIG. 11A, block diagrams illustrate electronic circuit 130 for the cam assembly and electronic circuit 508 for the corresponding electronic key assembly 500 mechanically and electrically conforming to cylinder plug 116 and its electronic circuit 130. Circuit 508 is constructed within the head 506 of key 500 or, alternatively, into a portable housing electrically coupled to key 500. As shown in FIG. 11A, a replaceable battery (e.g., a 3.3 volt button battery) may be removably encased in the head 506 of key 500, with the positive plurality coupled in common to one side of electronic signal filter 526 and the bitted blade 502 of the key. In this embodiment, blade 502 is mechanically cut with teeth 510 and channels 511 conforming to keyway 118. Blade 502 is positively charged by battery 437, and makes electrical contact with, and provides transmission of both power and data to circuit 130 via flexible contact wiper 136 mounted upon circuit board 139, which is, in turn, coupled to input/output stage 542. A local ground return between circuit 130 and circuit 508 is provided via flexible spring loaded electrical contact 138 making electrical contact with bolt 112 which, in turn, makes electrical contact with the electrically conducting door 408 of the container; a spring loaded pin 507 extending from the head 506 of key 500 rides upon and makes electrical contact with door 408.

Circuit 508 may be constructed with a microprocessor 512 driven according to a programs stored in read only memory 514, using data transient in random access memory 516. A clock 518 provides synchronization to microprocessor 512, while input/output stage 522 services as a buffer enabling microprocessor 512 to drive signal generator 524. Circuit 508 is electrically powered by battery 437.

When key 500 has been fully inserted into keyway 118, blade 502 makes electrical contact with spring biased data and power contact 136, while the radially spaced-apart spring bias contact 504 serves as a ground return making electrical contact with the surrounding region 409 of door 408 and, through bolt 112, electrical contact 138 and input/output stage 542. Within logic and control circuit 130 of the cam assembly, microprocessor 530 operates according to a program stored within read only memory 534 using data written into and read from random access memory 536. Counter 538 is coupled to microprocessor 530. Communication between the logic circuit 130 and contacts 136, 138 are conducted through input/output stage 542. A switch 544 is driven by input/output stage 542 under control of microprocessor 530 upon a determination by microprocessor 530 that key 500 holds a digital signature that electronically conforms to data stored within the circuit borne by circuit board 139, to provide electrical current through solenoid coil 402 and thereby retract armature 404 or, alternatively, if the solenoid is constructed as a stepping motor, to energize coil 402 and thereby rotate armature 404. The circuit illustrated in FIG. 11A is particularly suitable for retrofitting secured containers such as existing stand-alone, municipal curbside parking meters.

Figure 11B:
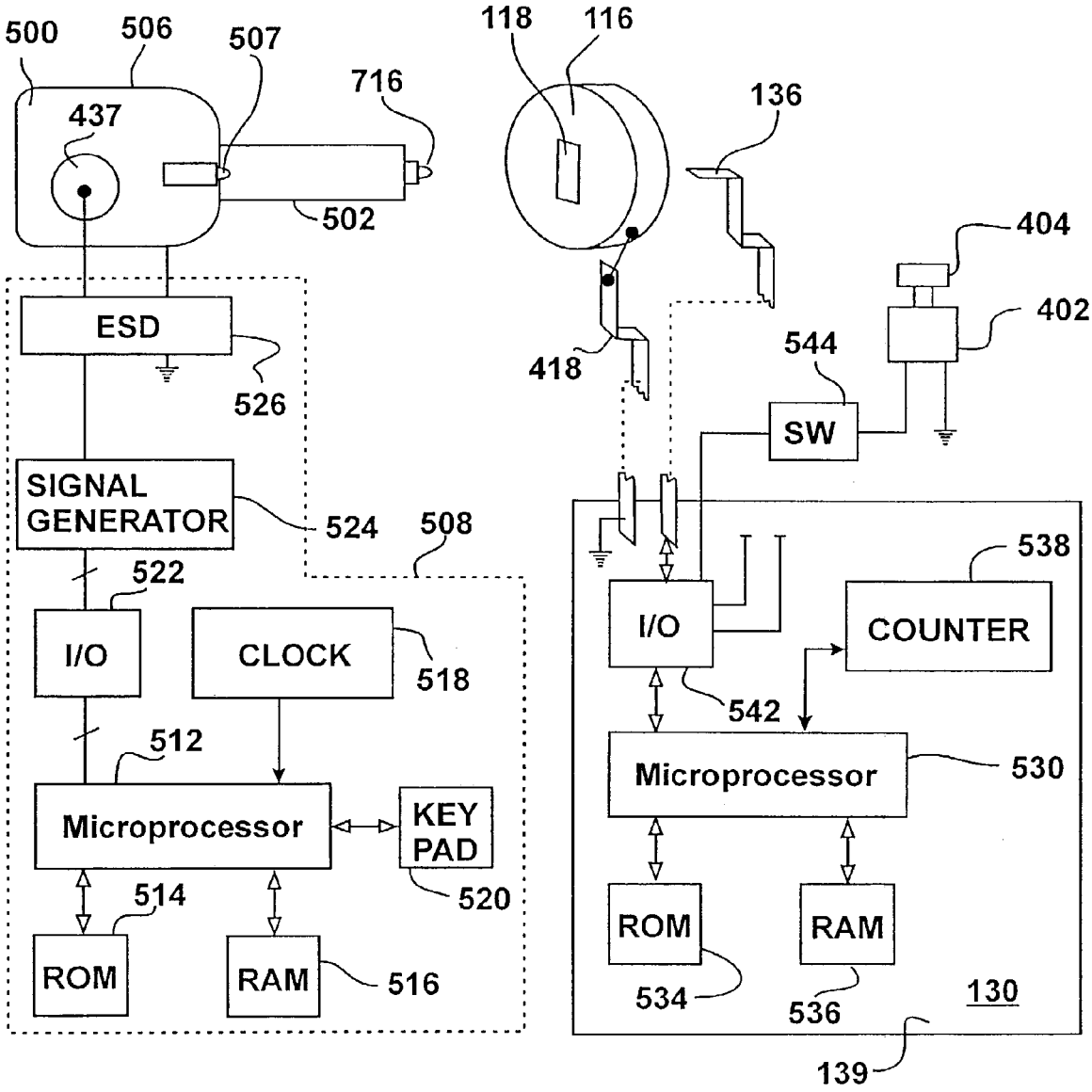
FIG. 11B is a block diagram schematic illustrating an alternative configuration of electrical circuits that may be incorporated into the practice of the present invention.

Turning now to FIG. 11B, key assembly 500 has a blade 502 without bits or channels, bearing a centrally positioned electrical data and power contact 716 coupled to the positive polarity of battery 437. Contact 716 is electrically insulated from the exterior surface of blade 502. Blade 502 serves as the negative ground return via electrical contact 418 while contact 716, serves as the power and data connector when fully inserted into keyway 118, to make electrical contact with flexible spring contact 416. Flexible, spring type electrical contact wipers 416, 418 may be surface mounted upon circuit board 139, in positions to make electrical contact respectively with contact 716 via keyway 118 and the electrically conducting cylinder plug 412. Solenoid winding 402 is either surface mounted on, or supported by, circuit board 139.

Figure 11C:
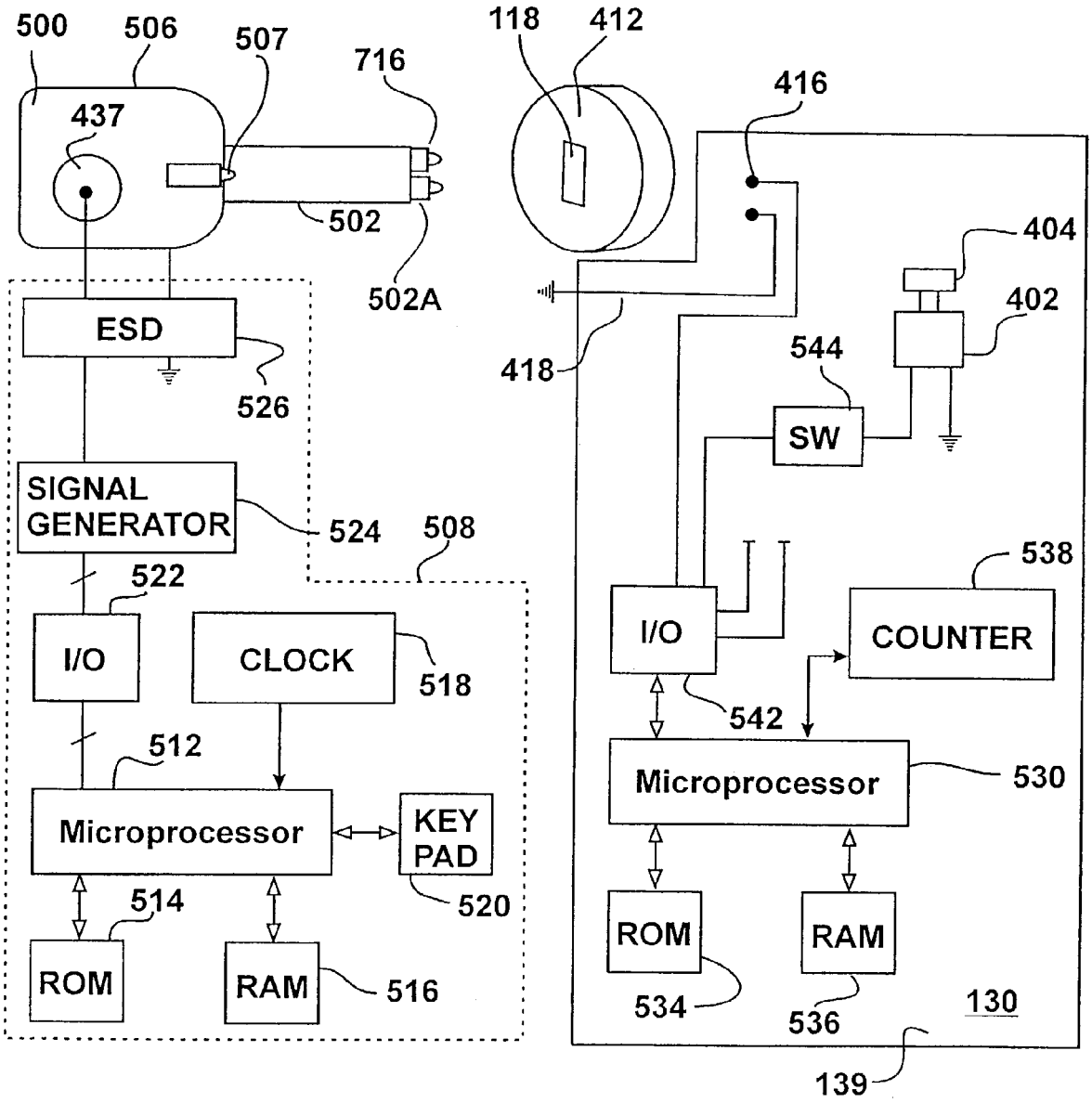
FIG. 11C is a block diagram schematic illustrating another alternative configuration of electrical circuits that may be incorporated into the practice of the present invention with a plurality of contacts accessible through the keyway.

As illustrated by FIG. 11C, the electronic circuit for the cam assembly may be equipped with its own local power supply in the form, for example, of a replaceable battery (not shown) installed on and wholly borne by circuit board 139 to provide a constant voltage to circuit components such as microprocessor 530, memories 534, 546, counter 538, and input/output stage 542, and to provide a source of electrical power for energizing coil 402 of the solenoid via switch 544. In this configuration the cylinder plug is not required to serve as a ground electrical path for the connection between the key and lock circuit 139. Use of an earth ground would be incidental. Leads 416, 418 are plated copper conductors formed on the circuit board 139, with lead 418 serving as a local ground terminal. On key circuit 508, pin terminal 502A serves as a ground conductor; terminal 502A may be a spring loaded pin or a flexible connection, positioned to make electrical contact with lead 418 when the blade, or shank 502, of key 500 is conformingly inserted into the aperture of keyway 118. A spring loaded ball bearing may be inserted within keyway 118 to mate with a corresponding dimple in shank 502, and serve as a key retainer when key 500 rotates keyway 118 out of its rest position. Terminal 502A may be connected without electrical insulation to shank 502, thereby connecting circuit 508 via shank 502. Pin terminal 716 serves that same function as shown in the embodiment illustrated by FIG. 11B, and is electrically insulated from shank 502 in order to conduct data signals and provide a positive potential to circuit 139 via lead 416.

Figure 11D:
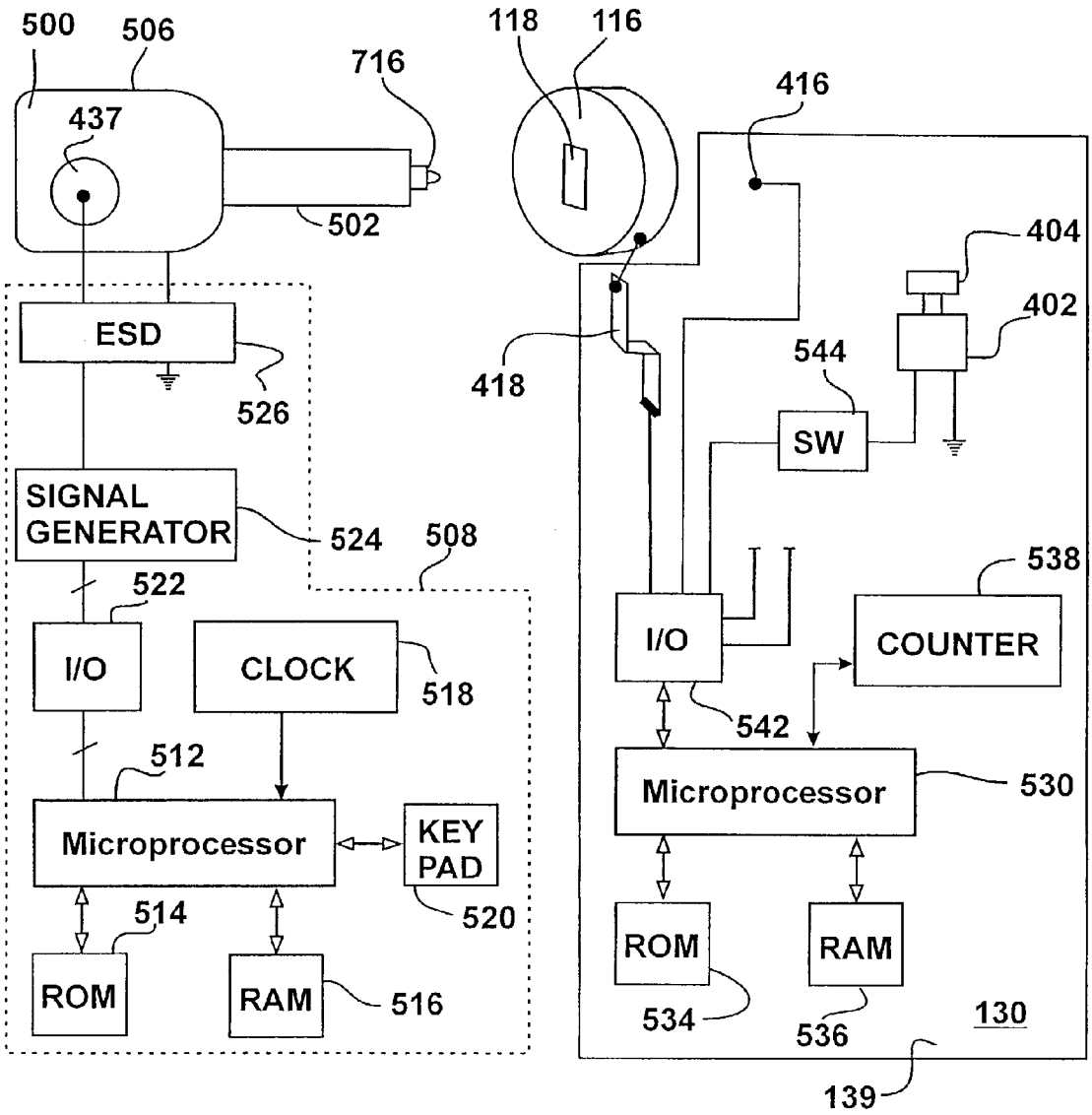
FIG. 11D is a block diagram schematic illustrating another alternative configuration of the electrical circuits that may be incorporated into the practice of the present invention with a single contact accessible through the keyway.

FIG. 11D illustrates an alternative embodiment with the cylinder plug 412 serving as an electrical ground path for electrical connection between key circuit 508 and lock circuit 139. Lead 416 is a copper lead plated upon circuit board 139, and is directly accessed by terminal 716 via keyway 118 to electrically conduct, for example, a positive potential and data signals. The key blade, or shank 502 serves as the ground terminal for key circuit 508. Terminal 716 is electrically insulated by shank 502 serves to electrically conduct a position potential and data signals in the same function as in the embodiment illustrated by FIG. 11B.

Figure 11E:
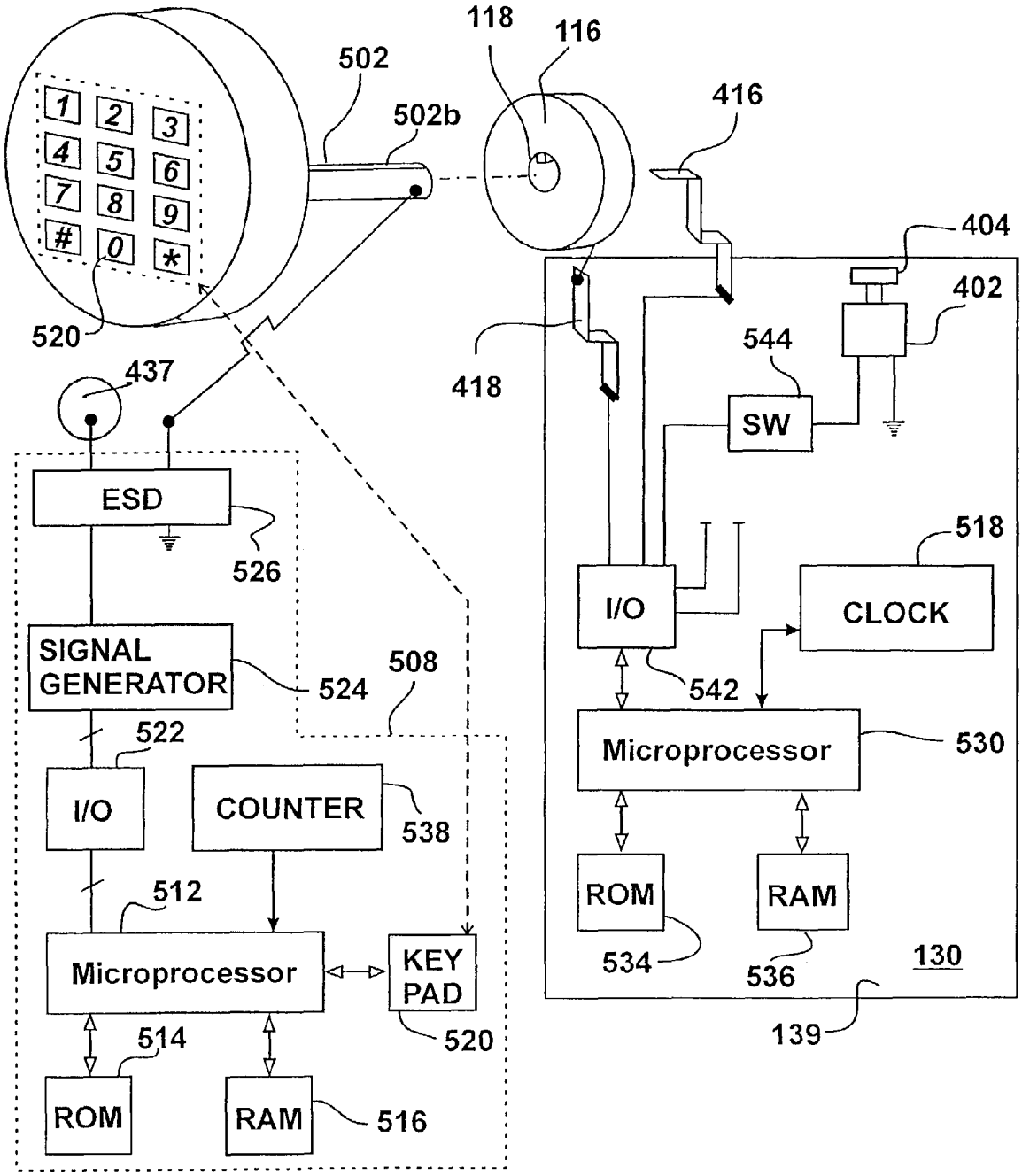
FIG. 11E is a block diagram schematic illustrating another alternative configuration of the electrical circuits that may be incorporated into the practice of the present invention using a drive spindle.
Figure 11F:
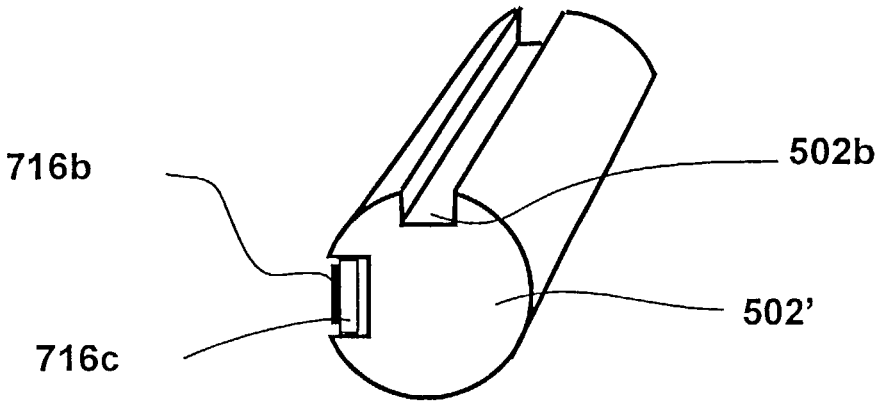
FIG. 11F is a perspective view of a drive spindle for the embodiment illustrated by FIG. 11E.

FIG. 11E illustrates an alternative embodiment bearing a keypad 520 that is exposed to manual activation by a user. A drive spindle 502', rather than a key blade, is used to apply torque to the electronic cam that bears and encases circuit 139. Once the drive spindle 502' has been electrically connected with the electronic cam circuit 139 via keyway 118', the spindle 502' may be left within keyway 118' and removed only for service and such maintenance as replacement of battery 437. Accordingly, with the exception of replacement of battery 437, lock circuit 139 would be continuously powered by battery 437 borne by key circuit 508. In this embodiment, lock circuit 139 could be equipped with merely a clock 528, while key circuit 508 contains a counter 538. As illustrated by FIG. 11F, drive spindle 502' may be constructed with an engagement keyslot 502*b* extending either partially, or wholly, the length of shank 502', to engage a corresponding detent within keyway 118. Spindle 502' may itself serve as an electrical conductor such as the ground return, that engages electrical lead 418 of lock circuit 139, while a second electrical conductor 716*b* extends the length of spindle 502' and is electrically insulated from the body of spindle 502' by insulation 716*c*. Conductor 716*b* may be constructed as either a circuit board with a tin, copper or gold plated trace, or an electrically conducting trace itself deposited directly upon insulation 716*c*. Conductor 716*b* could be set, after encased in electrical insulation, into a metallic spindle or encased in an electrically conductive plastic spindle may, for example, of carbon filled polymer.

Figure 12:
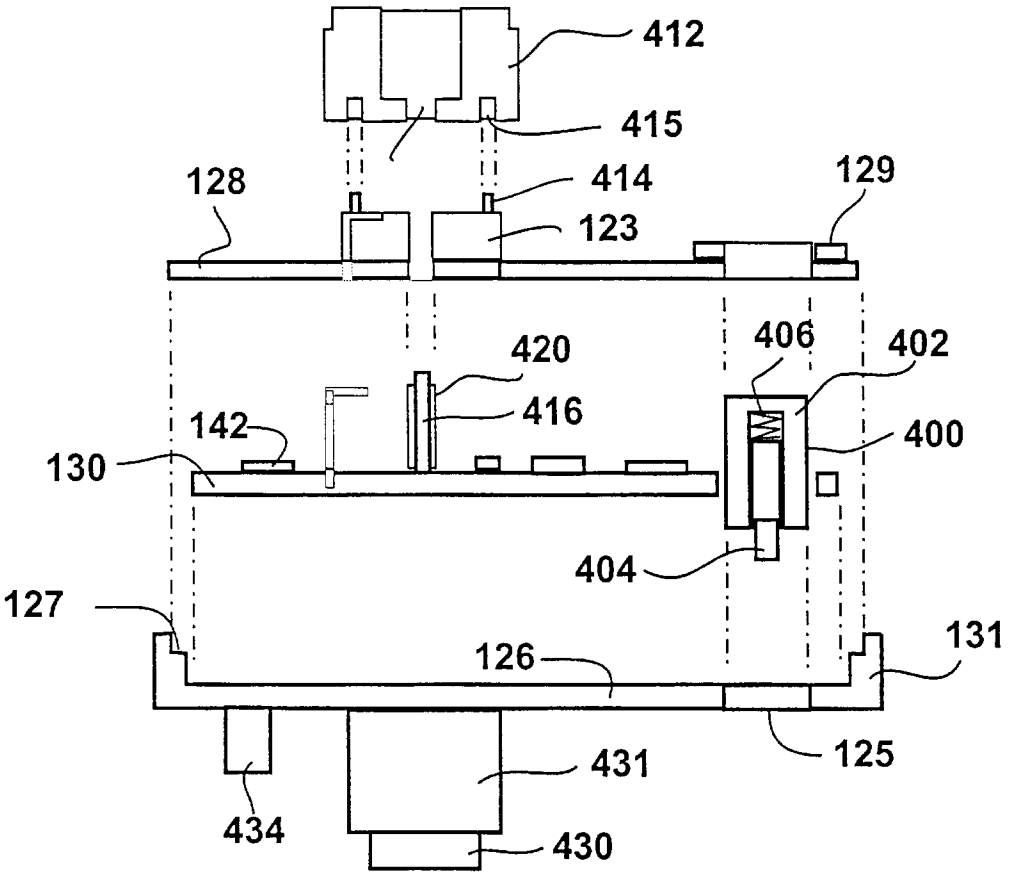
FIG. 12 is an exploded view illustrating details of the embodiment of FIG. 10.

When assembling the electronic cam, electrically conductive cylinder plug 412 bearing apertures 415, is positioned to receive within the apertures 415, corresponding shear lock pins 414 extending outwardly from cover 128 for the housing formed by cam plate 126. The solenoid release assembly 400 is mounted on circuit board 139, and circuit board 139 is in turn inserted within the circumferential walls 131 of cam plate 126, with surface mounted flexible spring electrical contact 416 centrally positioned to extend through cam plate extension 123 and into the vacant portion of keyway 118 in order to make electrical contact with the power and data conductor of the corresponding key. Contact 416 is surrounded by an electrical insulator 420 to prevent contact 116 from making electrical contact with either extension 123 or with electrically conducting plug 412. Cam spacing post 431 and pivot post 430 are concentrically positioned and coaxially aligned with keyway 118, to protrude from plate 126 toward the bolt (not shown in FIG. 12), while drive pin 434 extends axially in the same direction toward a corresponding aperture in the bolt.

Figure 13:
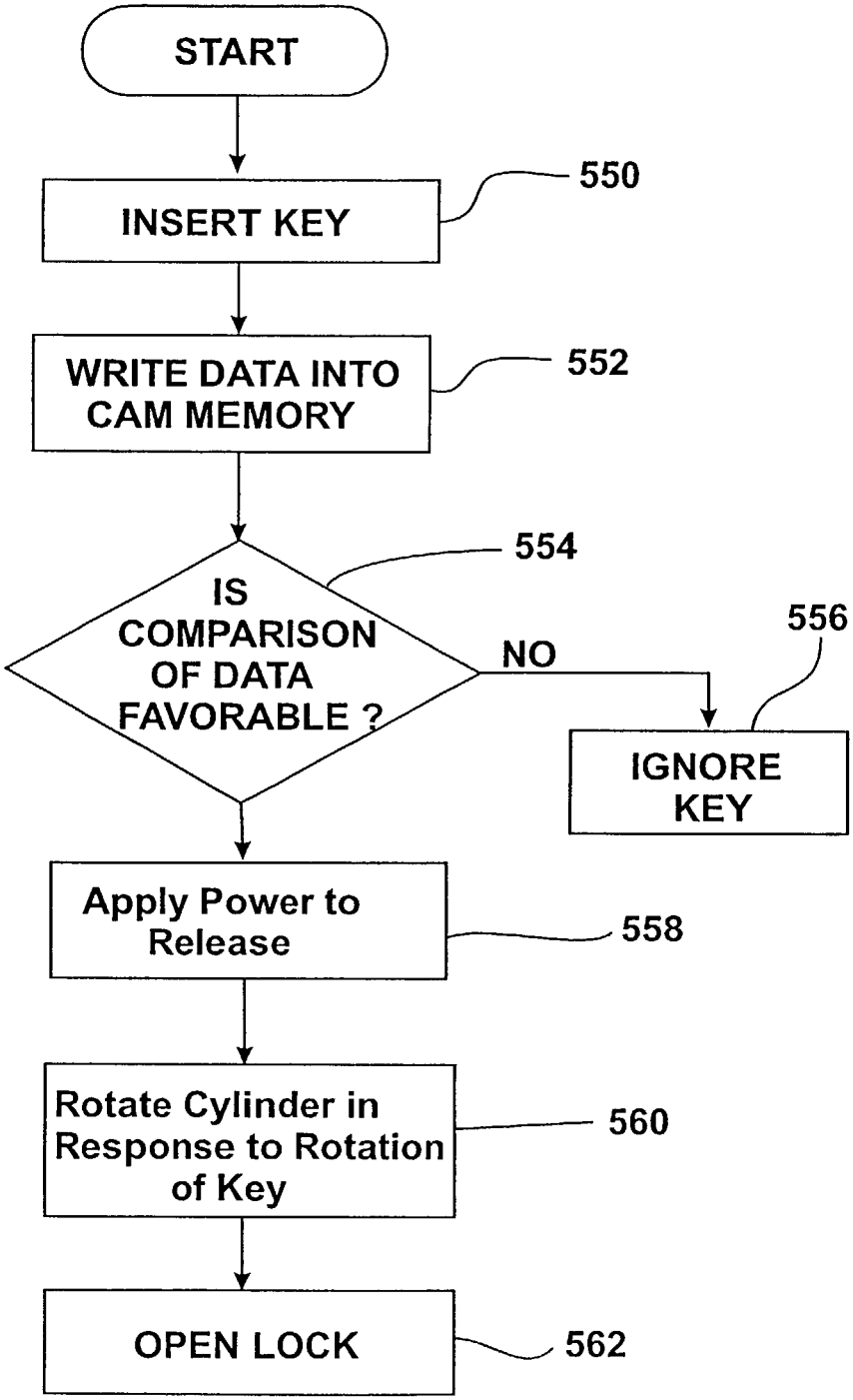
FIG. 13 is flow chart illustrating the principles of operation of the present invention.

In an operation, the key is inserted into the keyway as shown in step 550 of FIG. 13. Power is supplied from battery 437 via contact 136 to cam circuit 130, and data is written via contact 136 into memory 536. A comparison is then made by microprocessor 530 and if the data carried by the key is not electronically conforming to data held by circuit 130, in step 550 circuit 130 ignores the presence of the key. Alternatively, if the key is found by circuit 130 in step 554 to be electronically conforming, in step 558 circuit 130 applies power to switch 544 and solenoid (or motor) 400 to release cylinder 116 to the rotational torque manually applied by the key to the lock, thus enabling in step 560 rotation of the cylinder in response to the manual torque, and thereby resulting in opening of the lock in step 562.

Figure 14:
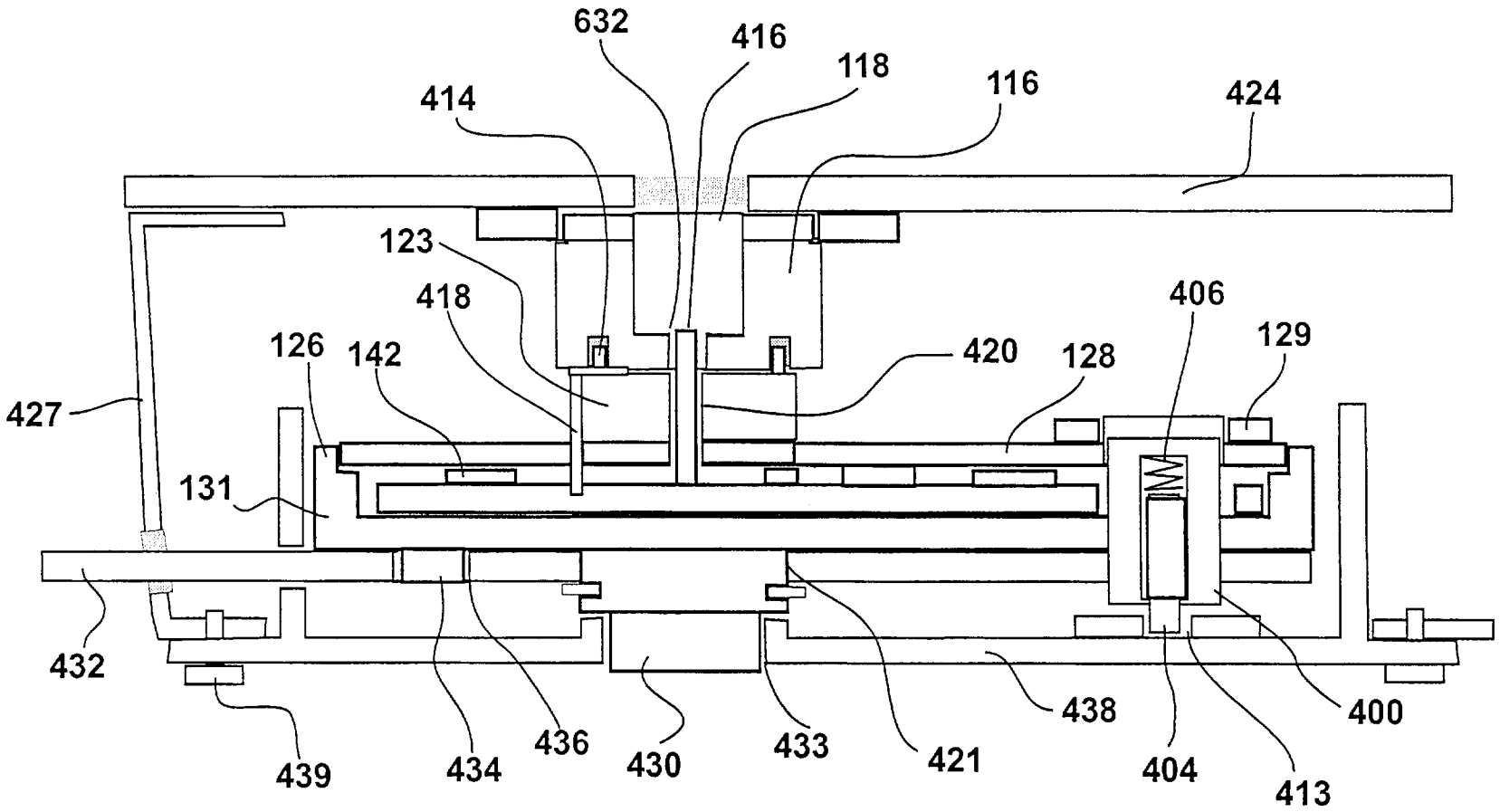
FIG. 14 is a front elevational view of a drawer fitted with an embodiment of the lock shown in FIG. 10.

In FIG. 14, a drawer of an item of furniture is fitted with a lock constructed according to the principles of the present invention, with a carrier housing 438 serving as the rear wall, attached to flange 427 via threaded fasteners 439. This allows for a modular improvement using an embodiment of the present invention as a separate item installed within the furniture.

Figure 15:
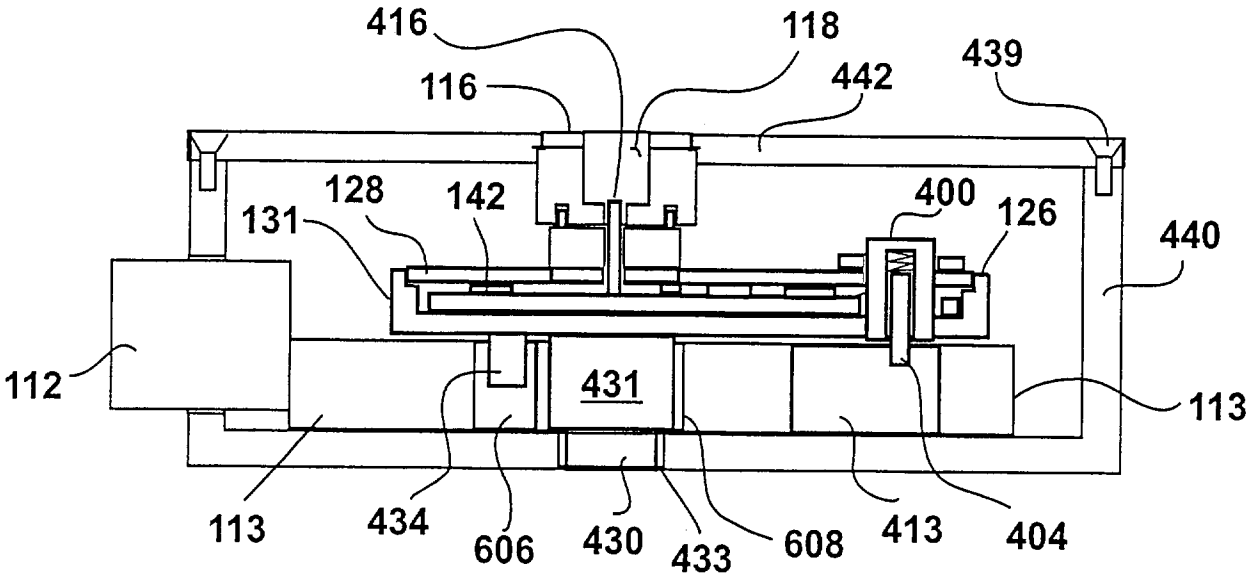
FIG. 15 is a cross-sectional view taken along sectional line XV-XV' in FIG. 17, showing a fourth embodiment of the present invention equipped with a vault.

Turning now to FIG. 15, an alternative embodiment of the present invention is shown with a construction particularly suitable for installation in a safety deposit box door within a bank vault. An aperture 433 in the rear wall of housing 440 for a lock, accommodates insertion and operational rotation of pivot post 430. The shank 113 of bolt 112 lies upon the inside surface of housing 440. Aperture 608 in shank 113 accommodates spacer 431 while aperture 606 accommodates drive pin 434 to force shank 113 to slide against the interior surface of housing 440.

Figure 17:
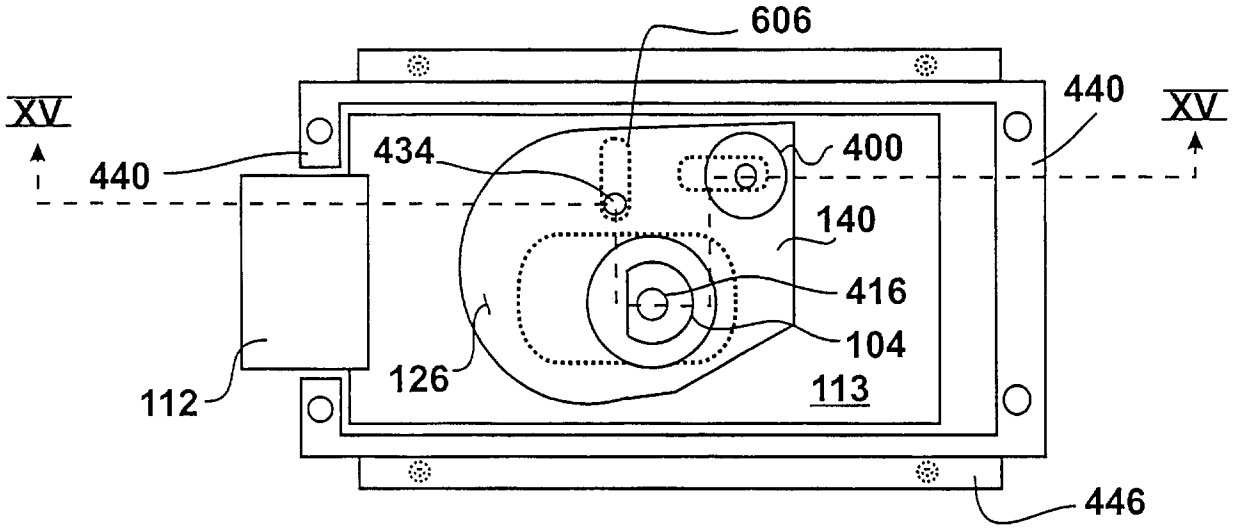
FIG. 17 is a plan view showing the assembly of the embodiment illustrated in FIG. 15.
Figure 16:
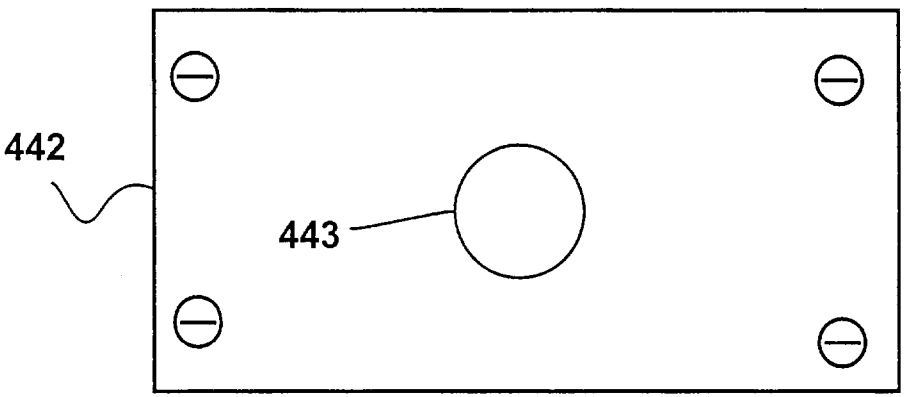
FIG. 16 shows a cover that may be attached to the embodiment of FIG. 15.
Figure 18:
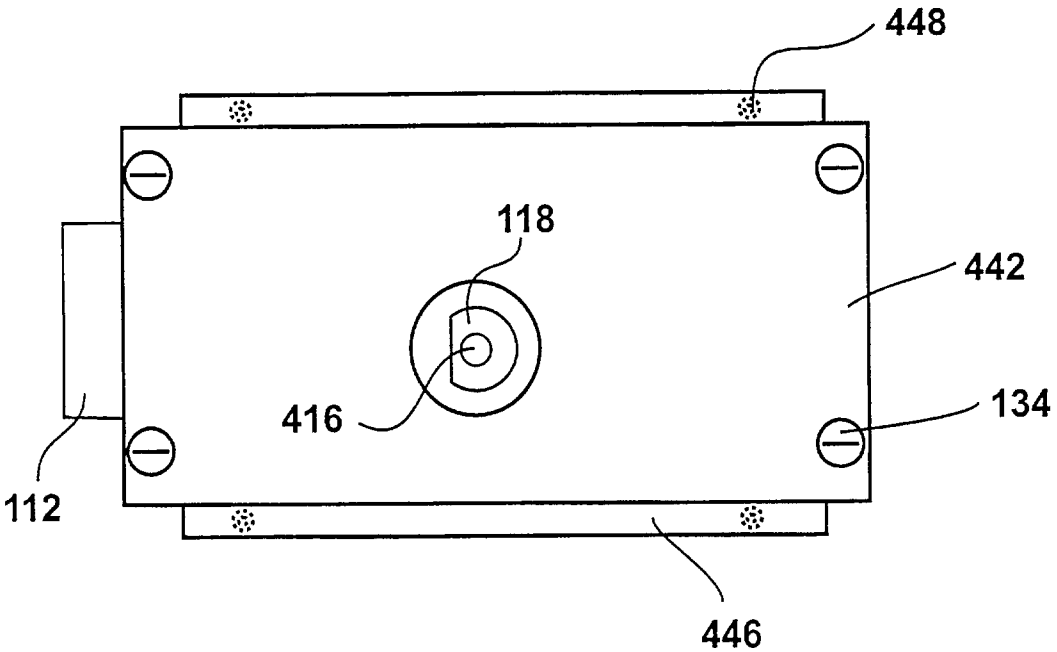
FIG. 18 is a plan view showing the assembly with the cover illustrated in FIG. 16 mounted upon the housing illustrated in FIG. 17.
Figure 19:
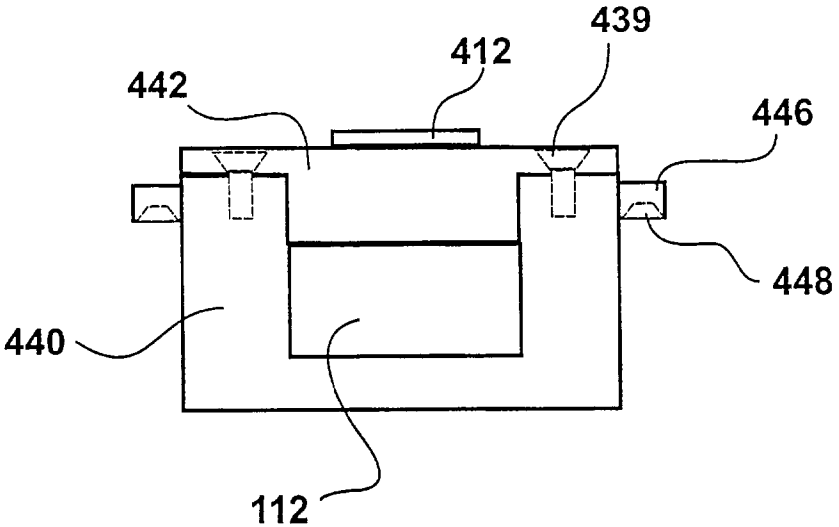
FIG. 19 is an end view of the embodiment shown in FIG. 18.
Figure 20A:
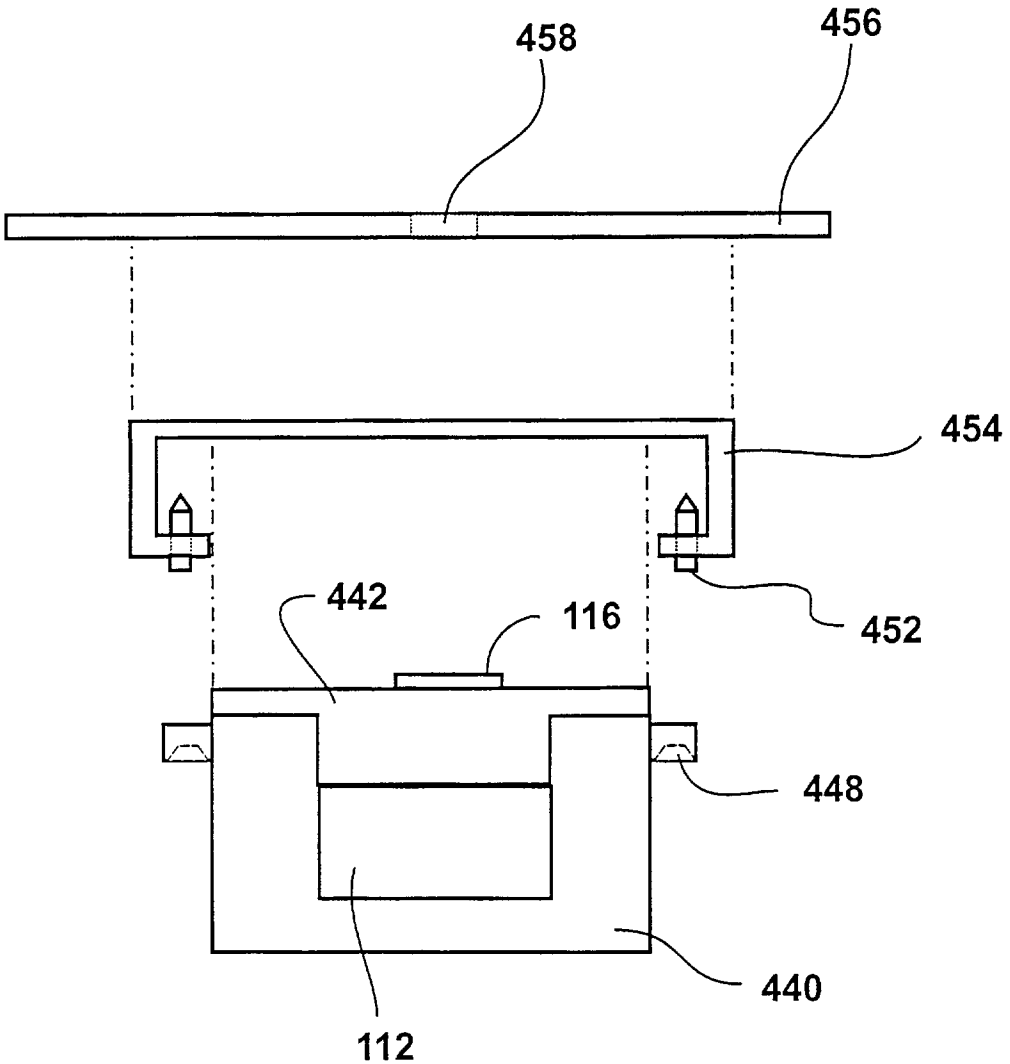
FIG. 20A is an exploded view showing the embodiment of FIG. 19 incorporated into a safe deposit door.
Figure 20B:
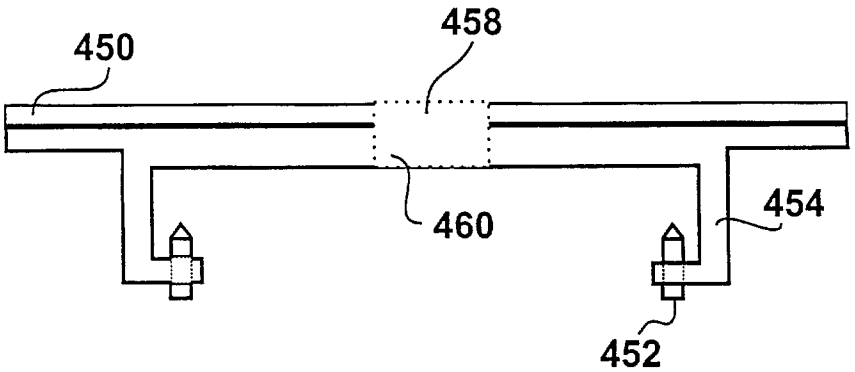
FIG. 20B is an assembled view showing a channel attached to the safe deposit door.
Figure 21:
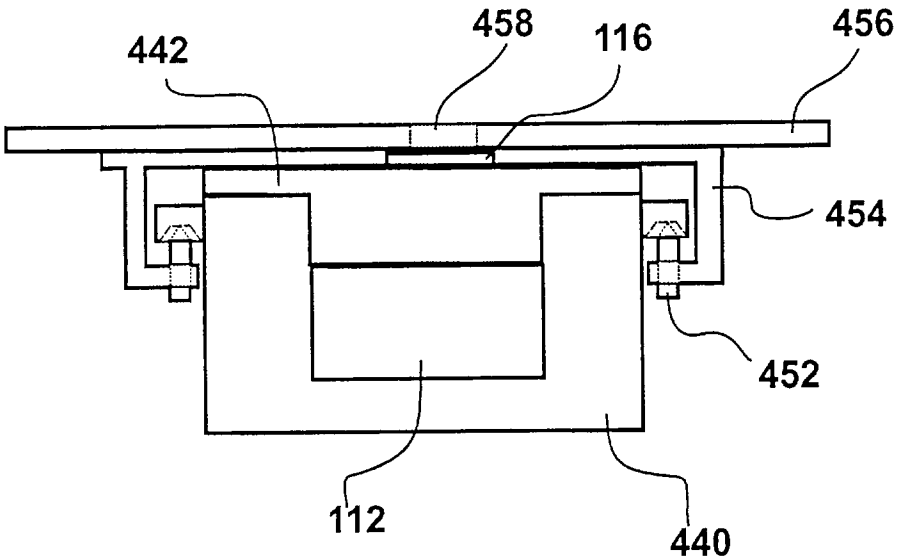
FIG. 21 is an end view of the assembly illustrated in FIG. 20.
Figure 22:
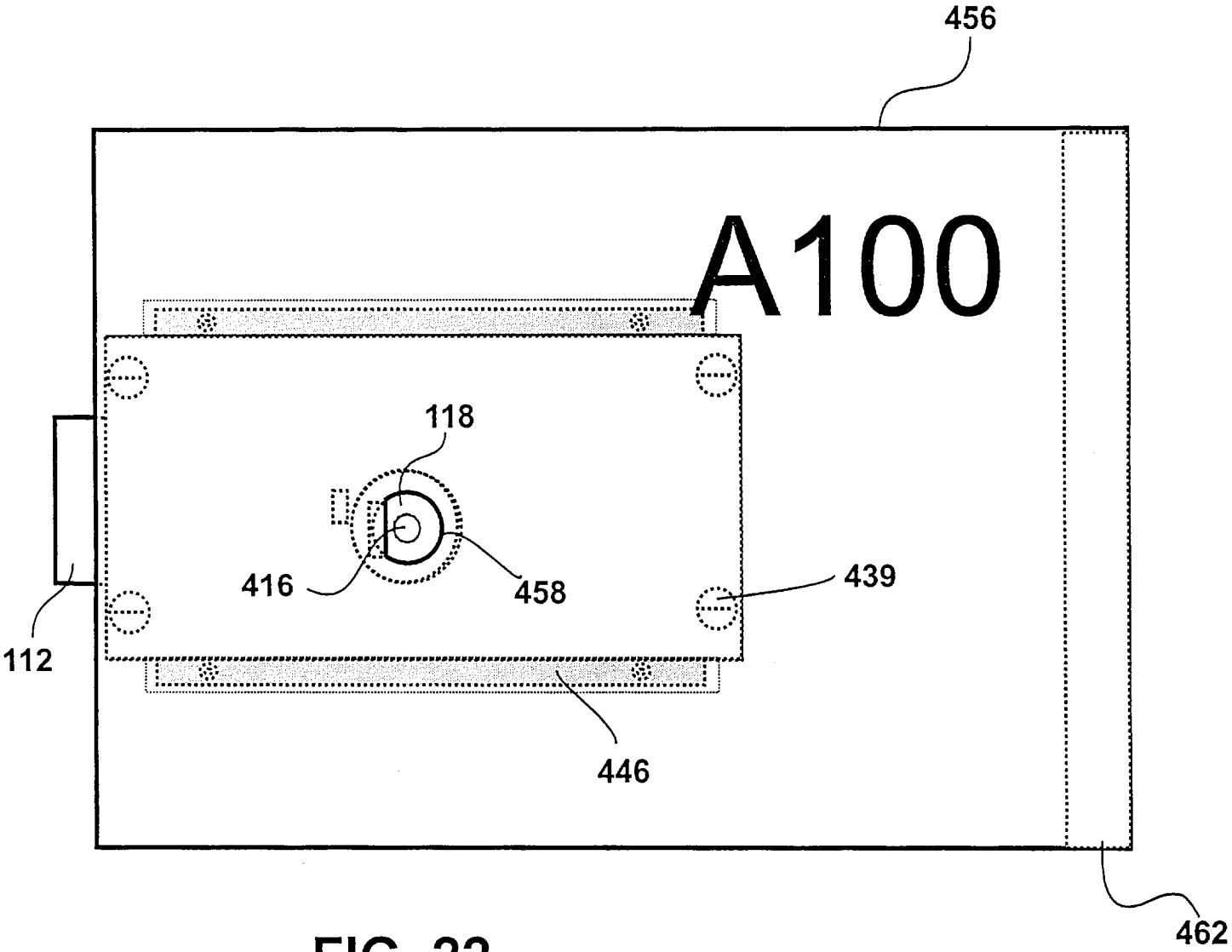
FIG. 22 is a front elevational view of the embodiment of FIG. 21.
Figure 23:
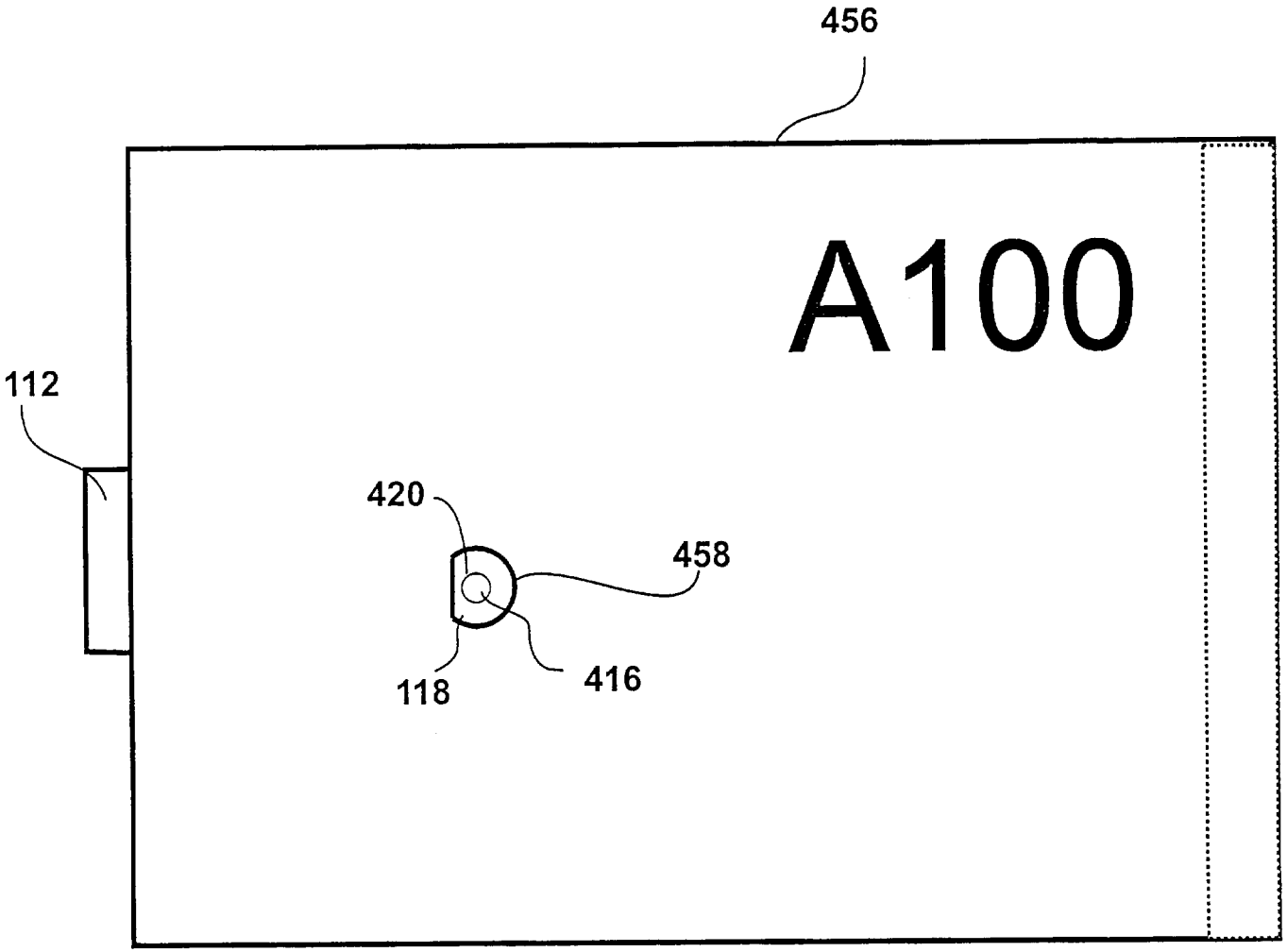
FIG. 23 is a front elevational view of a safety deposit door fitted with an embodiment of the present invention.
Figure 24:
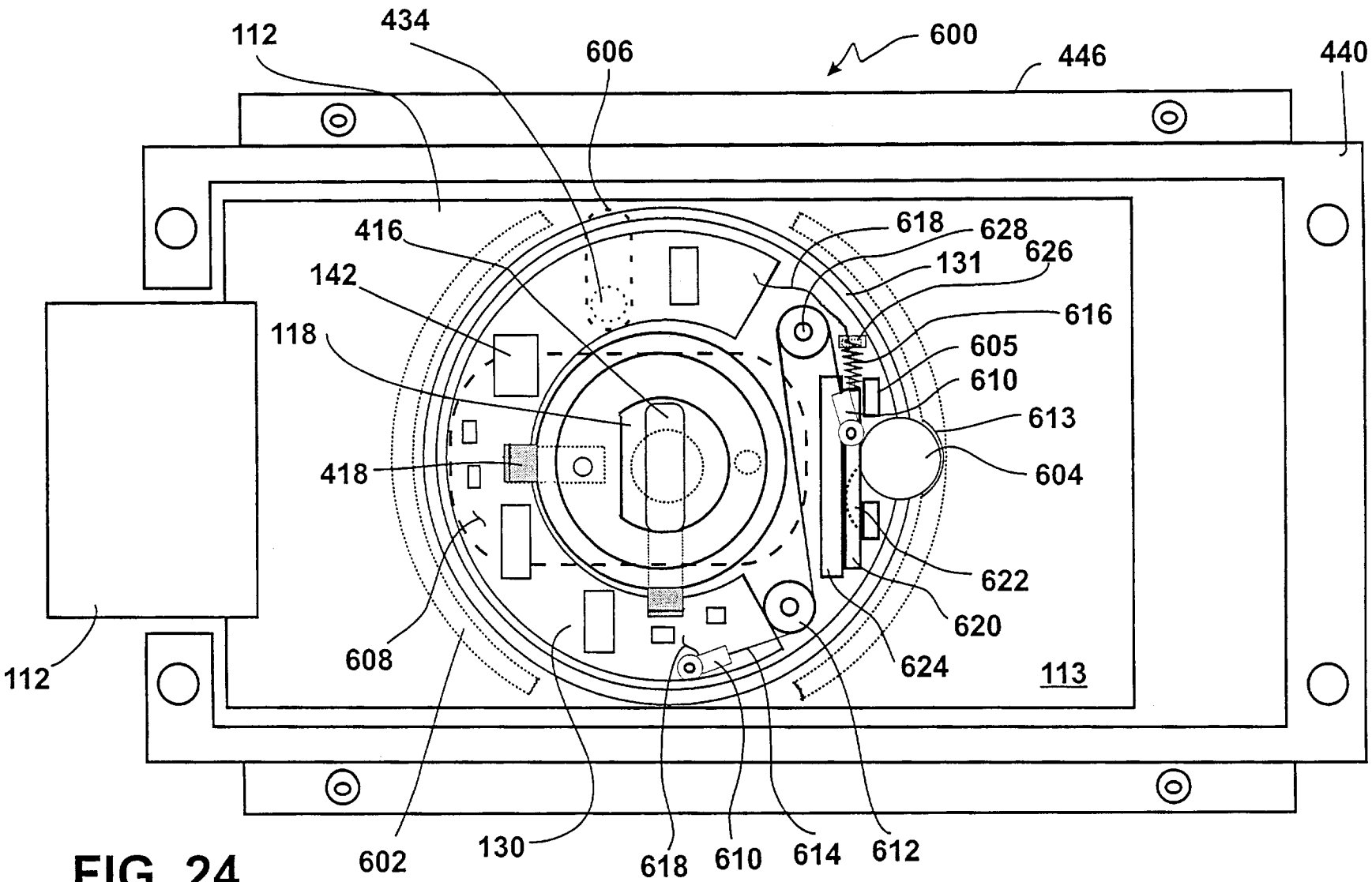
FIG. 24 is a plan view showing details of another embodiment constructed according to the principles of the present invention, while in a locked state.

Looking now to FIGS. 15, 16 and 17 in combination, insertion of an electrically conforming key into keyway 118 will, after electrical exchange of data via power and data conductor 416, enable circuit 130 mounted upon circuit board 139 to energize the coil of solenoid 400 and withdraw armature 404 against the force of return compression spring 406, thereby enabling torque manually applied by the key to cylinder plug 116 to rotate cam plate extension 123 and in turn, cam plate 126; as cam plate 126 rotates about pivot 430, drive pin 434 engages the surface of slot 606 formed in shank 113, and as the clockwise rotation of the torque applied to cam plate 126 drives drive pin 434 through a clockwise arc, drive pin 434 travels through slot 606 while forcing shank 113 to the right in FIG. 17, thereby retracting bolt 112. Subsequent counterclockwise rotation of the key to the position shown in FIG. 17, enables spring 406 to force armature 404 back into slot 413 after termination of the electrical current through the coil of solenoid 400. Cover 442 may be attached to housing 440 by threaded fasteners 439.

Considering FIGS. 15 through 23 collectively, the assembled housing 440 with cover 442 and protruding flanges 446 exposed on opposite sides of housing 440, may be received within channel 454 to enable set screws 452, or other detents, to be inserted within set screw detents 448. Once channel 454 is securely attached to the thin safety deposit door 456 with D-shaped key hole 458 aligned substantially coaxially with plug clearance hole 460 as shown in the assembled view of FIG. 20B, cylinder plug 116 will be substantially coaxially aligned with plug clearance hole 460 and D-shaped key hole 458 of channel 454 and door 456, respectively. As shown in the elevation view of FIG. 22, this enables bolt 112 to protrude substantially beyond the left side of the door while in the locked position. Consequently, the entire lock assembly 140 as well as the pins 462 for door 456, are concealed, with only board mounted data and power electrical contact 416 visible through keyway 118, as is more apparent from FIG. 23.

Turning now to FIGS. 24 through 27, an alternative embodiment constructed with a pair of electrically conductive attachments 610, one of which is mounted upon circuit board 139 and one of which is mounted upon unlocking detent 622, terminate opposite ends of the length of relatively thin wire made of a paramagnetic alloy of a shape-memory alloy such as a NiTiNol wire 614. The locking device 600 is constructed with a cover 442 having a pair of spaced-apart, oppositely facing arcuate guide walls 602 partially surrounding circumferential wall 131 of cam plate 126 to form a shell. A groove 613 formed into one of the guide walls 602 conforms to the shape of spherical ball 604 over an arcuate length of less than one half of the circumference of ball 604. Ball 604 is positioned principally upon cam plate 126 and spaced equally distantly between a pair of rectangular guides 605, to extend through a gap in circumferential wall 131. An unlocking detent 622 is held in position by an electrically conductive compression spring 616, between guides 605 on one side, and guide wall 624 on its other side. Plate 620 also contains a circular concave groove 622 circumferentially conforming to the exterior of ball 604 with a greatest depth of less than one half the diameter of ball 604. A proximal end of locking plate 622 is attached to conductive attachment 610.

Figure 25:
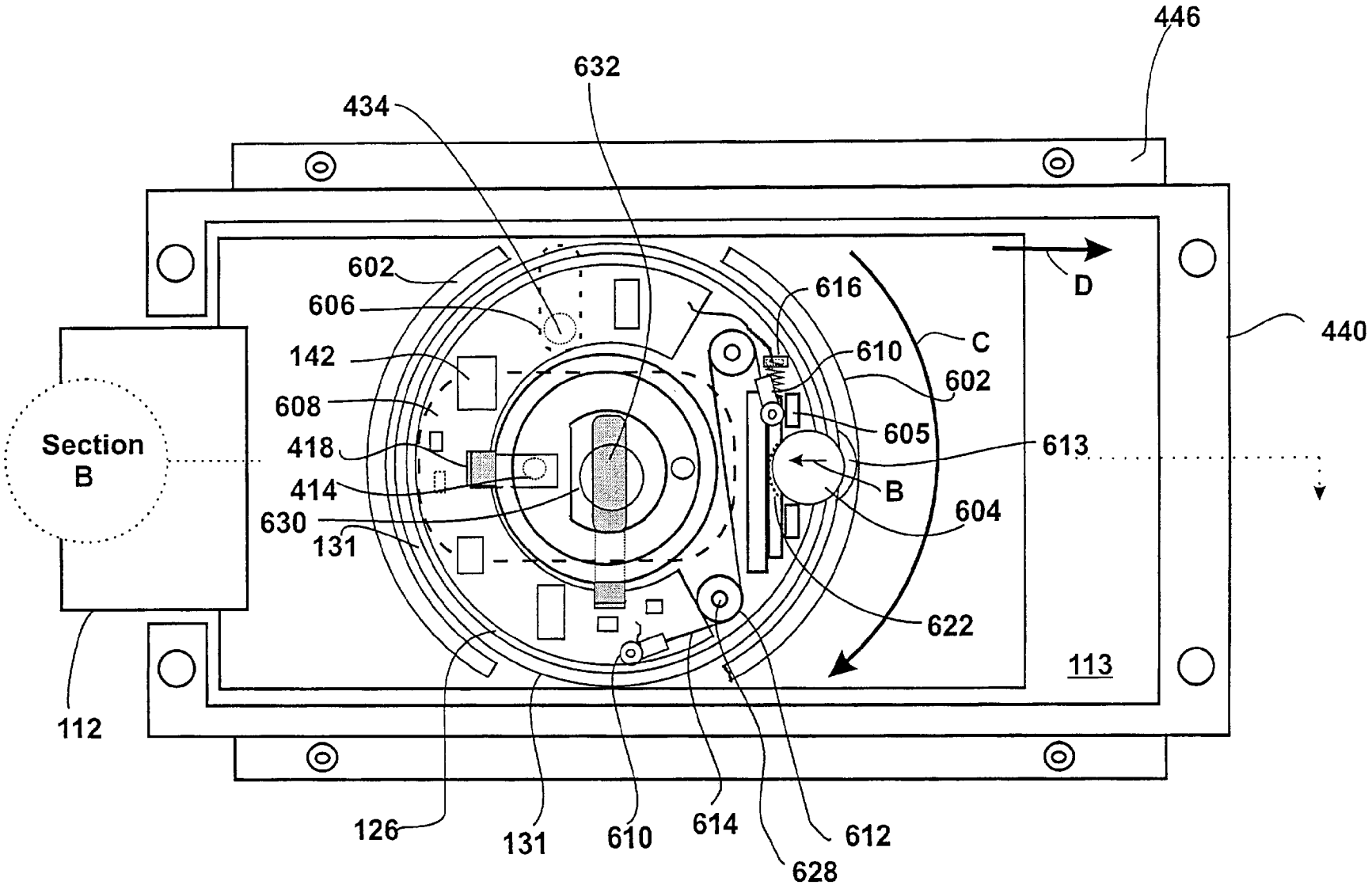
FIG. 25 is a plan view of the embodiment shown in FIG. 24, while in an unlocked state with the bolt still extended.
Figure 26:
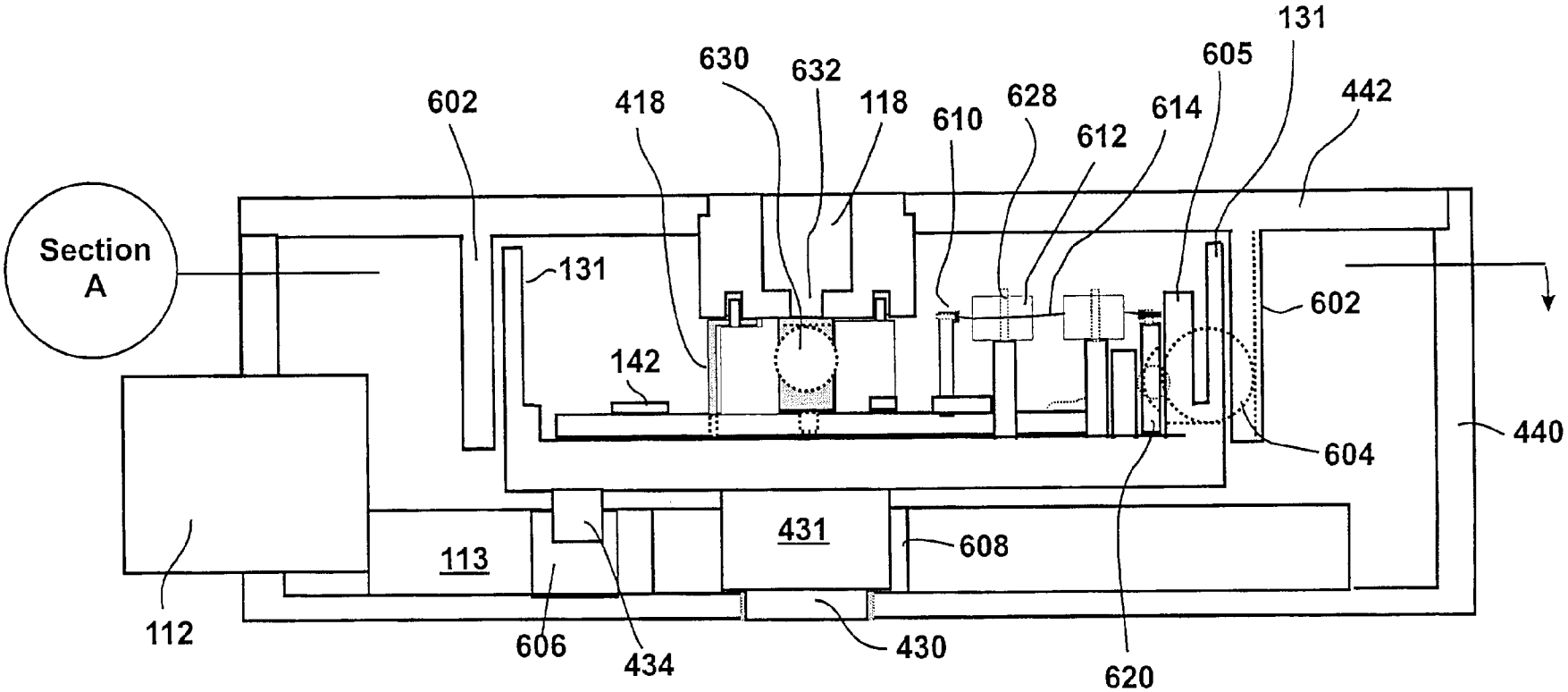
FIG. 26 is a side, cross-sectional view showing the embodiment of FIG. 24 in transition between locked and unlocked states.

In operation, a manual key electronically conforming to circuit 130 after insertion into keyway 118 and making electrical contact with conductives 416, 418, enables circuit 130 to apply electrical current between attachment 610; the electrical current causes the NiTiNol alloy wire 614 to contract, thereby drawing locking plate 622 upwardly against the force of compression spring 616, as shown in FIG. 25, thereby enabling the manual torque applied by the key to cam plate 126 to force ball 604 to roll out of groove 613 and to roll into groove 622 in a direction shown by arrow B as cam plate turns clockwise in a direction indicated by arrow C. The clockwise movement of cam plate 126 causes drive pin 434 to travel along slot 606, thereby forcing shank 113 to the right in a direction of arrow D as shown in FIG. 25, thus retracting bolt 112 substantially into the interior of housing 440. Cam rotation and withdrawal of the key from keyway 118 terminates access, by causing interruption of electrical current through NiTiNol alloy wire 614. Referring again to FIGS. 11A, 11B, software stored in ROM 534 may instruct microprocessor 530 after a certain number of pulses from counter 538 to change switch 544 to its rest state, causing interruption of power through NiTiNol alloy wire 614. This enables spring 616 to force locking plate 620 downwardly to discharge ball 604 alternately into groove 613 of guide wall 602. Simultaneously, the cam clockwise rotation opposite to the direction shown by arrow C in FIG. 25, forces drive pin 434 against the wall of slots 606, thereby causing shank 113 to travel in the opposite direction shown by arrow D, thus ejecting bolt 112 and locking the door to which the assembly has been attached.

Figure 27A:
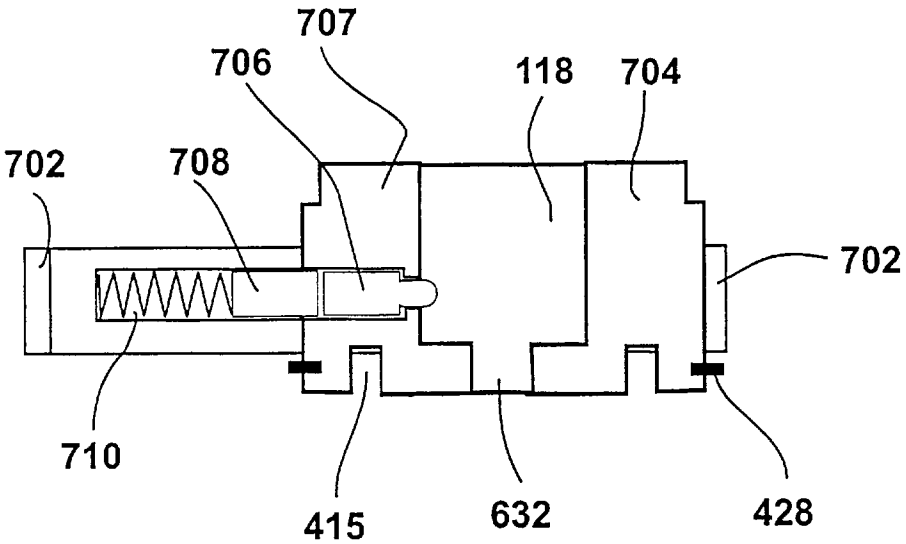
FIG. 27A is a cross-sectional view of a bitted cylinder plug that may be incorporated into the embodiment of FIG. 24.
Figure 27B:
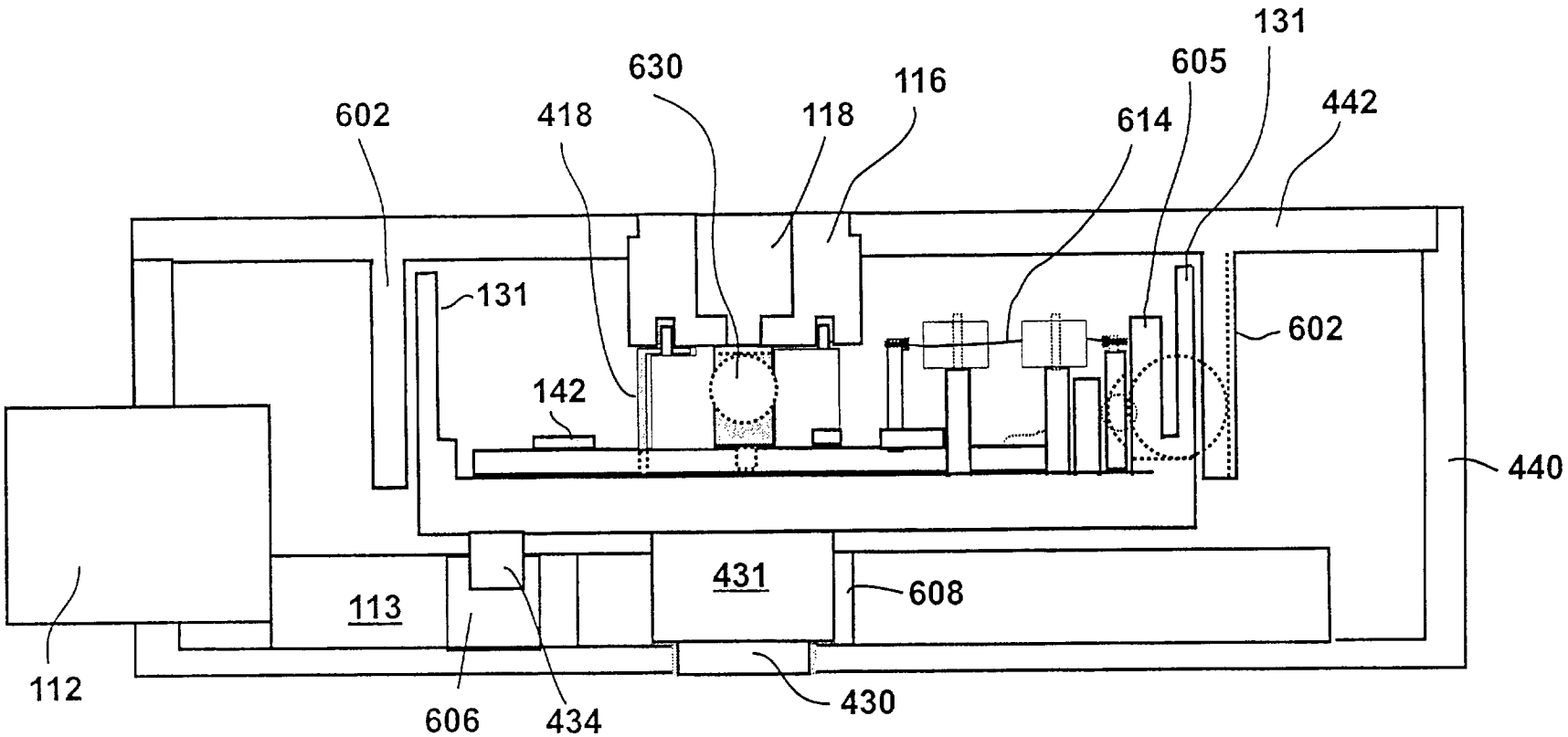
FIG. 27B is a cross-sectional view of an unbitted cylinder that may be incorporated into the embodiment of FIG. 24.
Figure 28:
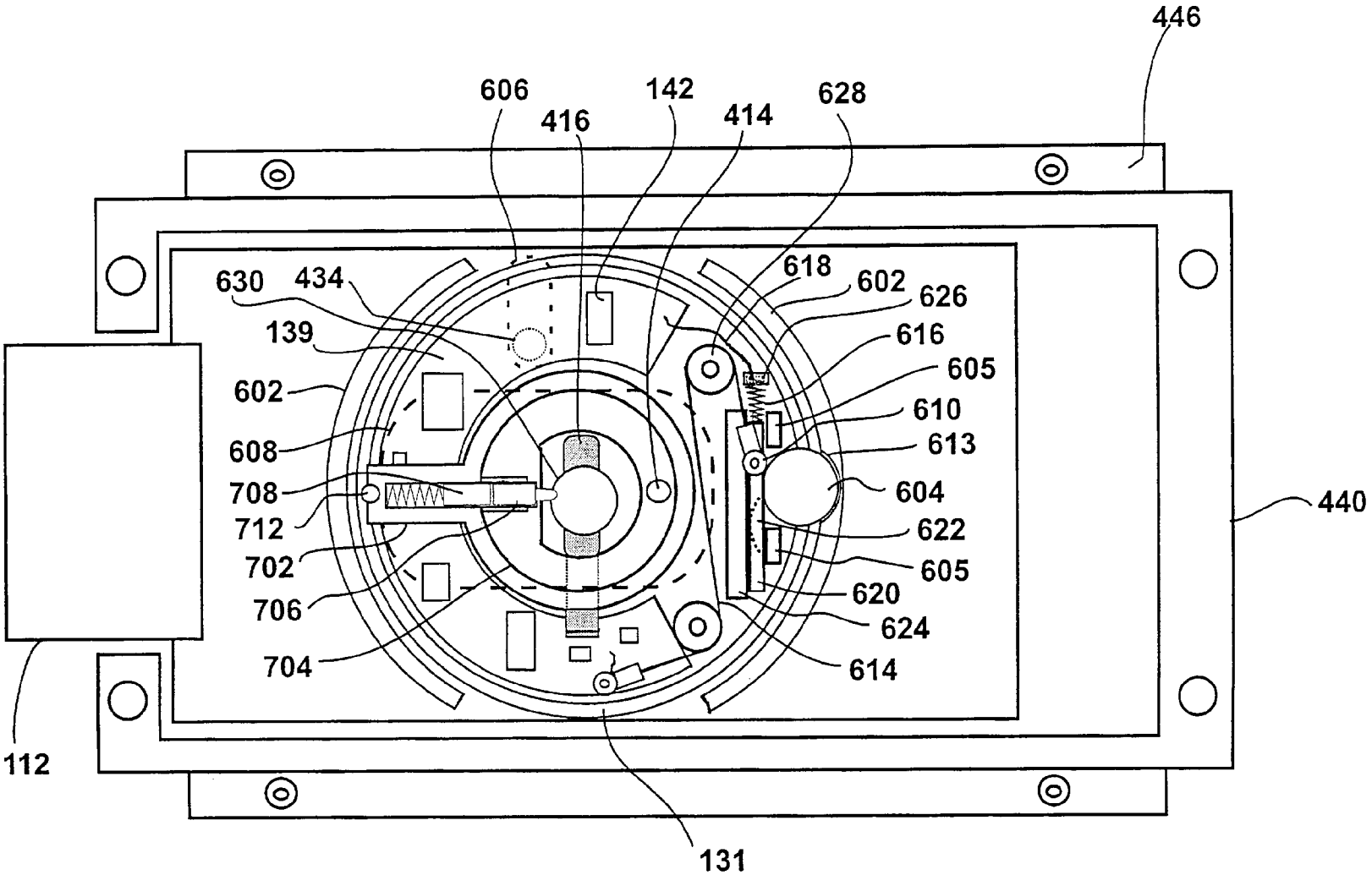
FIG. 28 is a plan view illustrating incorporation of a bitted cylinder plug incorporated into an embodiment constructed according to the principles of the present invention.

FIG. 27B shows a bitted cylinder 700 fitted with a cylinder plug 704 which may be incorporated into the embodiment represented by FIGS. 24 through 27A. In this embodiment, the key (not shown) can be configured with a plurality of teeth cut to conform to the shear lines 707 formed by the relative length of bottom pins 706 and top pins 708 within cylindrical shell 702. As shown in FIG. 27B, compression spring 710 holds bottom pins 706 and top pins 708 inwardly to prevent rotation of cylinder 704 relative to shell 702. A Truarc® ring 428 holds cylinder 700 within cover 442. With this alternative embodiment, the key must both mechanically conform to the shear line established by pins 706 and 708 and electronically conform to the digital signature required by circuit 130 before access can be obtained. As shown in FIG. 28, a fixed pin 712 holds the extreme wall of shell 712 fixed into position relative to circumferential wall 131 that forms a cylinder housed within and rotatable within the shell formed by guide walls 602.

Figure 29:
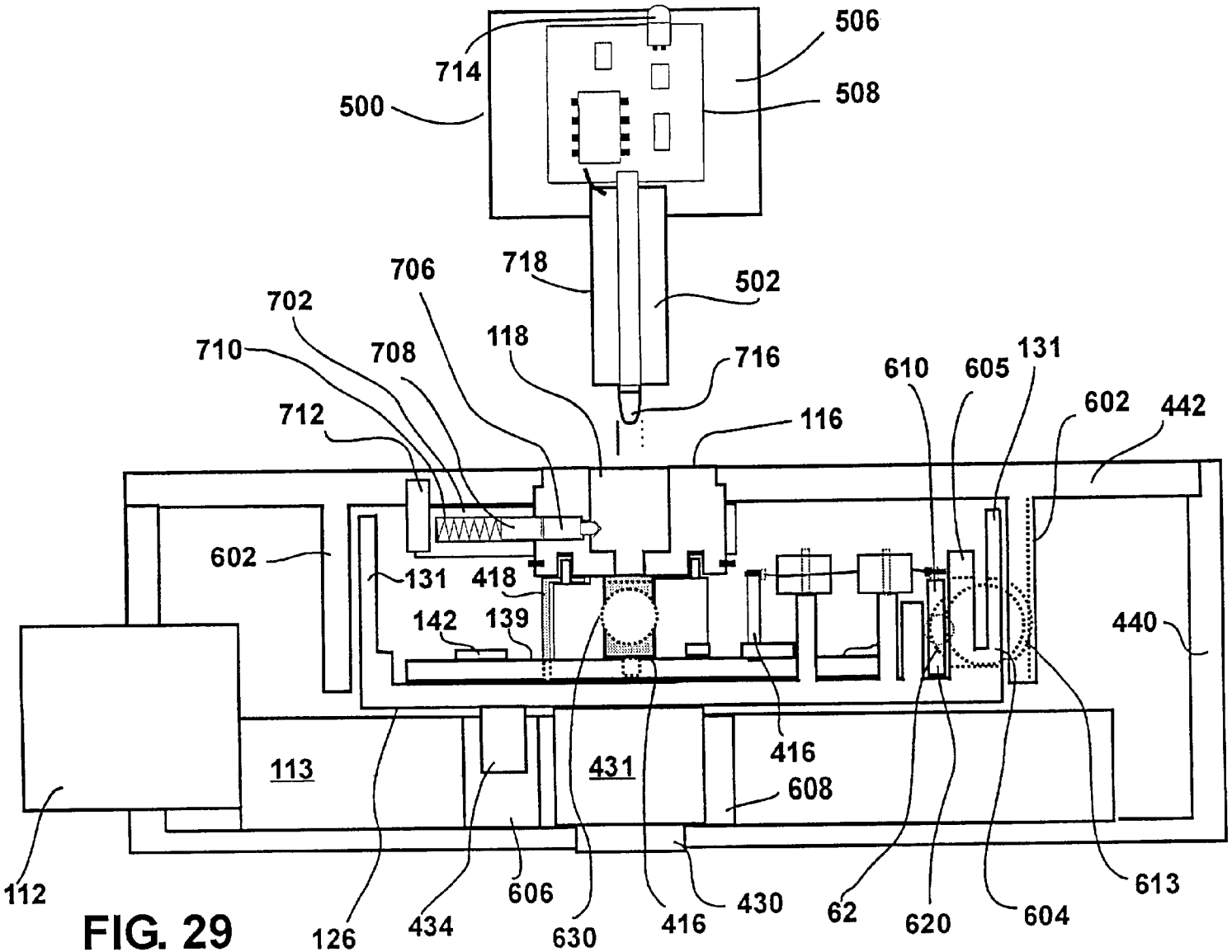
FIG. 29 is a cross-sectional view of the embodiment illustrated in FIG. 28 showing a key prior to insertion.
Figure 30:
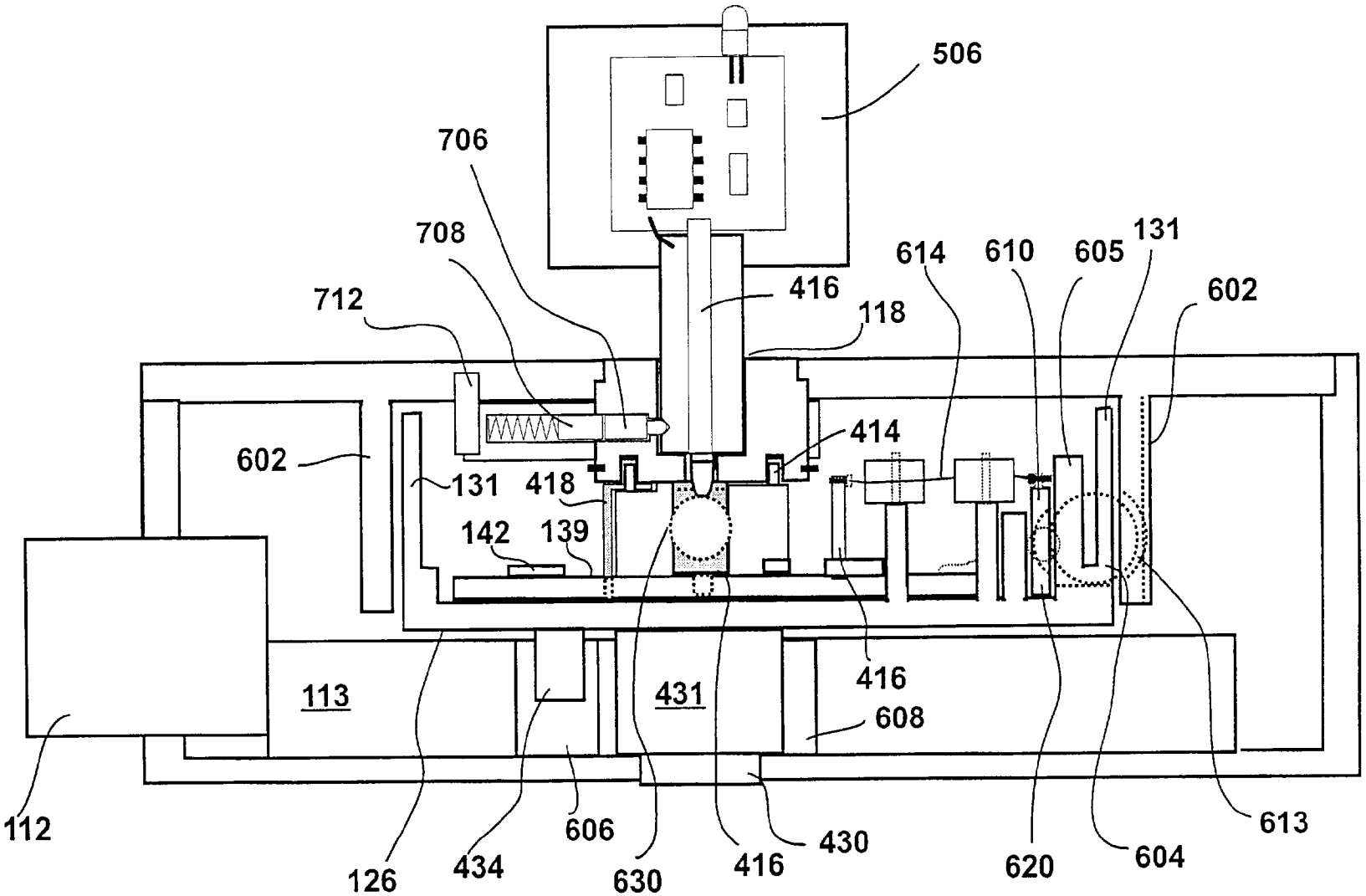
FIG. 30 is a cross-sectional view showing operational aspects of the embodiment illustrated in FIG. 28 with a mechanically conforming key inserted into its keyway.

Turning collectively to FIGS. 24 through 36, a sphere 630 of an electrically conductive material (preferably, with a polished exterior surface such as a chrome plated ball bearing, may be inserted into spacer 123 within a spherically conforming recess, under electrical contact 416 between the open portion of keyway 118, namely 632, and circuit board 139. Sphere 630 has unrestrained multiple degrees of freedom of rotation. Consequently, sphere 630 blocks direct access to circuit board 139 and, among other advantages, deters efforts to defeat locking device 600 by drilling for example with a rotating bit inserted into keyway 118. Accordingly, and as may be seen in FIGS. 29 and 30, electrically insulated central electrical contact 716 of key 500 makes electrical contact with contact 416 directly, and sphere 630 is interposed between contact 416 and an extension of keyway 118 through spacer 123, to protect circuit board 139 from damage caused by improper access such as drilling through keyway 118.

Turning again to FIGS. 29 and 30, when bitted key 500 is coaxially inserted into keyway 118 of a bitted cylinder plug 116, the bitting of key 500 radially displaces top and bottom pins within shell 702, and if there is a mechanical conformance between the bitting of the teeth and the shear line between the top and bottom pins, electronic conformance between circuit 508 of the key and circuit 130 formed on circuit board 139 will enable the battery 437 held by the head 506 of key 500 to apply electrical power via spring pin key data contact 716 and contact wiper 416 to paramagnetic alloy wire 416 extending between connectors 610, thereby contracting wire 416 and drawing locking plate 620 upwardly to receive a less than hemispheric exterior surface of ball 604, thereby allowing cam plate 126 to rotate under the torque applied by the key 500 relative to guide wall 602. Formation of groove 613, 620 with depths of less than one radius of bearing 604, in preferably less than one half of the radius of bearing 604, enables the torque applied manually to key 500 to force bearing 604 out of the corresponding groove 613 or unlocking detent 622 once plate 620 has been positioned by either spring 616 or paramagnetic wire 614.

Figure 31:
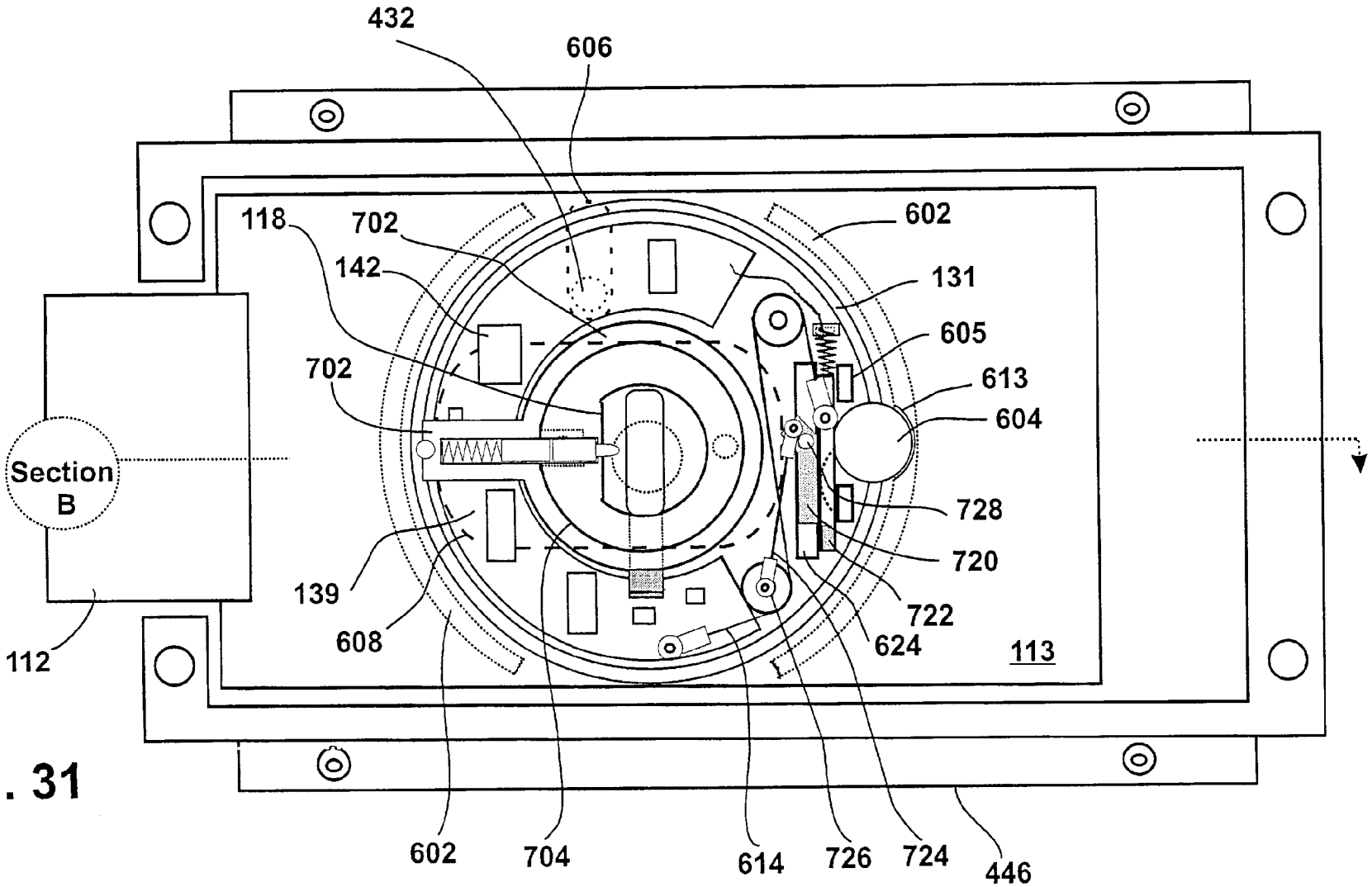
FIG. 31 is a plan view showing another embodiment constructed according to the principles of the present invention with a heat sensitive paramagnetic re-locking mechanism shown in an unrelocked state.
Figure 32:
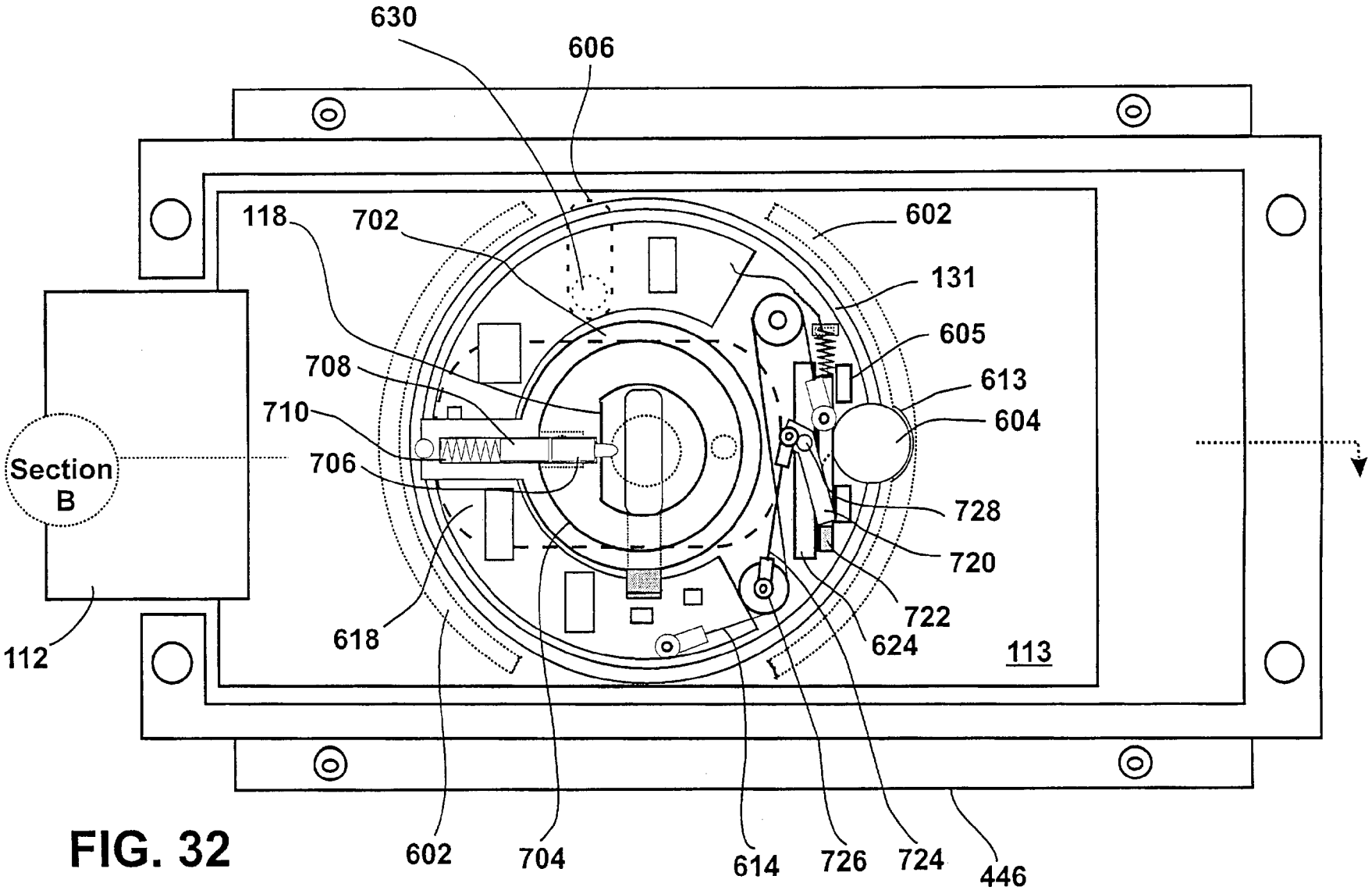
FIG. 32 is a plan view showing another embodiment constructed according to the principles of the present invention with a heat sensitive paramagnetic re-locking mechanism shown in a re-locked state.
Figure 33:
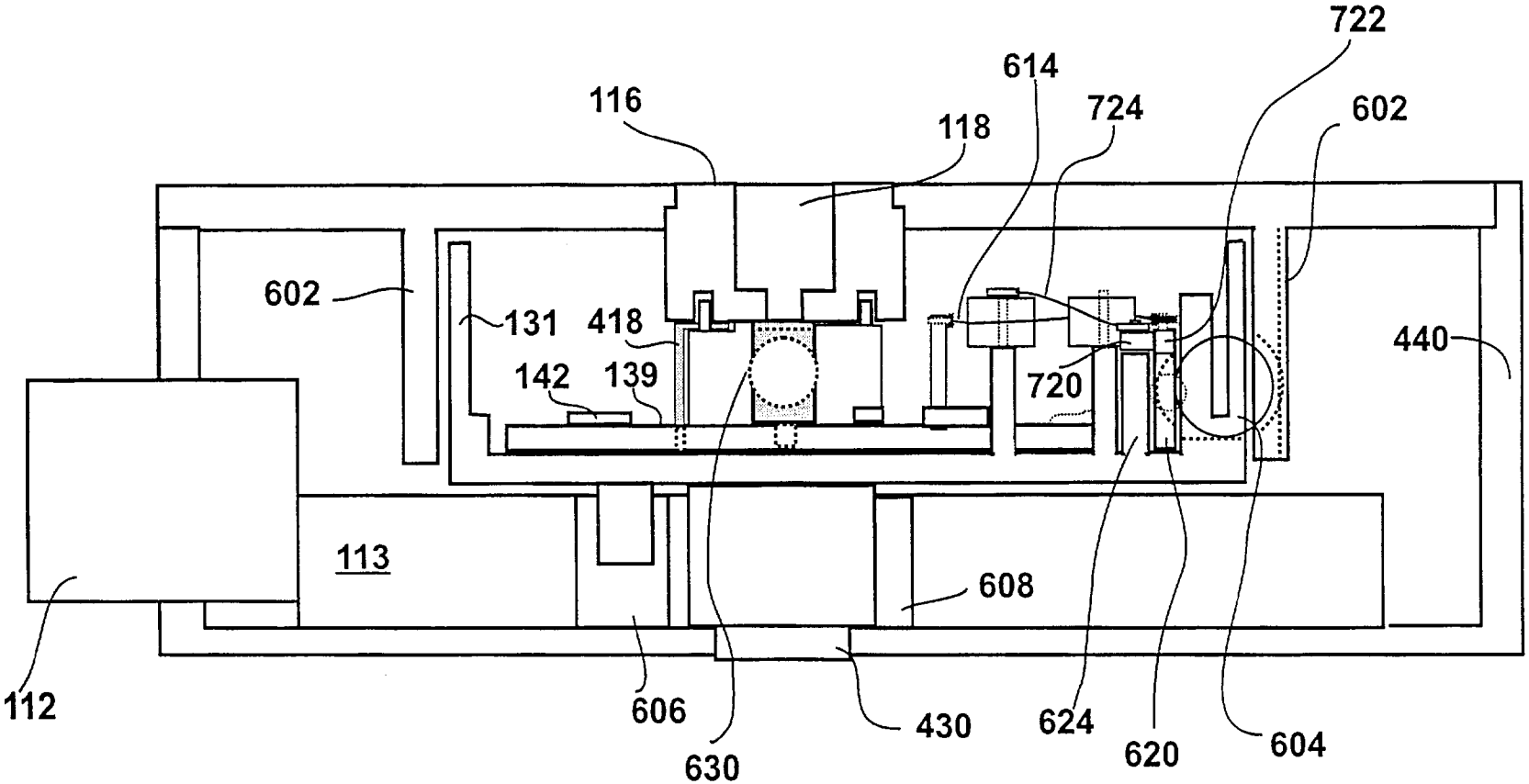
FIG. 33 is a side cross-sectional view of the embodiment illustrated by FIG. 32 while in an unrelocked states.

Turning now to FIGS. 31 through 33, not infrequently heat is applied to the keyway 118 in an improper effort to influence the behavior of the locking mechanism through thermal expansion caused by application of the heat. Paramagnetic alloys are especially responsive to heat. Therefore, in the embodiment illustrated a re-locking lever 720 is superimposed alongside locking plate 620, with a pivot 728 rotatably attaching lever 720 to the upper surface of guide wall 624. Re-lock lever 720 has a bell crank shape with one arm attached to a second paramagnetic alloy wire 724 extending between fasteners 726, 727. Application of heat to the cam assembly via keyway 118 will cause wire 724 to contract, thereby pulling the proximal end of lever 720 downwardly as shown in FIG. 32, thus forcing the distal end of lever 720 to engage slot 722 formed within locking plate 620. This prevents plate 620 from moving in response to contraction of wire 614 due to either application of an electrical current or heat. Consequently, improper efforts to open the locking mechanism via application of heat through keyway 118 are thwarted because locking plate 620 remains under the influence of spring 616, thereby preventing bearings 604 from leaving slot 613 within guide wall 602.

Figure 34:
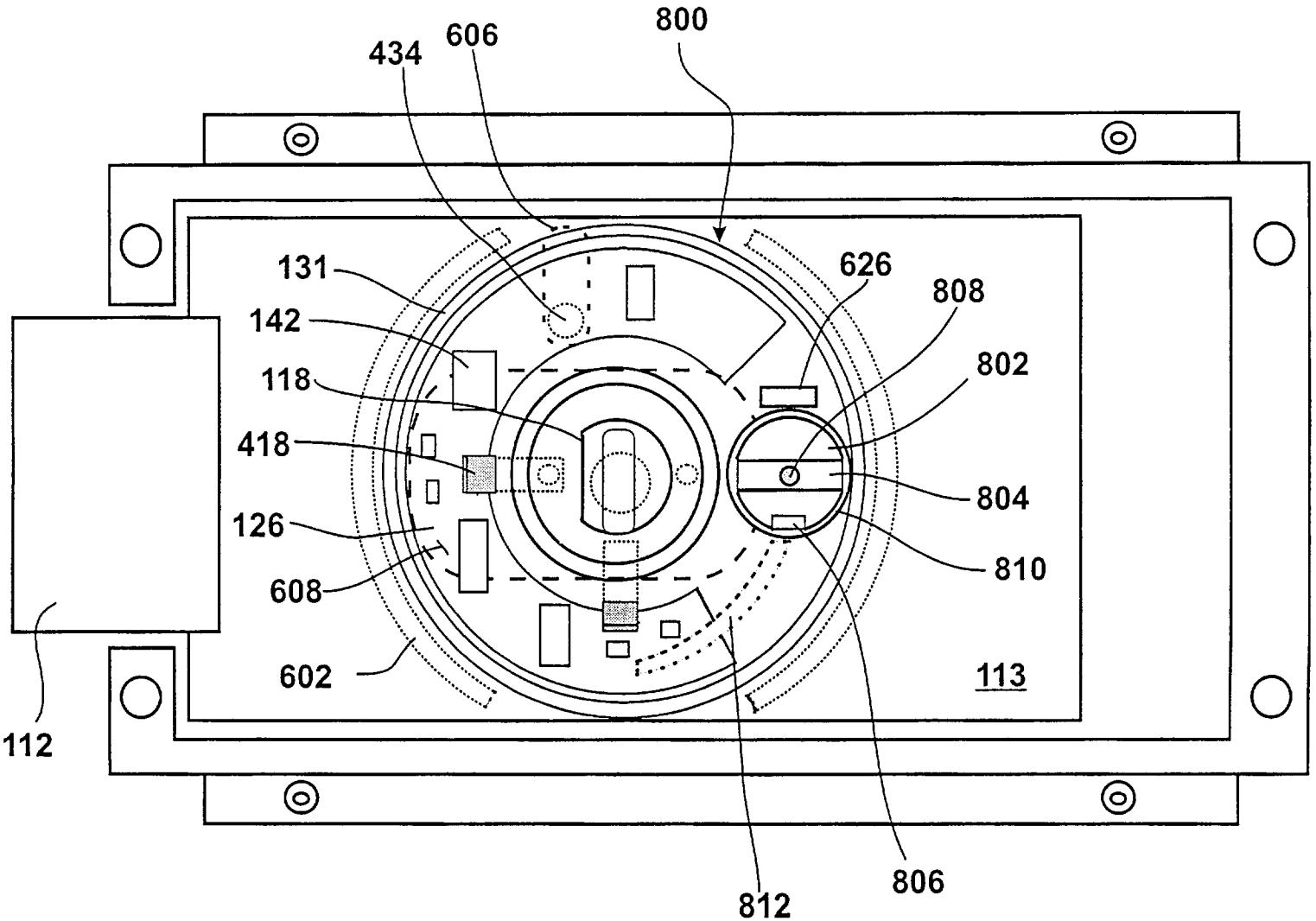
FIG. 34 is a plan view showing details of still another embodiment constructed according to the principles of the present invention using a rotary solenoid.
Figure 35A:
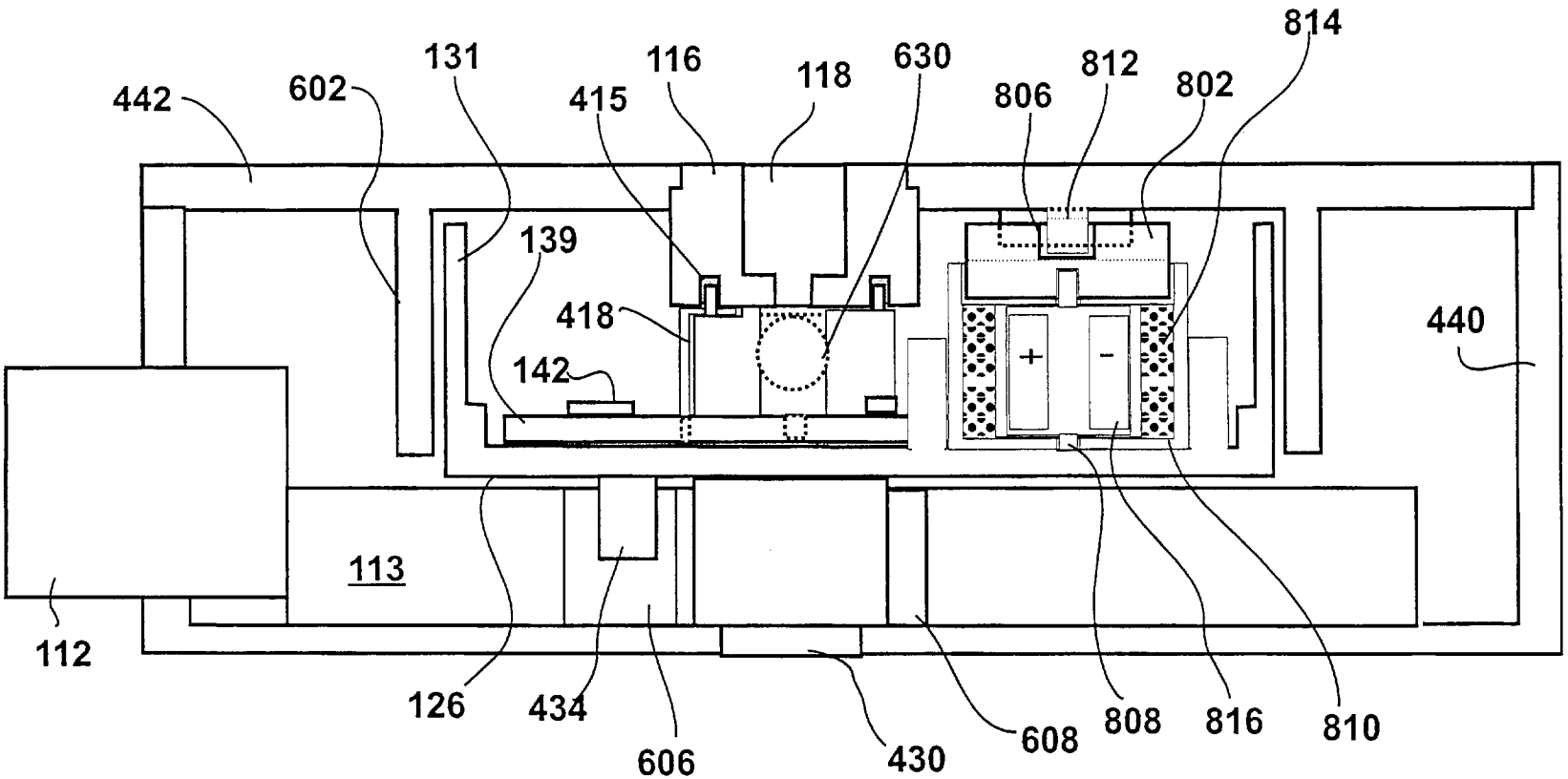
FIG. 35A is a cross-sectional view of the embodiment illustrated in FIG. 34 equipped with an unbitted cylinder plug.
Figure 35B:
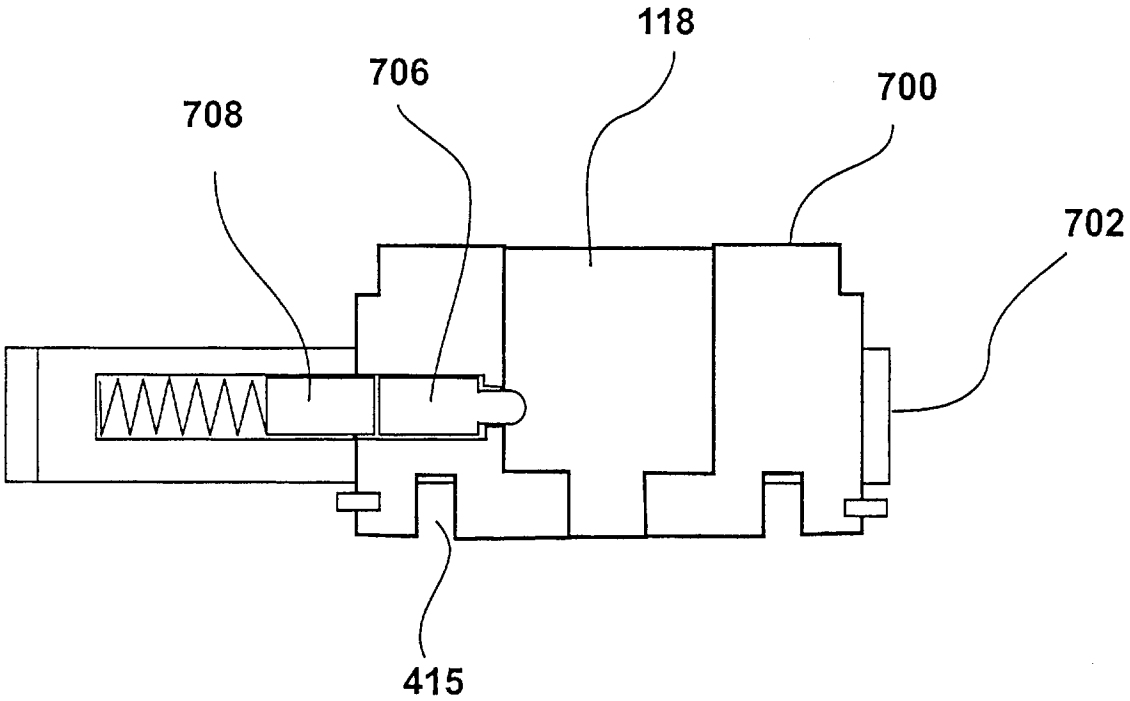
FIG. 35B is a detailed cross-sectional view of a bitted cylinder plug that may be incorporated into the embodiment illustrated by FIG. 34.
Figure 36:
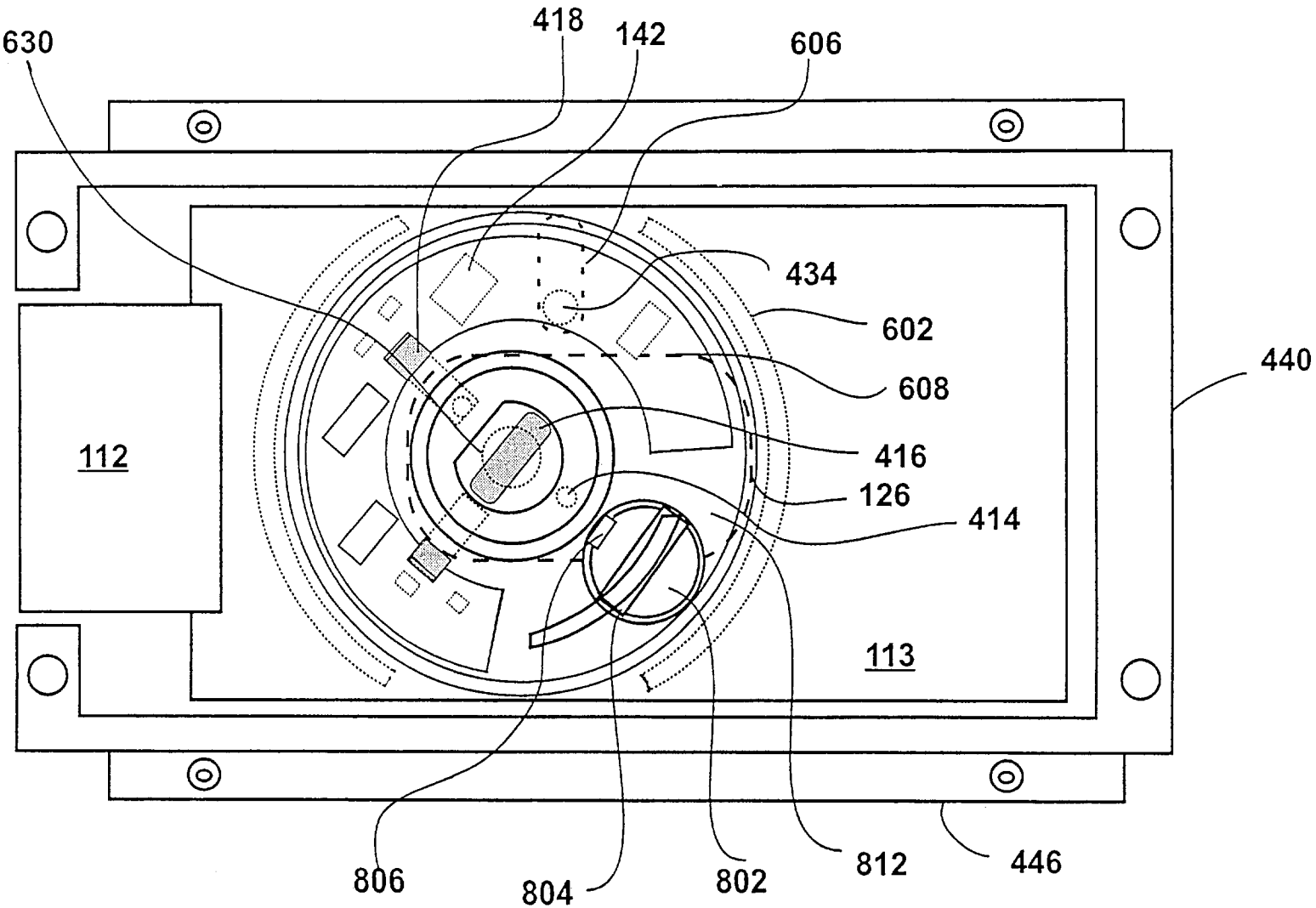
FIG. 36 is a plan view showing the embodiment of FIG. 34 while in an unlocked state with the bolt shown retracted.
Figure 37:
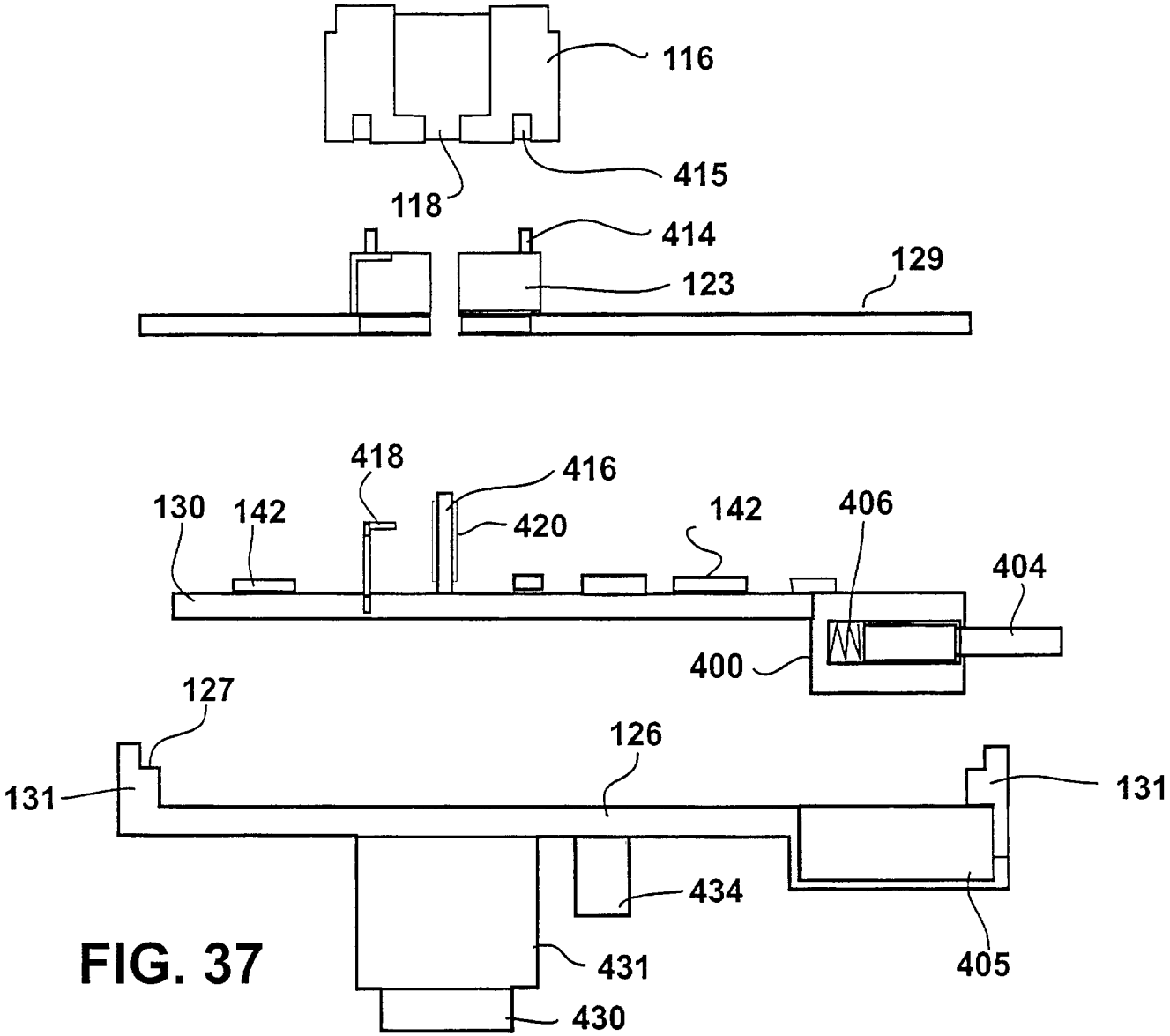
FIG. 37 is a partial assembly view showing an embodiment constructed according to the principles of the present invention with a non-bitted cylinder and a directly locking solenoid.
Figure 38:
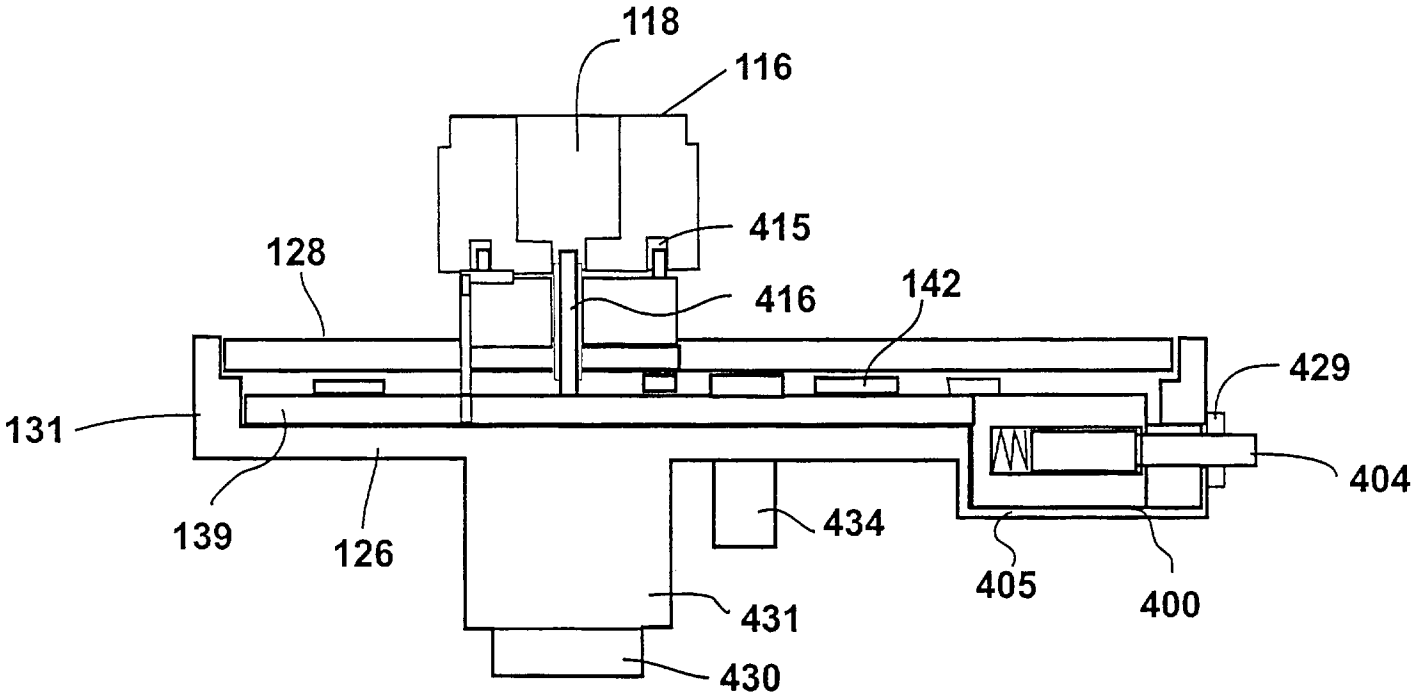
FIG. 38 is a cross-sectional view showing the assembly of the embodiment illustrated in FIG. 37 equipped with an unbitted cylinder plug.
Figure 39:
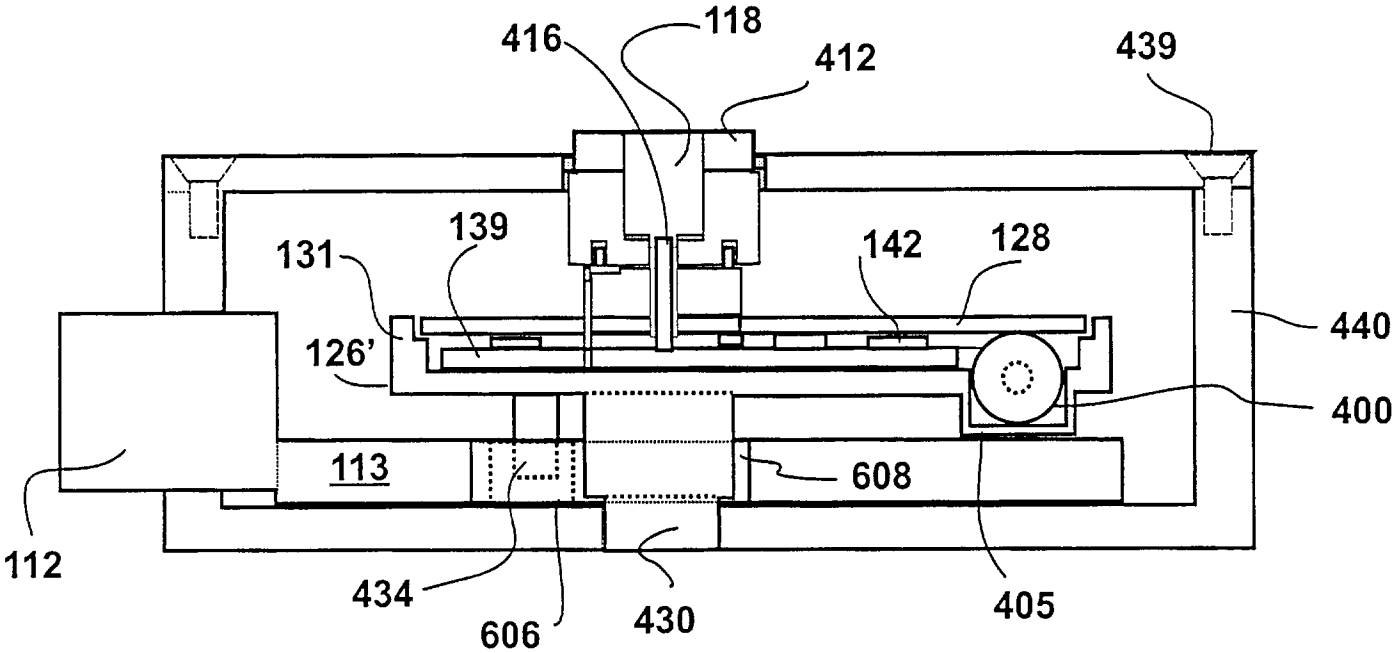
FIG. 39 is a cross-sectional side view showing the assembly of the embodiment illustrated in FIG. 37.

Turning now to FIGS. 34 through 36, the cam assembly 800 fitted with an electrically operated motor incorporated into the locking mechanism is illustrated. The motor is constructed with a shaft 808 supporting a drum 802 bearing a slot 804 formed through its upper surface that is sufficiently wide to accommodate passage of the arcuately curved fence 812 protruding downwardly from the under side of cover 422. Mechanical and electronic conformity of a key inserted into keyway 118 will enable circuit 130 to apply an electrical current to the coil 814 of the stepping motor, thereby turning the armature 816 of the motor by ninety degrees to an unlocked state accommodating passage of fence 812 as shown in FIG. 36 as cam plate 126 rotates. Shaft 808 can rest in the motor housing 810, which is in turn mounted upon circuit board 139 or, alternatively, directly upon cam plate 126. As shown in FIG. 34, drum 802 contains a false notch (shown on one side) 806 designed to accommodate entry, but not passage of a short portion of fence 812. This thwarts improper efforts to unlock the mechanism simply by application of rotational torque to the cylinder plug as, by insertion of the blade of a screw driver into keyway 118. Counterclockwise rotation and removal of the key will trigger application of a charge held by a capacitor within circuit 130 that has been charged by battery 437, to rotate locking drum 802 by one additional ninety degree step in the clockwise direction to block rotation of cam plate 126 relative to fence 812. Alternatively, the motor may be fitted with a torsion spring (not shown) anchored to the drum 802 and motor body 810 to restore the drum to its original locked position.

As shown in FIG. 35B, a bitted cylinder plug 700 may be incorporated into the cam assembly of FIGS. 34 and 35A, to provide an additional level of mechanical conformance required to gain entry to the container closed by the locking mechanism.

Figure 40:
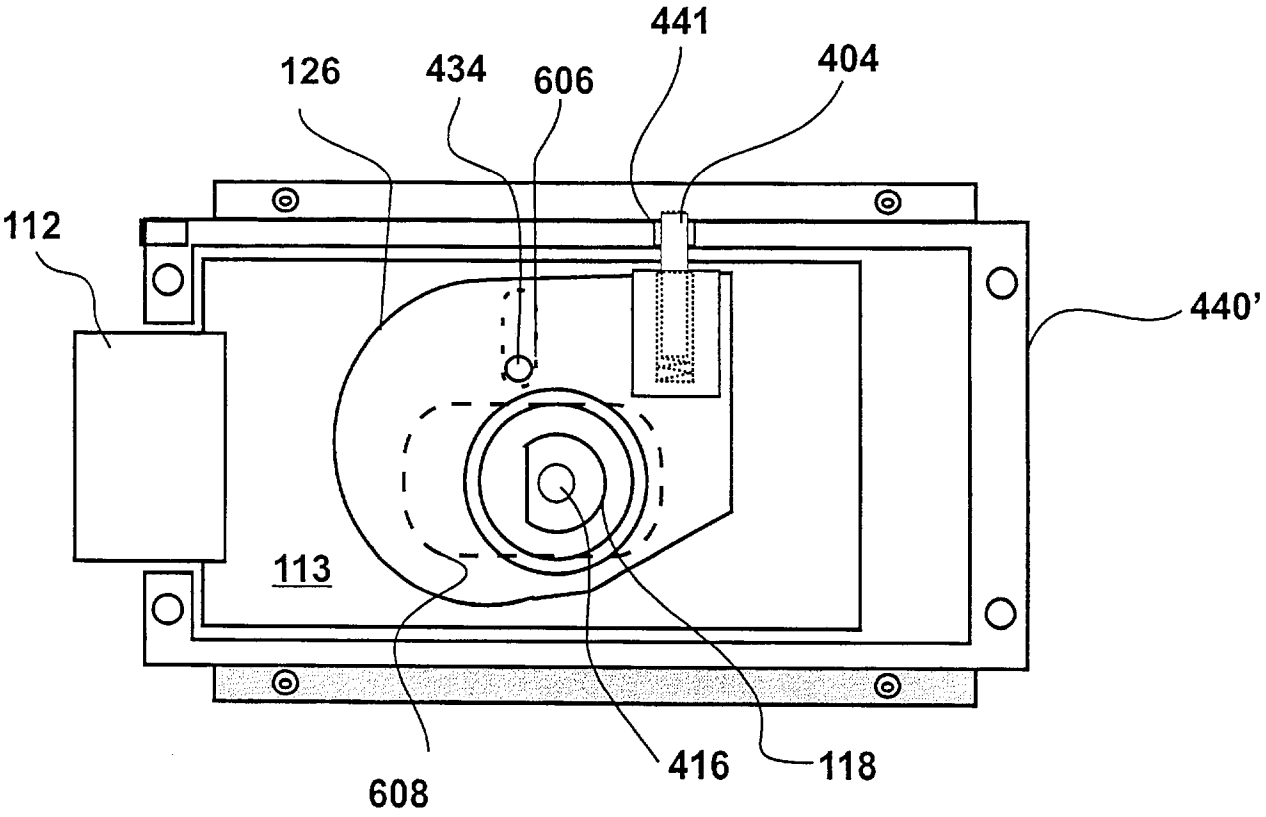
FIG. 40 is a plan view showing the assembly of the embodiment illustrated by FIG. 37.
Figure 41:
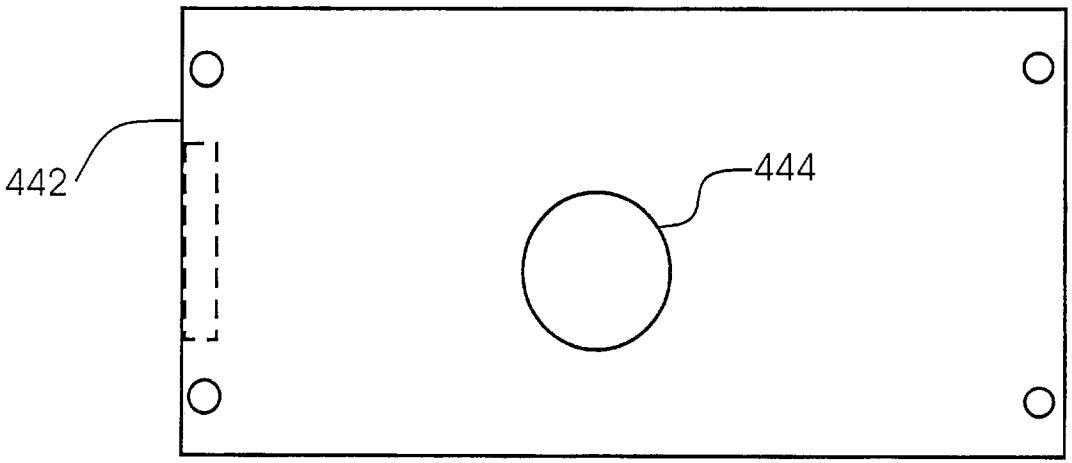
FIG. 41 is a plan view showing a cover that may be installed upon the assembly illustrated by FIG. 40.
Figure 42:
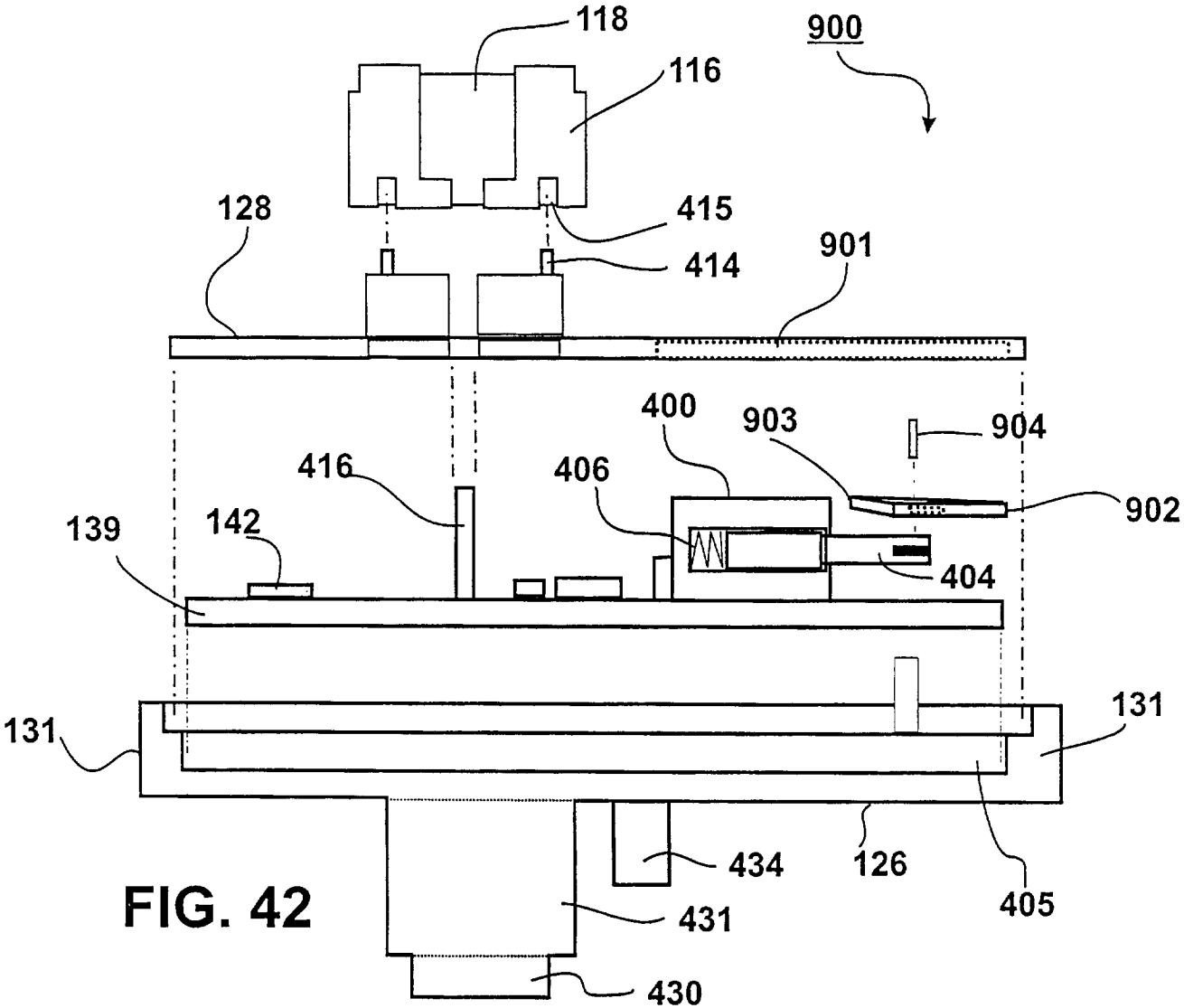
FIG. 42 is a cross-sectional assembly view showing an embodiment constructed with a solenoid activated linkage.
Figure 43:
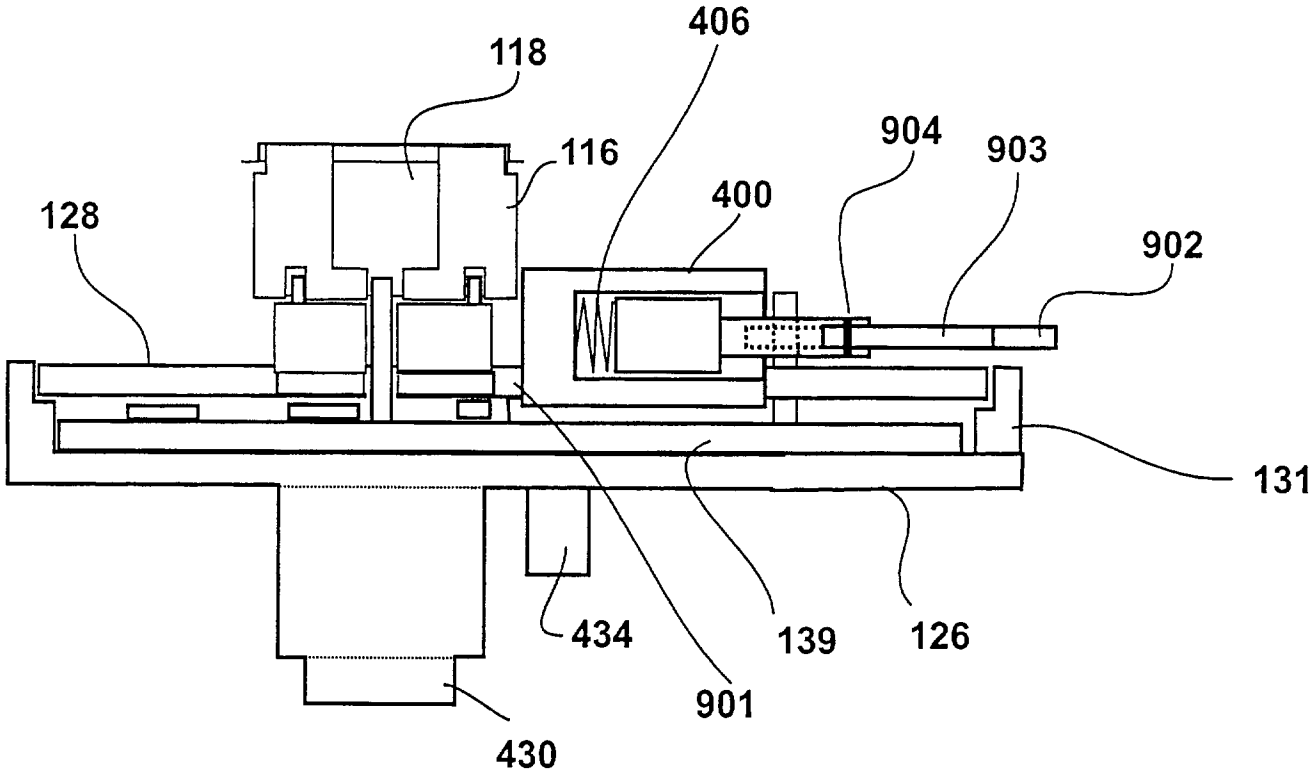
FIG. 43 is a side cross-sectional view of the embodiment illustrated in FIG. 42.

Turning now to FIGS. 37 through 41 collectively, a non-bitted cylinder plug 116 is mounted to a cam assembly extension 123 via shear pins 414 received within conforming apertures 415 in a cylinder plug. A solenoid 400 is mounted directly upon circuit board 139, as an interval component of circuit 130, and is received within cavity 405 of cam plate 126'. Lock housing 440' has one wall perforated by an opening 441 conforming in size and shape to solenoid armature 404. In the lock state therefore, spring 406 holds armature 404 within aperture 441. Correct mechanical conformance and electronic conformance between the key inserted into keyway 118 and circuit 130 will enable application of an electrical current to solenoid 400 that will cause withdrawal of armature 404 from aperture 414, thereby enabling cam plate to rotate clockwise (as shown in FIG. 40) under the torque applied by the key to keyway 118, thus withdrawing shank 113 under the force of drive pin 434 applied to slot 606, and thus withdrawing bolt 112. Clockwise rotation of the key will restore alignment between armature 404 and aperture 441.

Figure 44:
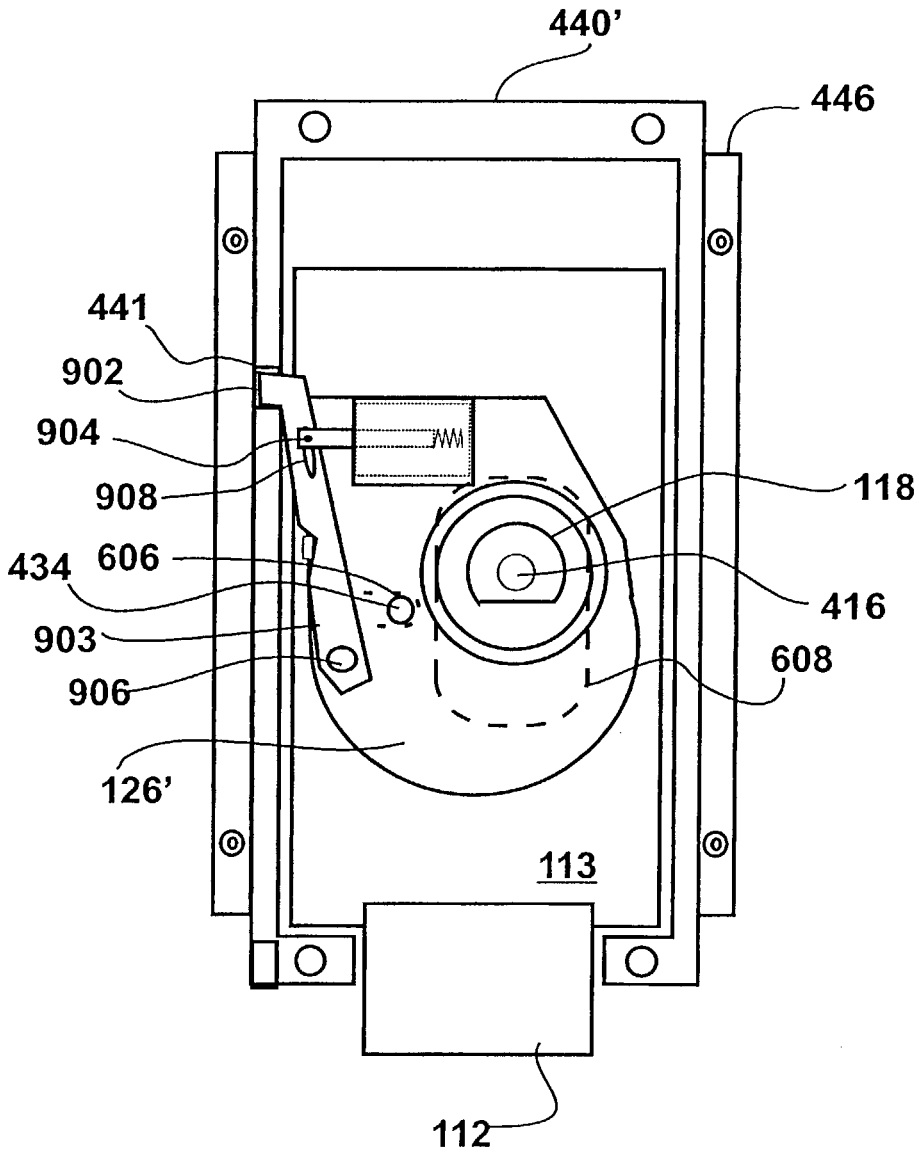
FIG. 44 is a plan view showing the embodiment illustrated by FIG. 42.
Figure 45:
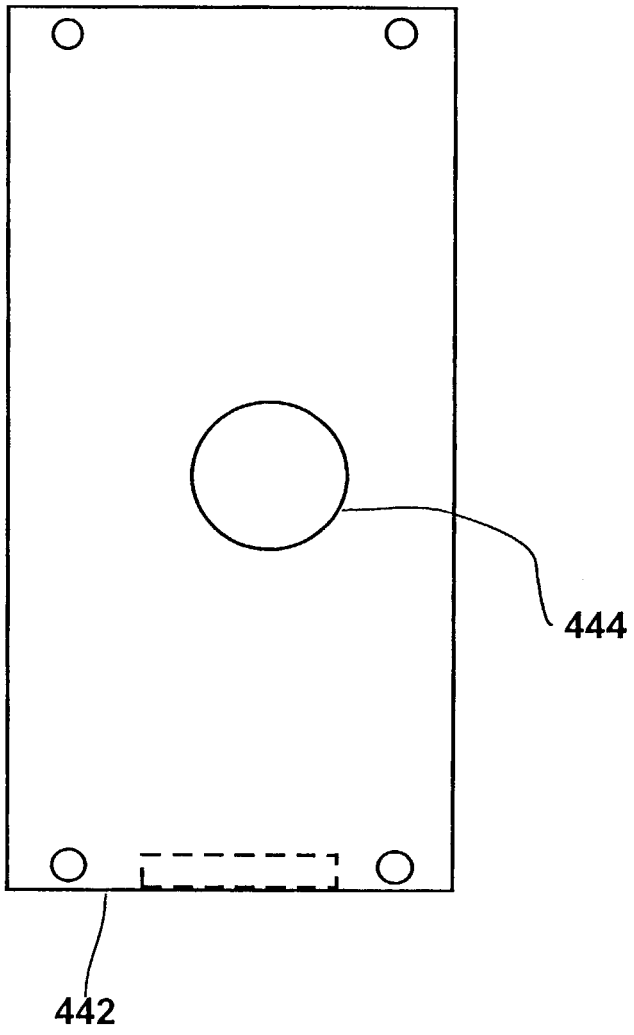
FIG. 45 is a plan view of a cover that may be installed upon the cam assembly illustrated by FIG. 44.
Figures 46, 47:
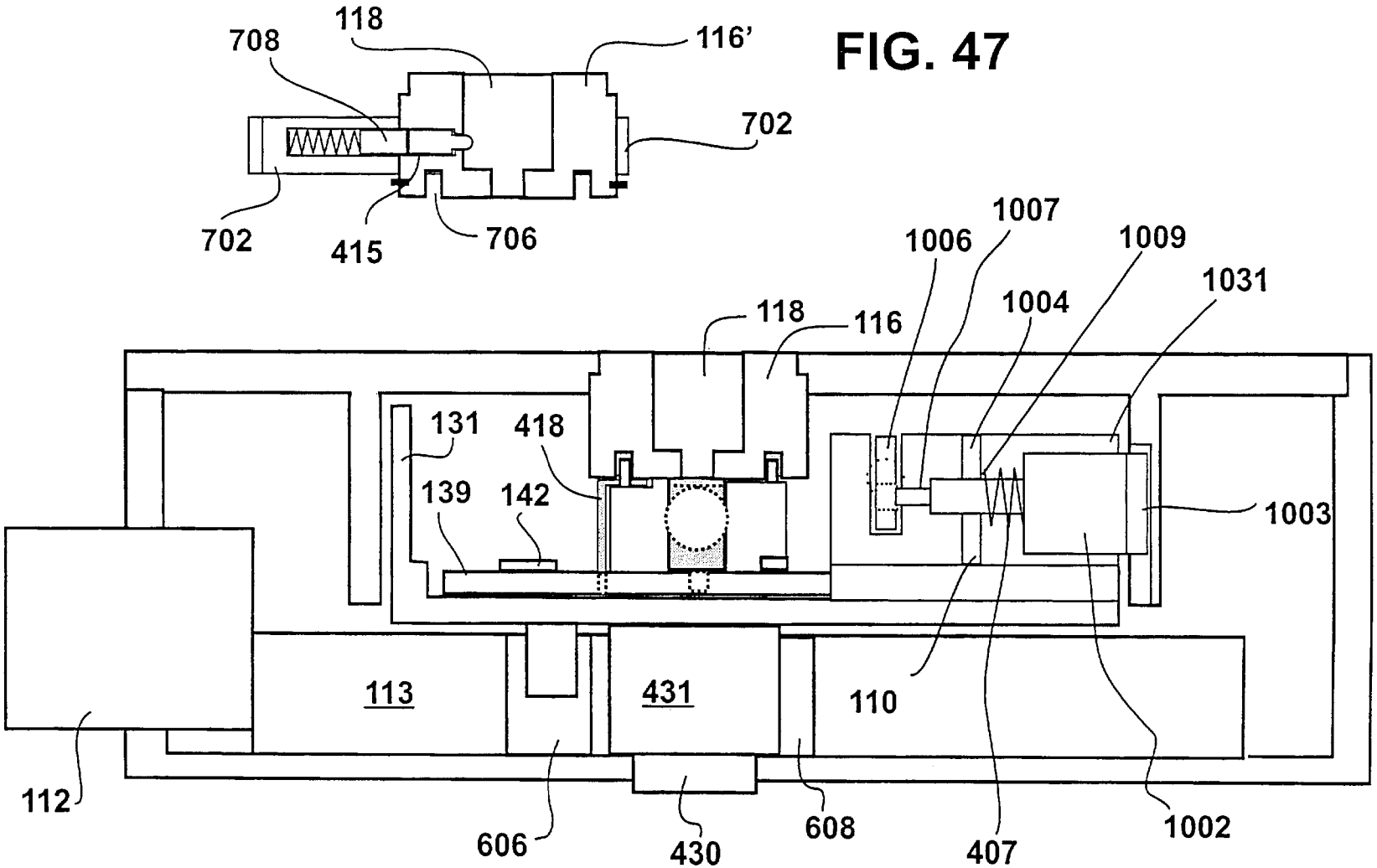
FIG. 46 is a cross-sectional elevation taken along sectional line XXIXVIII-XXIXVIII' in FIG. 48, showing still another embodiment constructed according to the principles of the present invention and equipped with an unbitted cylinder plug.
FIG. 47 is a cross-sectional view of a bitted cylinder plug that may be incorporated into the embodiment illustrated by FIG. 46.

Turning now to FIGS. 42 through 45, an alternative embodiment is constructed with solenoid release assembly 400 mounted upon circuit board 139, to protrude through slot 901 formed in cover 128. A lever 903 pivotally attached at a distal end to cam plate 126' via a rotating pin 906. Armature 404 is connected, at its distal end, via pin 904 to lever 903. Pin 904 slides within a slot 908 extending nearly longitudinally along a distal portion of lever 903. The distal end of lever 903 is terminated by a detent 902 conforming to aperture 441. Accordingly, when spring 406 forces armature 404 to its fully extended position as shown in FIG. 44, lever 903 forces detent 902 fully within aperture 441, thereby preventing rotation of cam plate 126' relative to shank 113. Consequently, efforts to apply a manual torque to via keyway 118 to cam plate 126' will, absent electronic conformance of the circuit held by the key with circuit 130 mounted on cam plate 126', will cause detent 902 to round the circumferential surface of aperture 441, thus preventing rotation of cam plate 126'. Given electronic conformance between circuit held by the key and circuit 130 however, electrical current running through solenoid 400 will retract armature 404 within solenoid 400 against spring 406, thereby compressing spring 406 while withdrawing detent 902 from aperture 441, thus enabling clockwise rotation of cam plate 126' relative to shank 113 and housing 440'. This rotation causes drive pin 434 to engage the walls of slot 606 and force shank 113 along the walls of spacer 431. Consequently, slots 608 slides along the circumferential walls of spacer 431, thus withdrawing bolt 112 substantially into the interior of housing 440'. Cover 442 fits upon and may be fastened with threaded fasteners to housing 440'.

It may be noted that this structure provides an indirect locking mechanism with detent 902. Moreover, the radial displacement of detent 902 from the central axis of keyway 118 provides an enhanced advantage in the amount of torque required to mechanically defeat the lock. Additionally, the increased diameter of pin 906 pivotally coupling the distal end of lever 903 to the peripheral of cam plate 126' further enhances a mechanical strength of locking mechanism.

Figure 48:
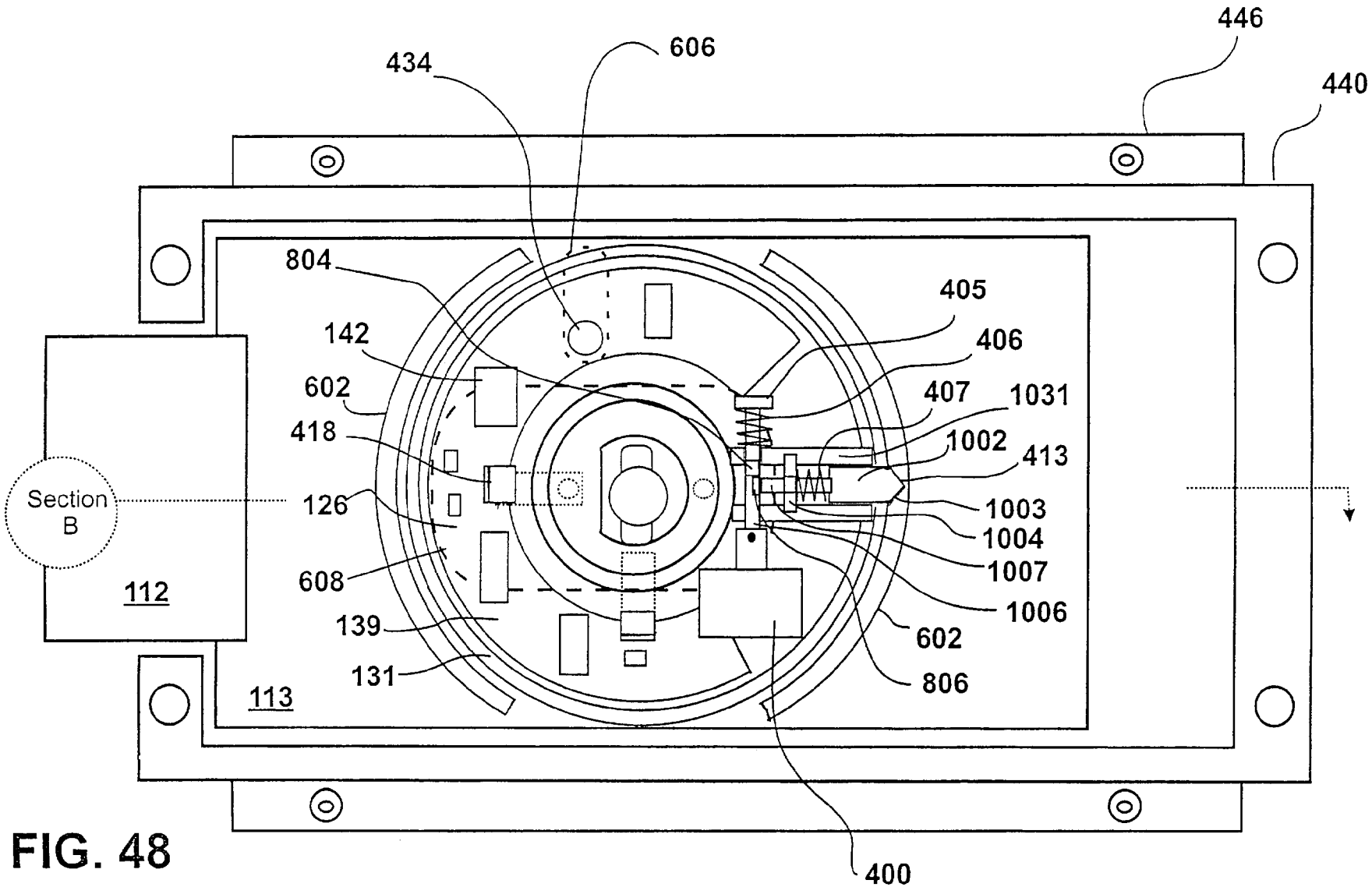
FIG. 48 is a plan view of the embodiment illustrated by FIG. 46 while in a locked state.
Figure 49:
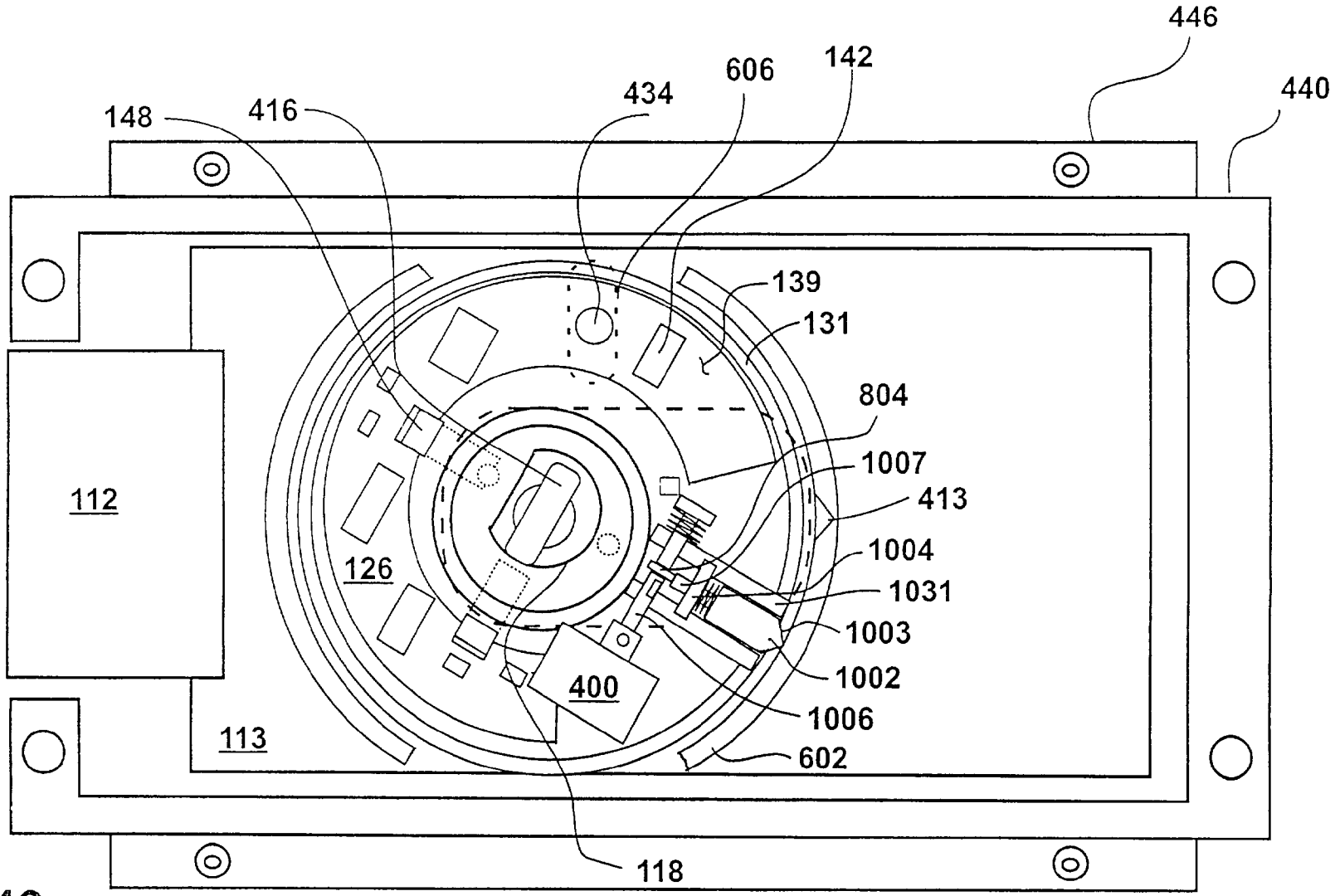
FIG. 49 is a plan view of the embodiment illustrated by FIG. 48 while in an unlocked state.
Figures 50, 51:
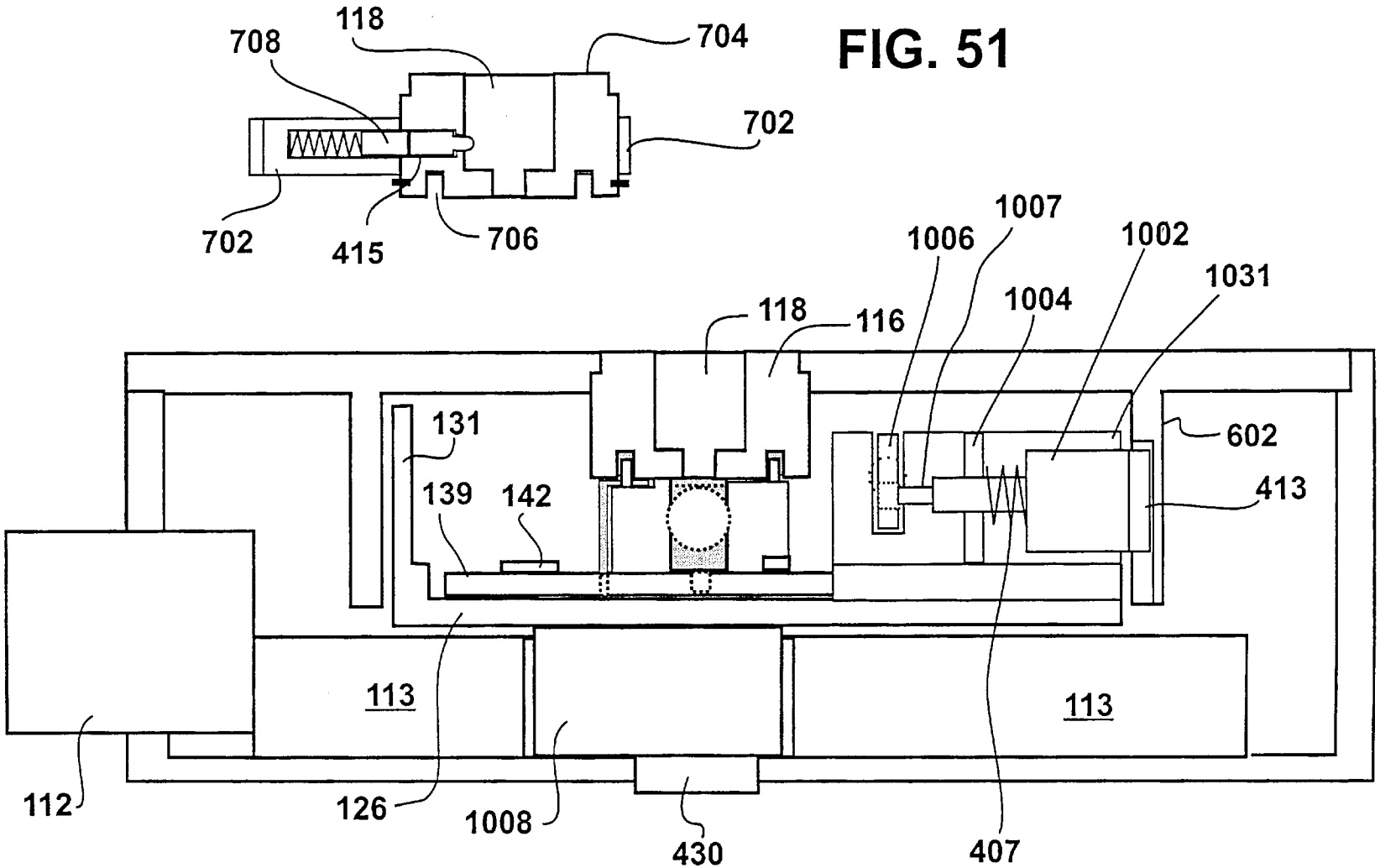
FIG. 50 is a cross-sectional elevation showing the details of still yet another embodiment constructed according to the principles of the present invention and equipped with an unbitted cylinder plug.
FIG. 51 is a detailed cross-sectional view of a bitted cylinder plug that may be incorporated into the embodiment illustrated by FIG. 50.

Turning now to FIGS. 46 through 49, an alternative embodiment is constructed using a solenoid 400 mounted upon cam plate 126. Solenoid 400 drives a locking plate 1006 reciprocally between a pair of radial extensions 1031 of circumferential wall 131 which forms a cylinder housed within and rotatable with respect to the shell, against the force of compression spring 406. Spring 406 is mounted between the cap 405 terminating one end of locking end 1006, and the side of upper extension wall 1031. Locking plate 1006 is partially perforated by blind false notch 806 positioned to be axially aligned with and to receive the distal end of shaft 1007 of plunger 1002 when solenoid 400 is un energized and in its rest position as shown in FIG. 48. When a mechanically conforming key is inserted into keyway 118 and the digital electronic signature borne by that key conforms to data stored within circuit 130, solenoid 400 is energized to retract plate 1006 in a downward direction, as shown in FIG. 48, and unlocking slot 804 is axially aligned with the distal end of shaft 1007, as shown in FIG. 49.

Guide plate 1004 extends transversely between radial extension walls 1031, and is perforated by a through aperture accommodating entry in partial passage of the enlarged proximal end of shaft 1007. Return spring 407 acts against plate 1004 to hold plunger 1002 within groove 413 formed in guide wall 602. The distal doubled end surfaces 1003 of plunger 1002 conform with the shape of groove 413 to form an obtuse angle at its apex, thereby enabling application of manual torque to keyway 118 to force, through camming action between surfaces 1003 and the walls of groove 413, plunger 1002 to the left as shown in FIG. 48. Consequently, absent electronic conformance between the digital electronic signature held by the key inserted in the keyway 118 and data stored within the memory of circuit 130, the distal end of shaft 1007 will engage false notch 806. This is frequently the situation when a person seeking unauthorized access to the container secured by the locking mechanism attempts to simultaneously jar solenoid 400 while overcoming the bias force created by spring force 406. The much larger force created by return spring 407 however requires a substantial jarring motion applied to the container, with result that the plunger 1002 tends to move suddenly and thereby overcome the bias force of return spring 407, with result that the distal end of shaft 1007 engages false notch 806. Electronic conformance between the signature held by the key and data stored within the memory of circuit 130 enables radially inward movement of shaft 1007 through aperture 804, thereby enabling the manual torque to rotate cam plate 126 clockwise as shown in FIG. 49. The apex of surfaces 1003 rides along the inner circumferential surface of guide wall 602.

Figure 52:
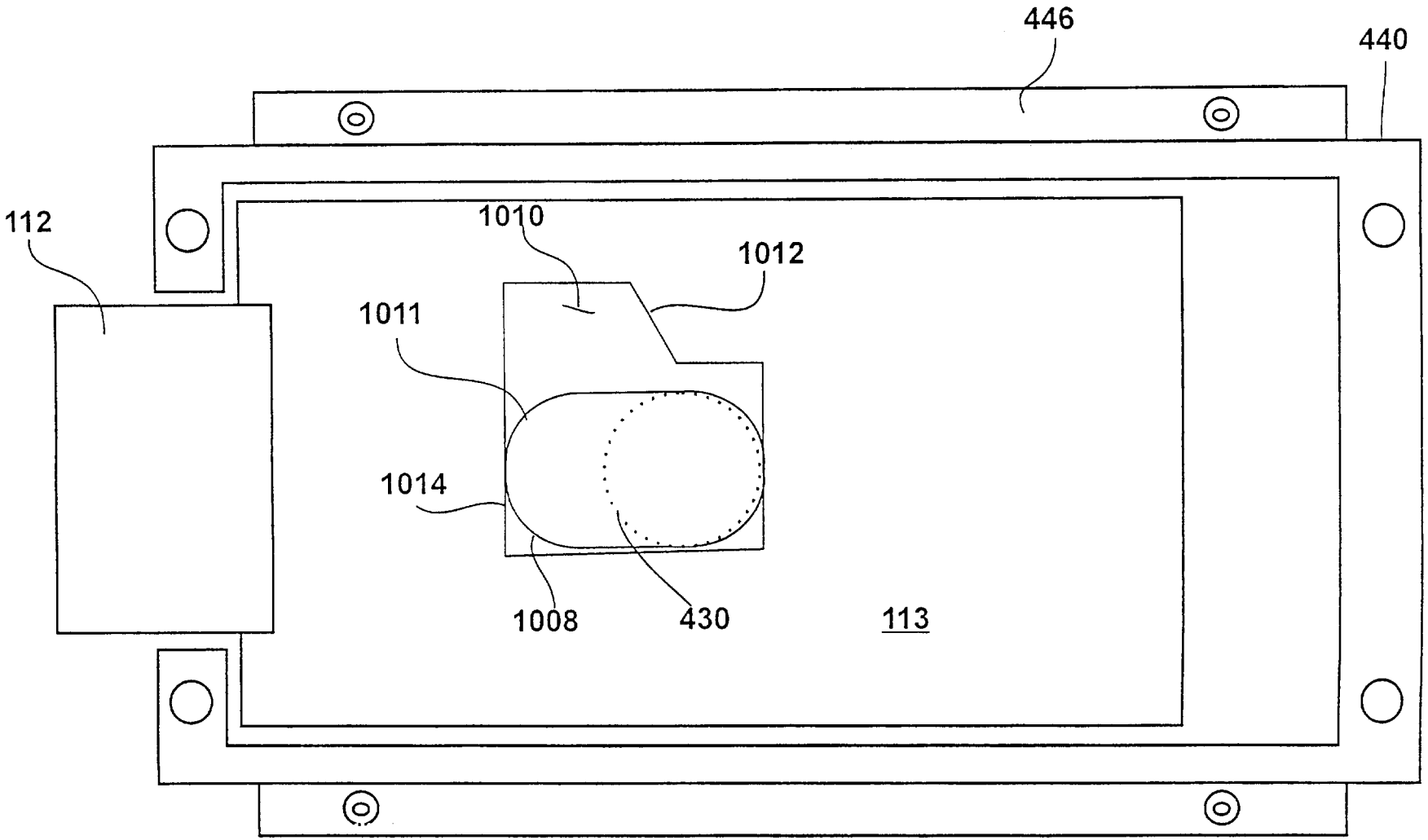
FIG. 52 is a plan view illustrating the embodiment of FIG. 50 while in a locked state.
Figure 53:
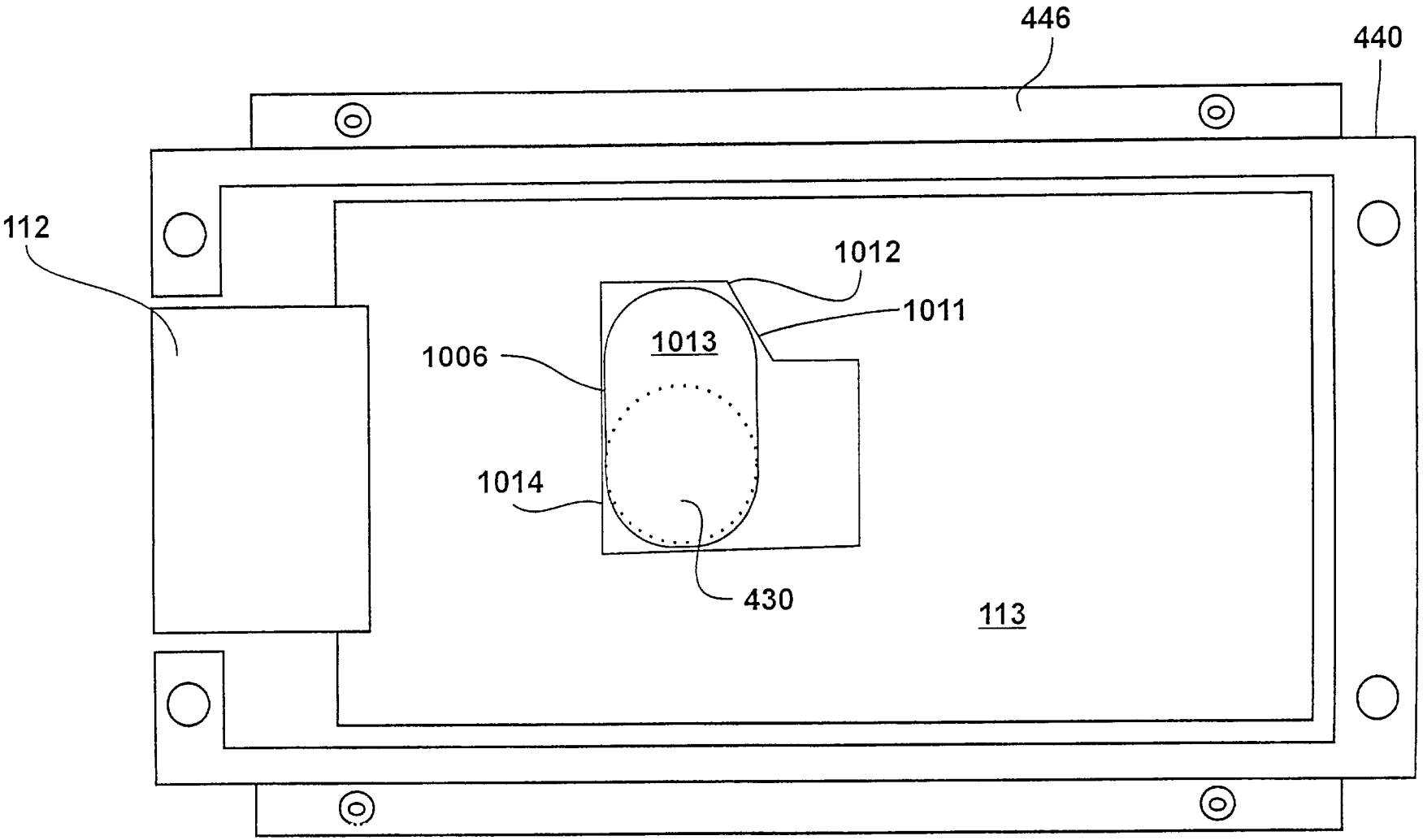
FIG. 53 is a plan view showing the embodiment illustrated by FIG. 50 while in an unlocked state.

Turning now to FIGS. 50 through 53, an alternative embodiment is shown constructed with an elliptical bolt drive lobe 1008 positioned between post 430 and cam plate 126. This embodiment eliminates the need for a separate, discrete bolt drive pin 434. Instead, the configuration shown relies upon camming action between surface 1011 of lobe 1013 to rotate through ninety degrees while engaging retract surface 1012 as manual torque is applied to a key that mechanically and electrically conforms to keyway 118 and circuit 130, as the key is turned counterclockwise (looking at FIGS. 52 and 53). This enables the camming action between surfaces 1011, 1012 to draw shank 113 to the right (as shown in FIGS. 52 and 53), thereby withdrawing bolt 112 substantially within housing 440. In an alternative configuration, the bitted plug 704 may be substituted for cylinder plug 116, to add an additional element of access security.

Turning now to FIGS. 54 through 57 show yet another alternative embodiment constructed with a cam plate 126" having a centrally positioned spacer 431 and pivot post 430 coaxially aligned with the keyway 118 of cylinder plug 116 mounted upon cover 128 via spacer 123. Cam plate 126" is equipped with a downwardly depending drive pin 434 radially offset from the central axis of keyway 118. A notch 1113 is formed at an intersection of two sides of plate 126" separated by spacer 431 from bolt 112. Notch 1113 engages blocking plate 1107 mounted on the distal end of armature 404. Solenoid 400 is mounted upon the floor of housing 440, rather than upon cam plate 126". A pair of electrical leads 1018 coupled to plug 1012 electrically engage a pair of jacks 1016 mounted upon circuit board 139. Leads 1018 flex as cam plate 126" rotates through an approximate forty five degree arc in response to manual torque applied by a key inserted into keyway 118 when the key mechanically and electronically conforms to keyway 118 and circuit 130.

Figure 54:
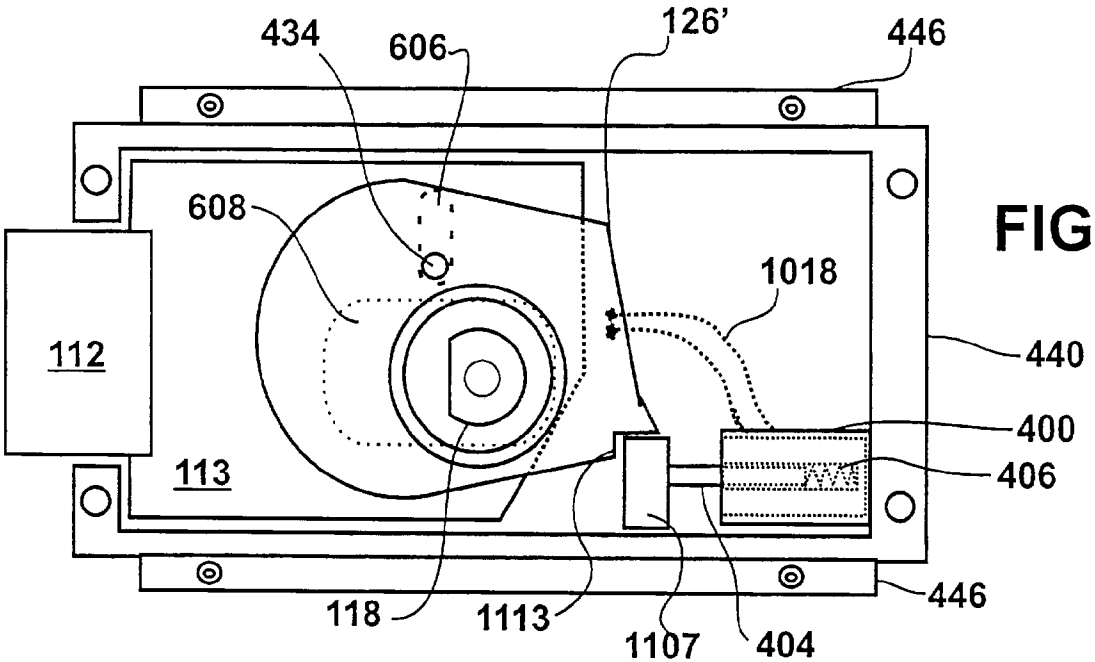
FIG. 54 is a plan view of another alternative embodiment constructed according to the principles of the present invention.
Figure 55:
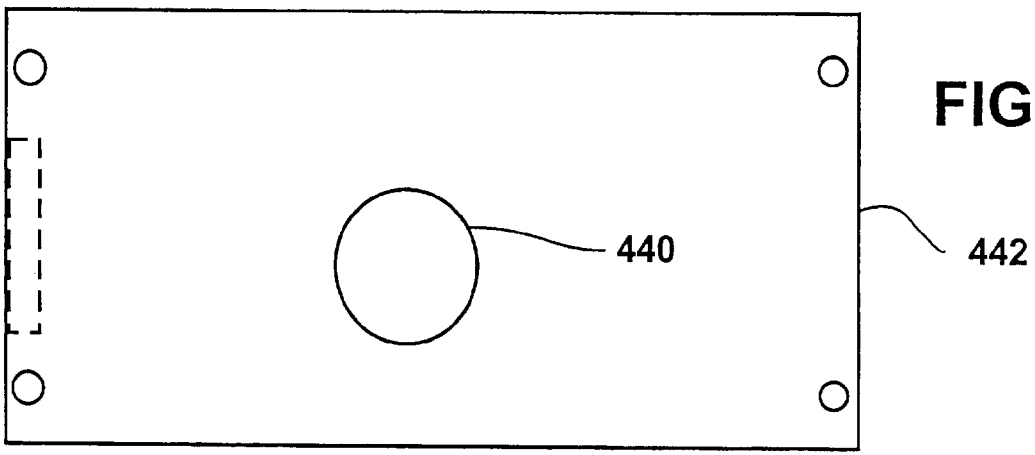
FIG. 55 is a cover that may be attached to the embodiment illustrated by FIG. 54.
Figure 56:
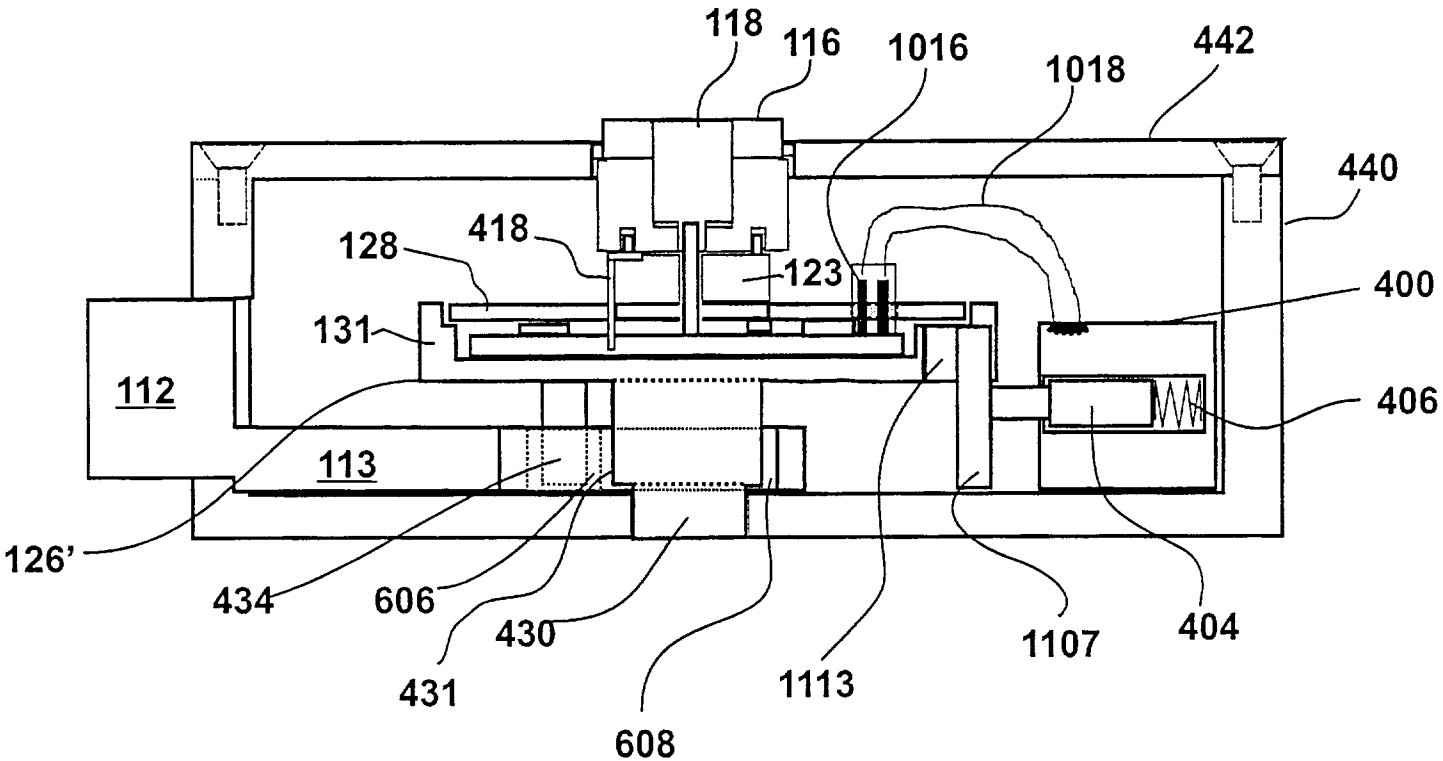
FIG. 56 is a cross-sectional elevation of the embodiment illustrated by FIG. 54.
Figure 57:
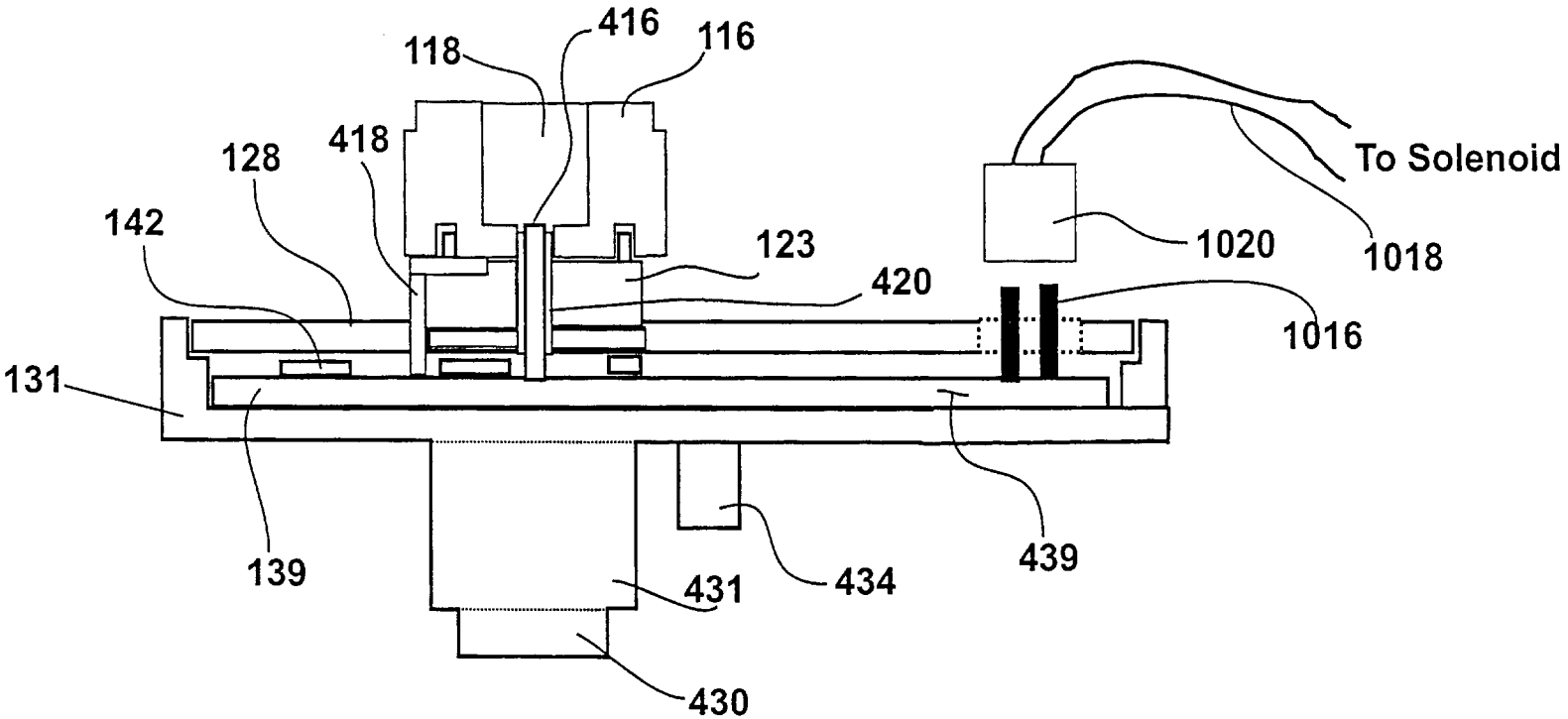
FIG. 57 is a side elevational view of the embodiment illustrated by FIG. 54 equipped with an unbitted cylinder plug.

Mechanical conformance of the key to keyway 118 and electronic conformance of the electronic digital signature held by the key to digital data stored within circuit 130 enables circuit 130 to apply an electrical current derived from the battery held by the key (or alternatively, by a battery mounted within circuit 130) to the winding of solenoid 400 via leads 1018, thereby retracting armature 404 and locking plate 1101, and thus allowing counterclockwise rotation of cam plate 126" under the force of the torque of the key. This causes drive pin 434 to force the walls of slot 606 to the right as shown in FIG. 54, thereby shifting shank 113 and bolt 112 to the right, thus withdrawing bolt 112 substantially within housing 440. Cover 442 is secured to housing 446. As shown in FIG. 57, plug 1020 may be easily removed from jacks 1016 to enable and easy replacement of solenoid 400.

Turning now to FIGS. 58 through 65, an alternative embodiment of a cam assembly is illustrated with a cam plate 126''' supporting the circuit board 139 containing an electronic circuit such as 130 (FIG. 11B). Power and data electrical contact wiper 416 is centrally positioned across the longitudinal axis (which extends out of the plane of the paper) while ground contact wiper 418 is spaced regularly apart from contact wiper 416. Shear pins 414 may connect a cylinder plug 116 with a centrally disposed boss 1218 formed within cam plate 126'''. An elliptical bolt drive lobe 1008 extends axially downwardly from the lower surface of cam plate 126''', to support a much smaller pivot post 430 that is symmetrically positioned around the longitudinal axis F of keyway 118. Elliptical lobe 1008 is situated within slot 1010 centrally formed within shank 113. The central boss 1218 of cam plate 126''' has a series of spaced-apart side walls 1210, 1212 and 1214 connected by an inwall 1215, loosely accommodating a cam locking bolt 1200, while allowing cam locking bolt 1200 to reciprocate radially relative to central axis F. A spring 1206 is compressed between end wall 1215 and the central inside portion of cam locking bolt 1200, thereby holding nose 1208 of cam locking bolt 1200 outwardly protruding to engage an arch 1222 formed in a guide wall 1220 of housing cover 1240.

Figure 60:
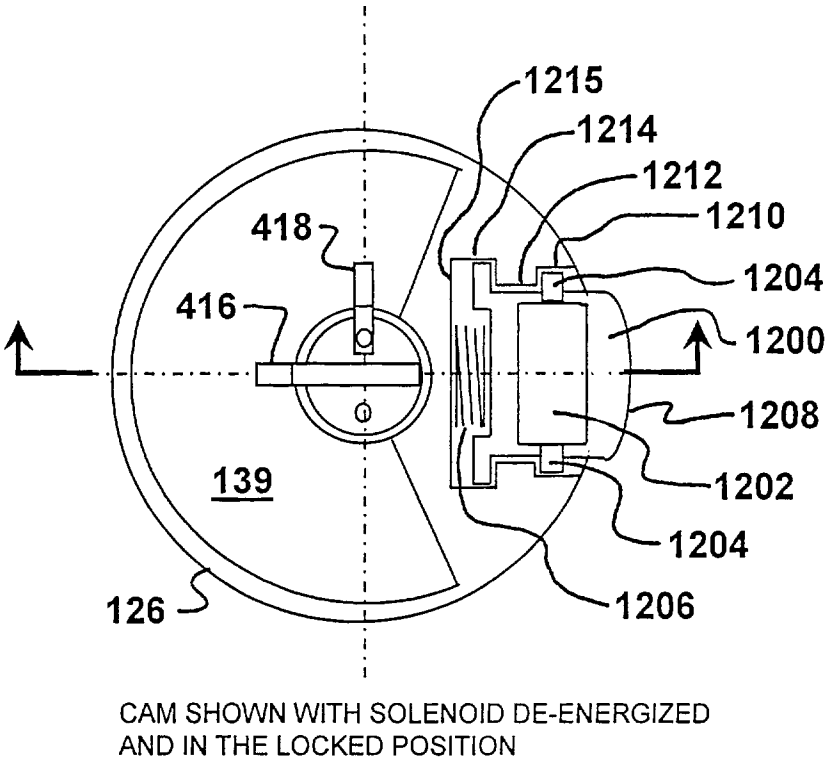
FIG. 60 shows a plan view of the cam assembly of FIG. 58.
Figure 58:
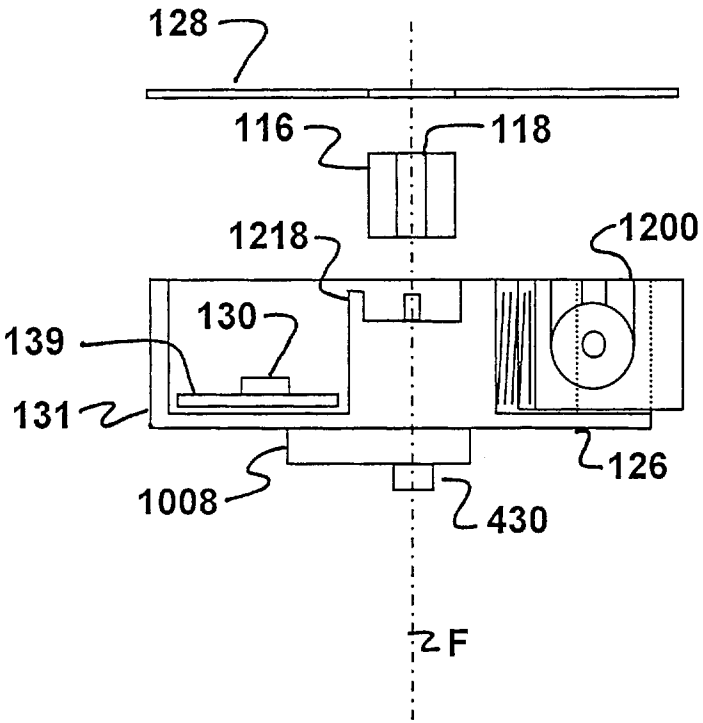
FIG. 58 shows a cross-sectional view taken along the sectional line in FIG. 60, of an alternative embodiment.
Figure 63:
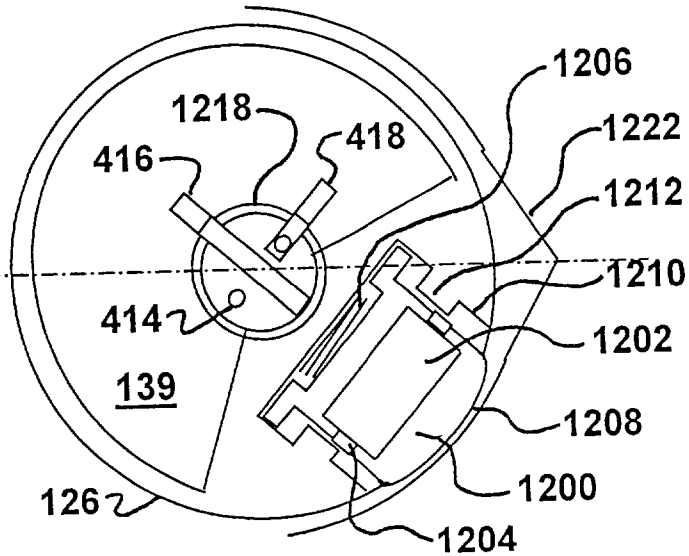
FIG. 63 shows a plan view of the embodiment of FIG. 58 in an unlocked and opened position.
Figure 59:
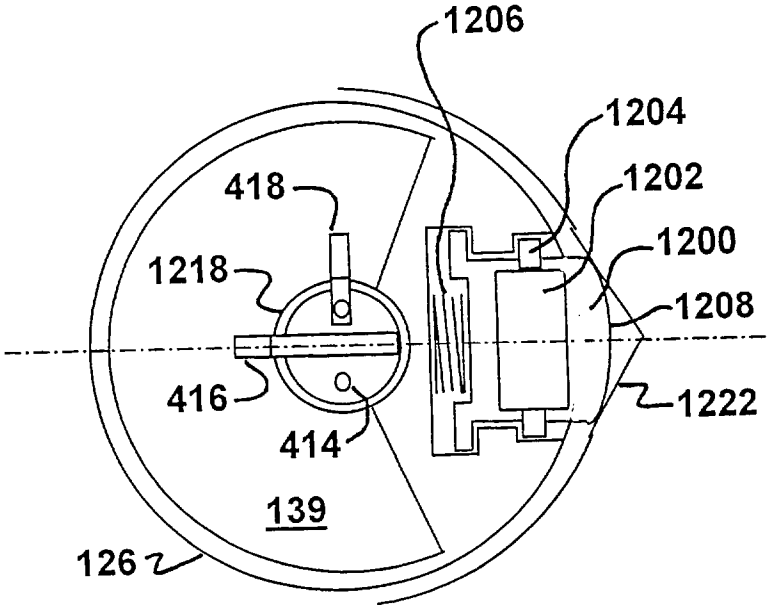
FIG. 59 shows a plan view of the embodiment of FIG. 58, when installed with a guide wall.
Figure 61:
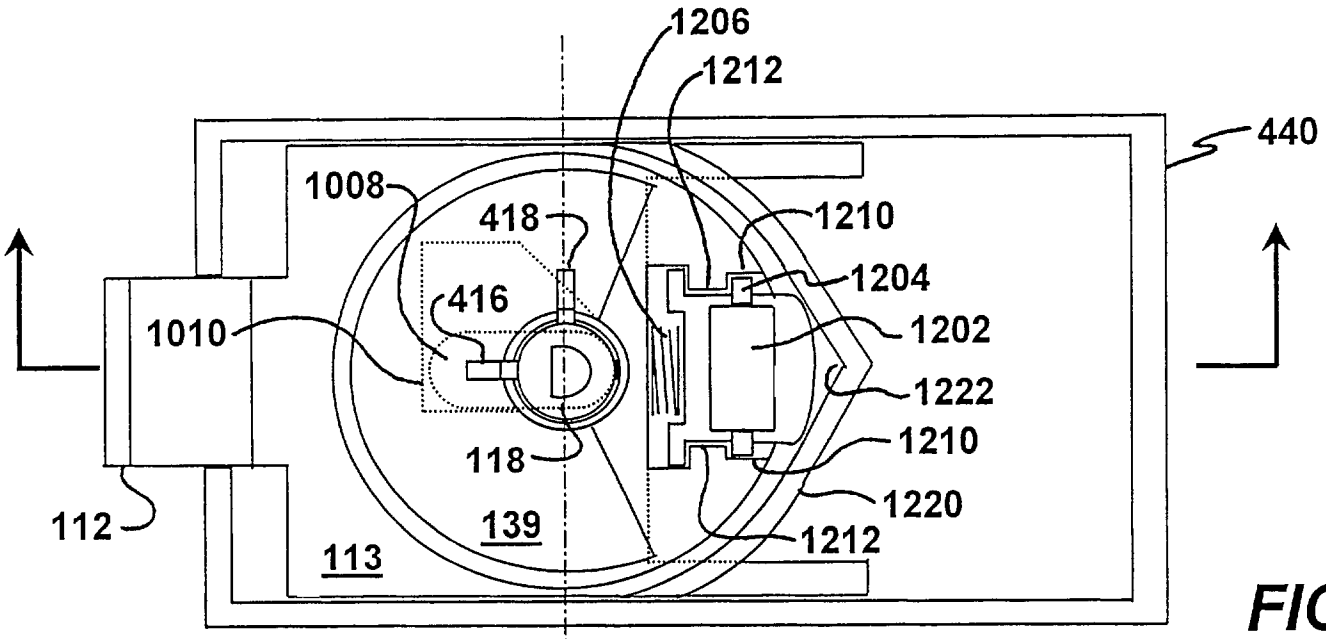
FIG. 61 shows a plan view of the embodiment of FIG. 58, as installed in a lock assembly.
Figure 62:
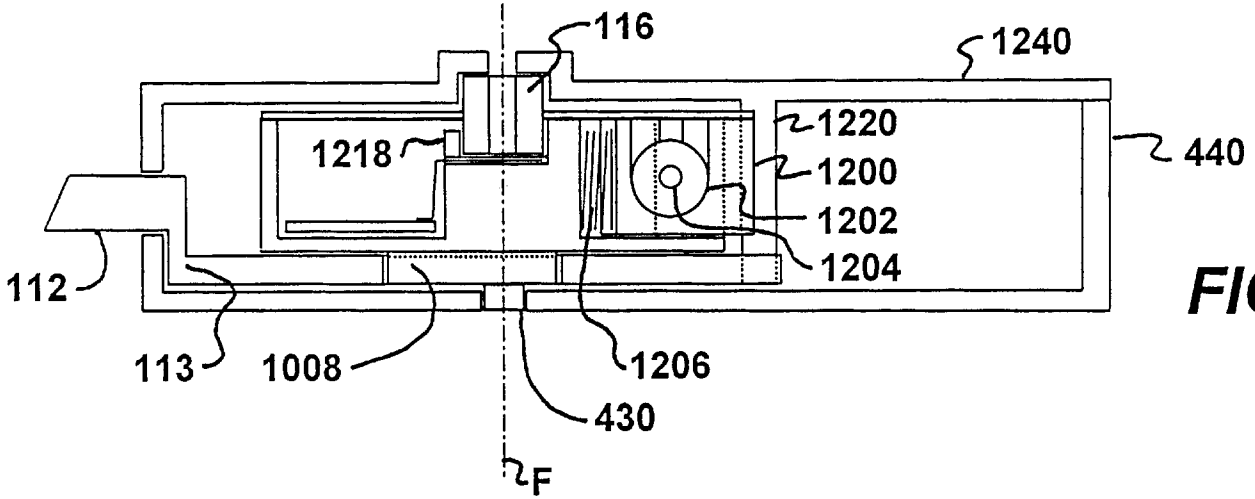
FIG. 62 shows a cross-sectional view taken along the sectional line in FIG. 61.
Figures 64, 65:
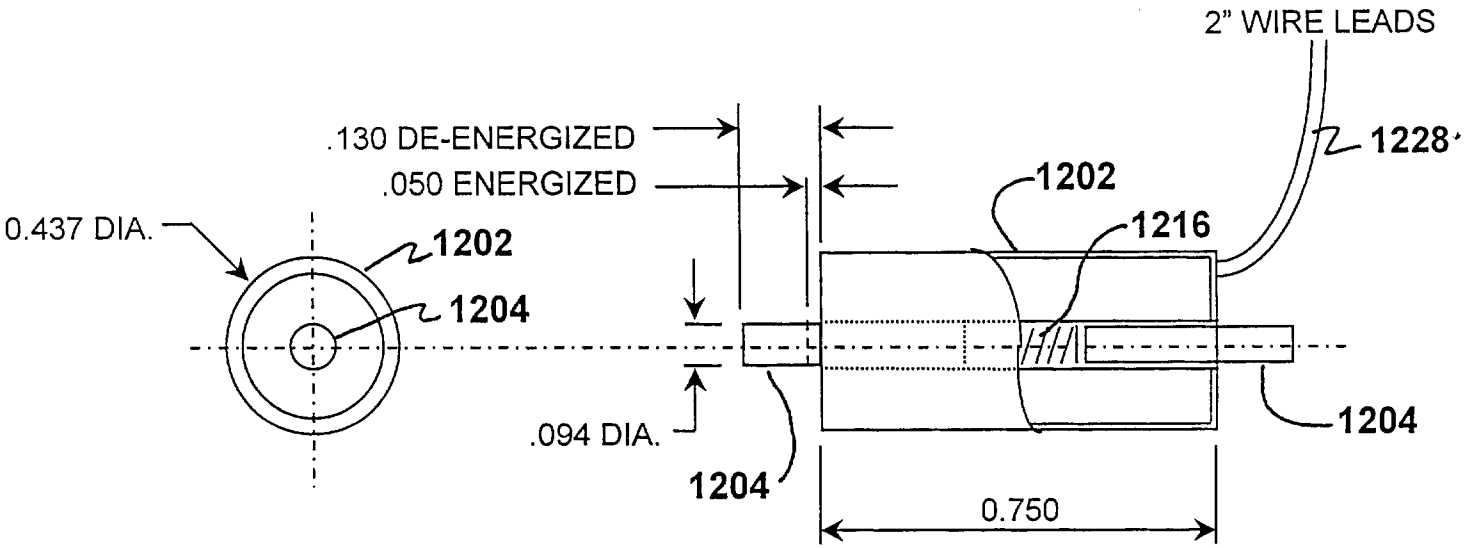
FIG. 64 shows a side view of a solenoid usable in the embodiment of FIG. 58.
FIG. 65 shows a side view of the solenoid of FIG. 64.

Solenoid 1202 blocks cam locking bolt 1200 with oppositely extending coaxially positioned armatures 1204 which, when solenoid 1202 is de-energized, extend axially outwardly as shown in FIG. 60 in order to place the cam assembly in the locked position. Solenoid 1202 may be constructed with a single annular wound coil driving both armatures 1204 in opposite coaxial directions. Mechanical conformance of the key inserted into keyway 118 and electronic conformance of the digital signature held by the key with the memory of circuit 130 (not separately shown) mounted upon circuit board 139 will enable circuit 130 to apply an electrical current to the coil of solenoid 1202, thereby retracting both armatures 1204 against compression spring 1216. This enables the manual torque applied by the key to keyway 118 in a clockwise direction, to cam nose 1208 of cam locking bolt 1200 out of arch 1222 and thus accommodate clockwise rotation of cam plate 126''' against the bias force of spring 1206, as shown by FIG. 63.

While energized by circuit 130, solenoid 1202 withdraws armatures 1204 by a sufficient distance to allow the distal ends of armatures 1204 to an axial length less the distance between opposite side walls 1212. In a locked, unenergized state solenoid 1202 has armatures 1204 extending to coaxial length somewhat less than the separation between opposite side walls 1210; it is the energization of solenoid 1202 that retracts solenoid 1202 to an axial length less than least distance separating side walls 1212. In one embodiment, each armature 1204 extended approximately 0.130 inches while solenoid 1202 was de-energized, but extended only 0.050 inches while solenoid 1202 was energized. Wire leads 1228 electrically coupled the coil of solenoid 1202 to circuit 130. It may be seen therefore, that counterclockwise rotation of the key placed within keyway 118 will enable nose 1208 of cam locking bolt 1200 to reciprocate regularly outwardly into arch 1222 prior to withdrawal of the key.

Figure 66:
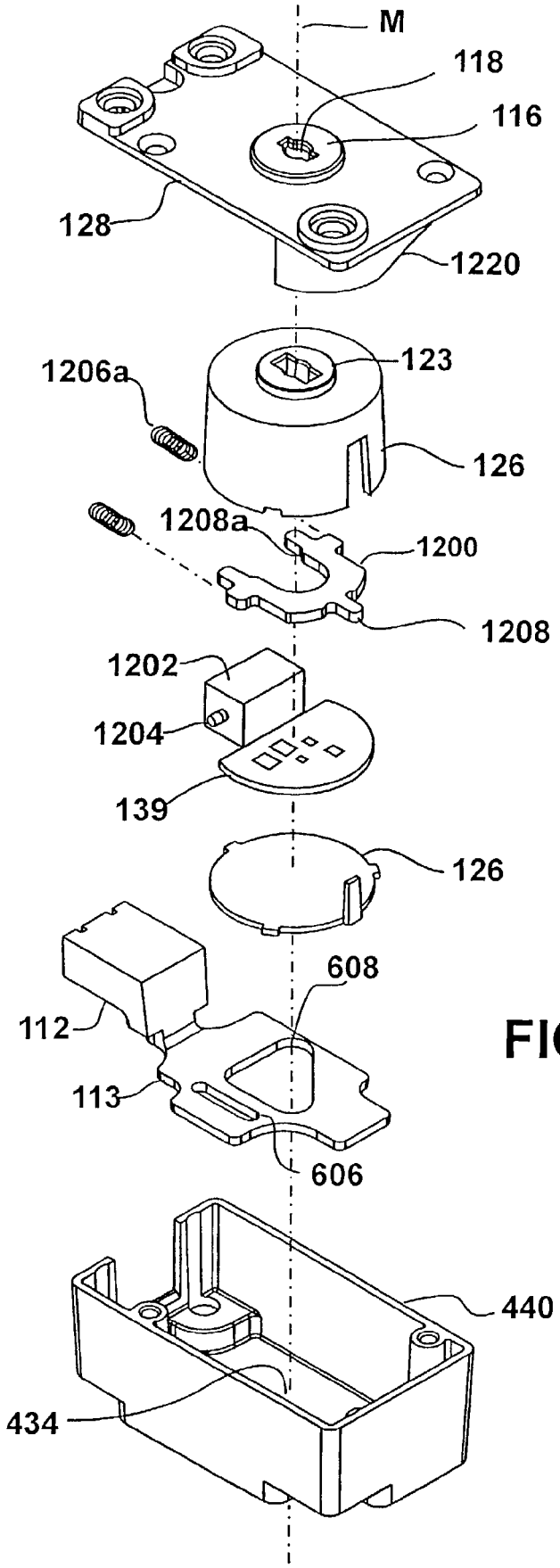
FIG. 66 shows an exploded isometric view of the embodiment illustrated by FIG. 58.

In an embodiment illustrated by FIG. 66, an alternative to the construction of the embodiment of FIGS. 58 through 65 is shown with a pair of compressible springs **1206*a* being substituted for the single compressible spring 1206. Each spring 1206*a* is seated within a different recess 1210 to bias a boss 1208*a* of cam nose 1208 toward engagement against guide wall 1220; the rotary force of manual rotation of a conforming key within keyway 118 overcomes the combined bias forces of springs 1206*a*, and enables reciprocal displacement of cam nose 1208 from engagement within arch 1222 and, ultimately, movement of shank 113 and the concomitant withdrawal of bolt 112 toward the interior of casement 440**.

Figure 67:
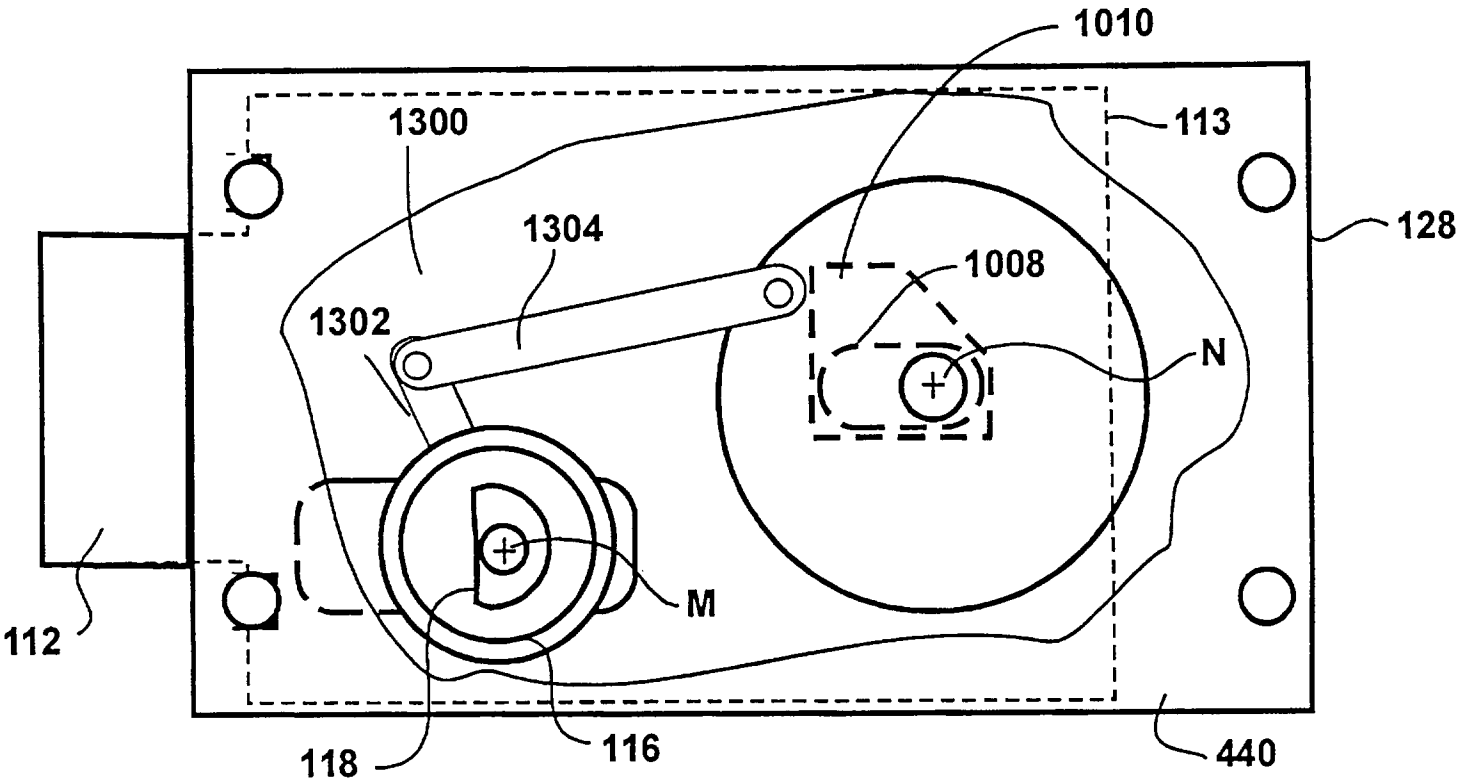
FIG. 67 shows a top view of an assembled alternative embodiment while in the locked state.
Figure 68:
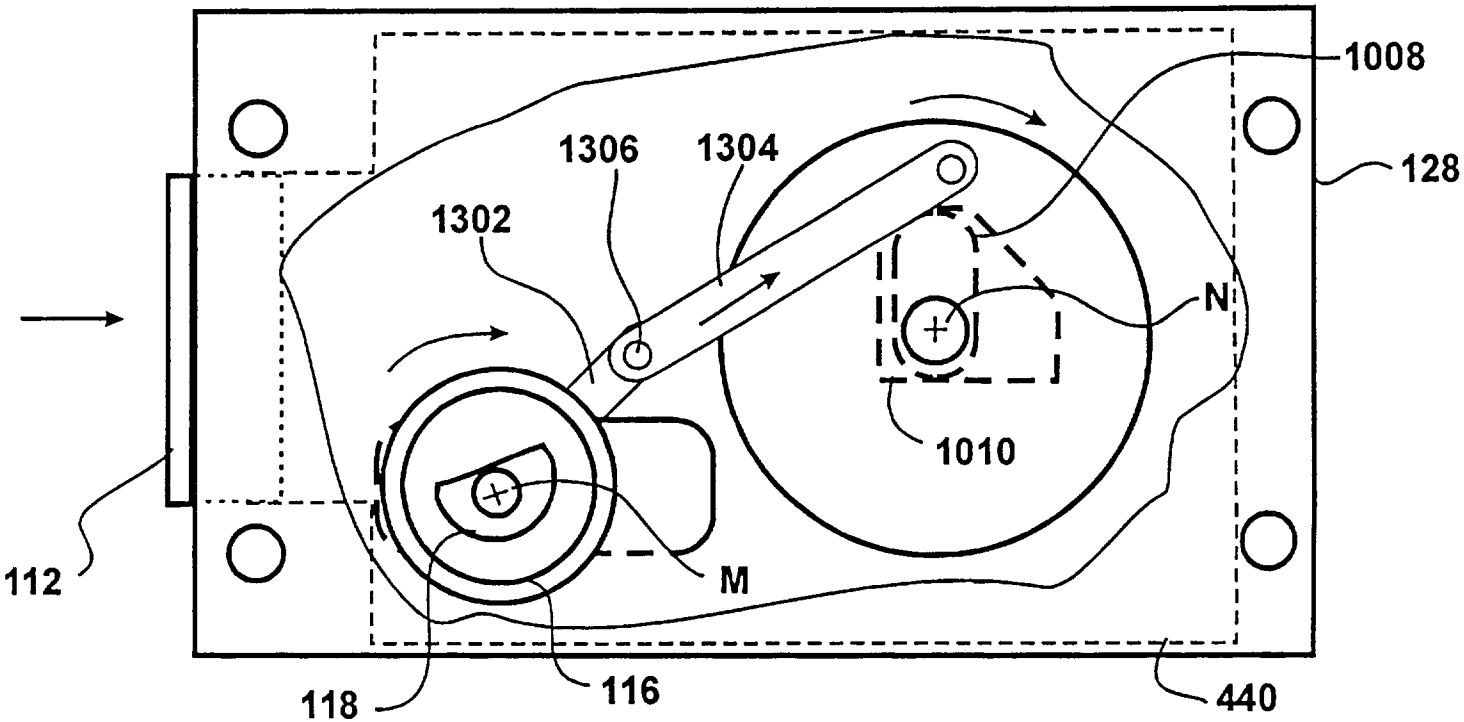
FIG. 68 shows a top view of the embodiment of FIG. 67, while in an unlocked state.
Figure 69:
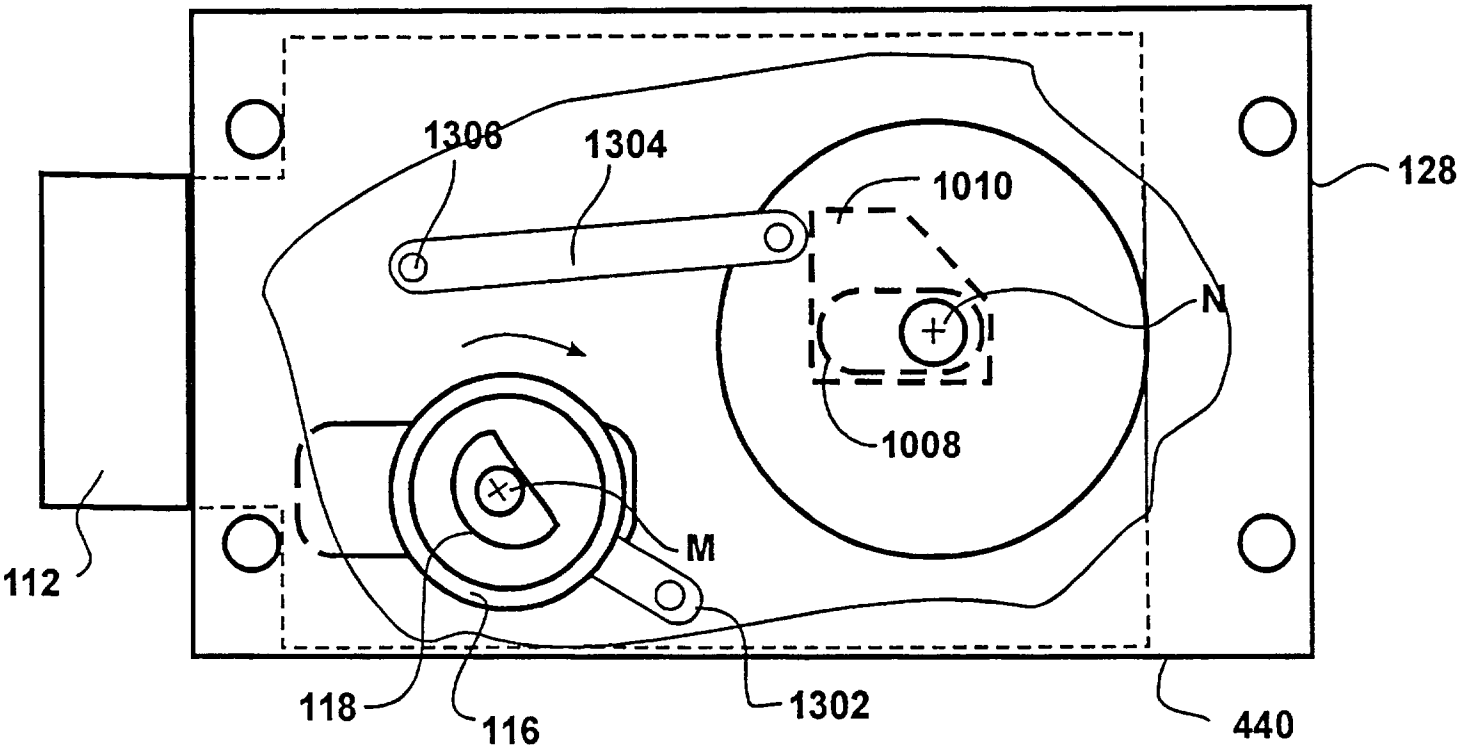
FIG. 69 shows a top view of the embodiment illustrated by FIG. 67 in a locked state, after the embodiment has been subjected to excessive keyway torque.

FIGS. 67 through 69 illustrate an assembled alternative embodiment of the principles of the present invention with an articulated lever 1300 operationally coupling cylinder plug 116 with cam plate 1260 while the shank 113 of bolt 112 is held by drive lobe 1008 mounted on cam plate 126 in a locked state, extending outwardly beyond the adjacent wall of casement 440 for the lock. Cylinder plug 116 is positioned toward the lower left interior of casement 440, to rotate around a first axis M that is laterally offset from cam plate 126. Cam plate 126, which may, in a particular embodiment, be the same assembly as cam plate 126''' illustrated in FIG. 66, albeit without spacer 123 and with cylinder plug 116 being separately and independently mounted along axis M, is positioned within casement 440 to rotate around a second axis N that is preferably parallel, and laterally (or, more accurately, radially) offset from first axis M. Referring briefly to the views of alternative embodiments provided by, for example, FIGS. 73, 73A through 73D, 76C and 76 D, circuit board 139 is mounted upon, and borne by, cam plate 126. Circuit board 139 carries the individual components of circuit 130 and, optionally, a battery. An electrical contact is formed on circuit board 139 beneath the head of threaded fastener 1013, and an electrically conducting substrate 1508 lies beneath cam plate 126. Cam plate 126 is pivotably mounted between lower spacer 1431 and upper spacer 1441. Spacers 1431, 1441 are respectively supported by lower pivot post 1430 and upper pivot post 1440, that are rotatably seated within recesses formed, respectively, within the base of casement 440 and cover 128.

FIG. 68 shows a top view of the embodiment of FIG. 67, while in an unlocked state with bolt 112 drawn by clockwise rotation of lobe 1008 against recess 1010 within shank 113, into the interior of casement 128. In this embodiment, lever 1302, in combination with arm 1304, operationally connects cylinder plug 116 with cam plate 1260. Lever 1302 is joined, preferably in a non-rotating relation, to and extends radially outwardly from, cylinder plug 116. Alternatively, lever 1302 may be pivotally coupled to cylinder plug 116 to experience a limited degree of lost motion prior to following any rotation experienced by cylinder plug 116. The distal end of arm 1304 is pivotally coupled by pin 1306 to the distal end of arm 1302, while the proximal end of arm 1304 is pivotally coupled to cam plate 126. The relative lengths of the interior of casement 440 and shank 113 restrict the throw of bolt 112, and thereby limit the angular rotation of cylinder plug 116 and cam plate 126.

In operation, a key (not shown) able to demonstrate both mechanical conformance when inserted into keyway 118 and electronic conformance to the digital signature held by the key with the memory of circuit 130 (not separately shown) mounted upon circuit board 139, will enable circuit 130 to apply an electrical current to the coil of solenoid 1202. The electrical current retracts both armatures 1204 radially inwardly and against compression spring 1216. This axial withdrawal of both armatures 1204 enables the manual torque applied to the key by the user, and by the key to keyway 118 in a clockwise direction, to turn lever 1302 clockwise. The clockwise rotation of lever 1302 in turn, forces arm 1304 to rotate counter-clockwise around axis N. This counter-clockwise rotation forces surface 1209 of cam nose 1208 out of the detent formed by arch 1222 and drives cam nose 1208 to the left, and thus accommodates counter-clockwise rotation of cam plate 126 against the bias force of spring 1206 (not separately shown in FIGS. 67-69). While energized by circuit 130, solenoid 1202 withdraws simultaneously armatures 1204 in opposite axial directions by a sufficient distance to allow the distal ends of armatures 1204 to extend axially outwardly by an axial length that is less the distance between opposite side walls 1212. In a locked, unenergized state, solenoid 1202 has armatures 1204 extending to a coaxial length of somewhat less than the separation between opposite side walls 1212. In these particular embodiments, the energization of solenoid 1202 causes the retraction of armatures 1204 into solenoid 1202 by an axial length of less than the least distance separating side walls 1212. The retraction of armatures 1204 permits the manual rotation of cylinder plug 116 to transmit the rotational force to cam plate 126 via lever 1302 and spring 1304. Elliptical lobe 1008 may be coaxially mounted with cam plate 126 to rotate counter-clockwise around axis N, as indicated in FIG. 68, when a conforming key is inserted into keyway 118 and rotated clockwise around axis N. The distally entending end 1008 of lobe 1013 rides along the transverse wall of the recess 1010 formed within shank 113, and the concomitant camming action between the distal end 1008 of lobe 1013 and the wall of slot 1010 forces shank 113 to the right, as is indicated in FIG. 68, thereby forcing bolt 112 to withdraw inside casement 440. This places the lock in an unlocked state shown by FIG. 68. Although various types of key retainers may be incorporated into cylinder plug 116 to hold the key (not separately shown) within keyway 118, as long as no counter-clockwise force is applied to the key, cam nose 1208 will remain outside of, and arcuately displaced from arch 1222, and the lock remains in its unlocked state.

The lock may be returned to its locked state by a manual application of a counter-clockwise torque to the key and cylinder plug 116, that, in turn, draws lever 1302 counter-clockwise, and pulls arm 1304 counter-clockwise, thereby causing cam plate 126 to rotate clockwise until the spring-loaded nose 1208 is released by fence 1220 to move to the right and into arch 1222. Either a previous, or a subsequent interruption of electrical current to the coil of solenoid 1202 enable armatures 1204 to move axially outwardly, in opposite directions, and to extend into the conforming slots 1210 formed in the circumferential wall of cam plate 126. Completion of the counter-clockwise rotation of the key within keyway 118 enables the key to be withdrawn from the retainer and keyway 118.

Should excessive torque be applied to cylinder plug 116 as, for example, insertion of a conforming shank (e.g., the bit of a screwdriver) into keyway 118 during an illicit attempt to improperly obtain entry into the volume that is being secured by the lock, and if the excessive torque is adequate to rotate cylinder plug 116 around axis M, the combination of the engagement of nose 1208 and arch 1222, and the distal ends of armatures 1204 and slots 1210, prevents arm 1304 from forcing cam 1260 to rotate around axis N. If the magnitude of the torque is increased, pin 1306 coupling lever 1302 and arm 1304 will ultimately fail, as is shown in FIG. 69, before arm 1304 will force cam plate 126 to rotate around axis N.

Moreover, if cylinder plug 116 is completely wrenched out of the cover 128 of the lock in a further effort to obtain unauthorized entry, the radial offset between axes M, N denies direct access to both cam plate 126 the resulting void created by the absence of cylinder plug 116 does not provide direct access to either cam 1260 or to cam locking bolt 1200. Access to cylinder plug 116 is further restricted by the relative thinness of casement 440.

In some embodiments, lever 1302, pin 1306 and arm 1304 may serve as electrical conductors of signals propagating between a key and circuit board 139. Accordingly, these components may be made of alloys that are electrically conductive at room temperatures, with pin 1306 being made of a softer electrically conducting material that will shear after being subjected to excessive torque, before the application of the excessive torque to cylinder plug 116 causes sufficient deformity of either fence 1220, or to cam locking bolt 1200, to allow rotation of cam plate 126 around axis N.

Figure 70:
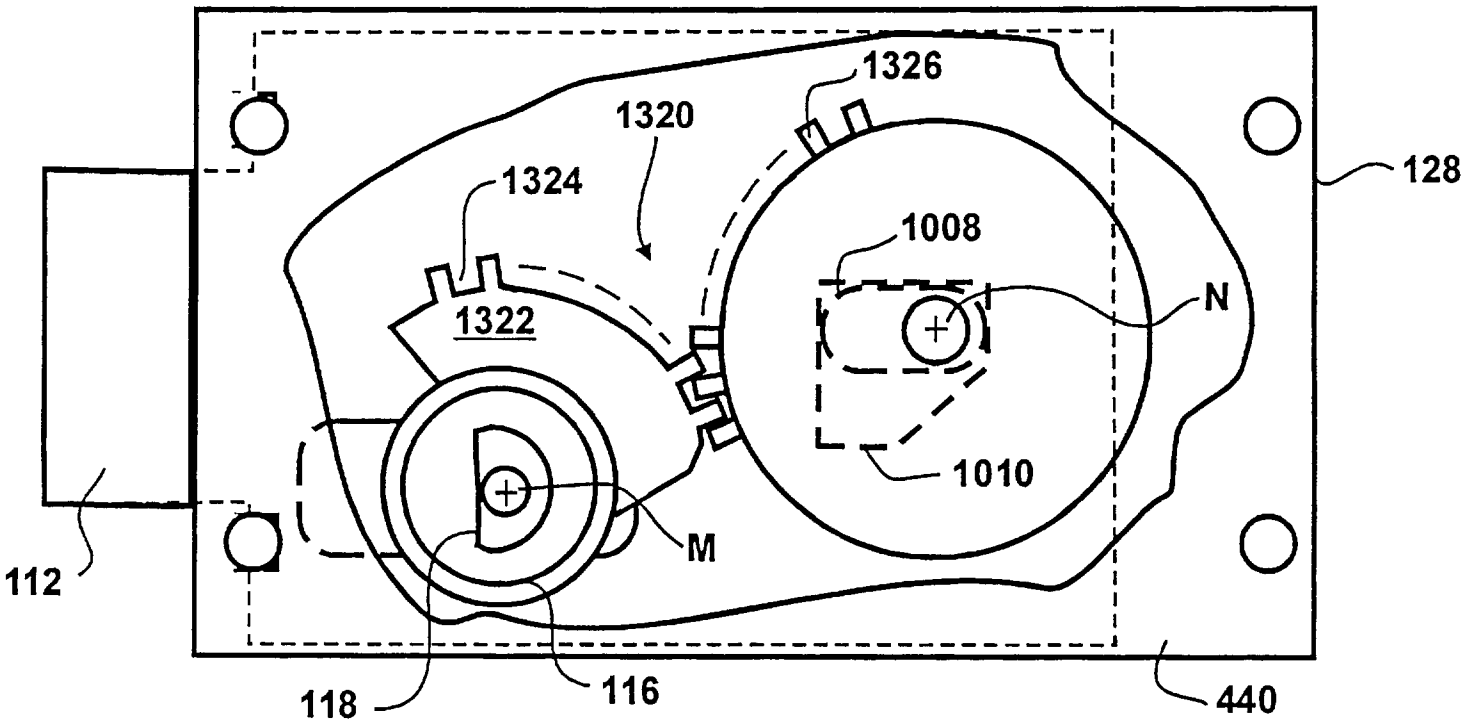
FIG. 70 shows a top view of still another alternative embodiment, while in a locked state.
Figure 71:
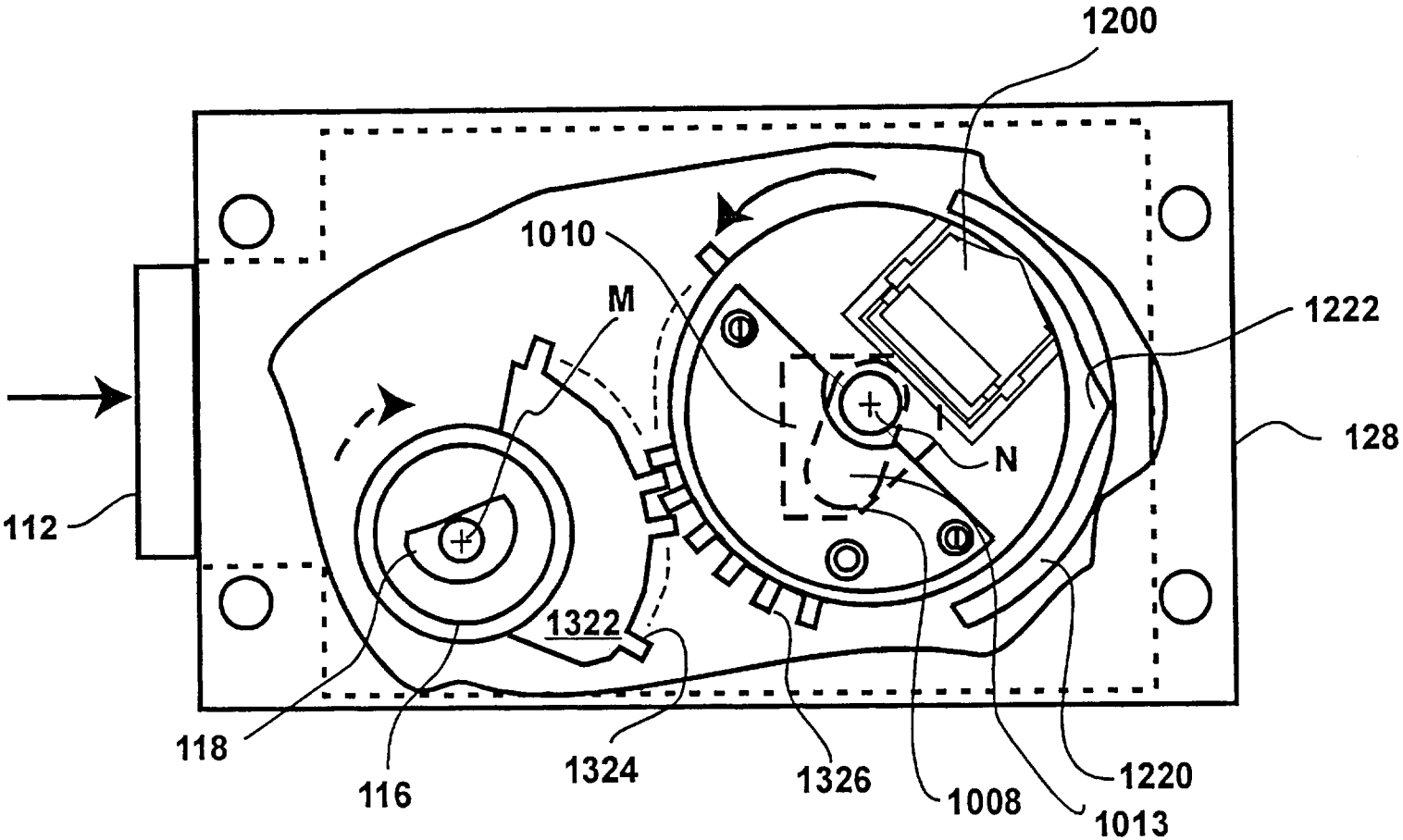
FIG. 71 shows the embodiment illustrated by FIG. 70, while in an unlocked state.

FIGS. 70 through 73D illustrate an assembled alternative embodiments with cylinder plug 116 positioned toward the lower left interior of casement 440, to rotate around a first axis M that is laterally offset from cam plate 126. Cam plate 126 is positioned within casement 440 to rotate around a second axis N that is preferably parallel, and laterally offset from first axis M. Cylinder plug 116 is joined with, and simultaneously rotates around axis M with a first sector gear 1322 that bears a plurality of teeth 1324 that are meshed with corresponding teeth 1326 arcuately extending around an arc of the periphery of cam plate 126, to form a second sector gear that rotates about axis N simultaneously with cam plate 126. As manual rotation of a key that mechanically and electrically conforms with both keyway 118 and a current code stored within the circuit 139 borne by cam plate 1260 turns cylinder plug 116, sector gear 1322 rotates clockwise around axis M as shown by FIG. 71, while meshed with teeth 1326 of the sector gear formed on cam plate 126; this, in turn, drives cam plate 126 around axis N. The rotation of cam plate 126 causes the edge 1008 of the elliptical lobe 1013 to cam against the inner surface of recess 1010 and force shank 113 to the right while drawing bolt 112 toward the right as shown in FIG. 71, and into casement 440, thereby placing the lock in the unlocked state shown by FIG. 71.

In the embodiment shown by FIGS. 70 and 71, to forestall unauthorized entry, the teeth 1324 of the cylinder plug gear 1322 may be made of a softer material such as brass, while teeth 1326 along the circumference of cam plate 126 may be made of a relatively harder material such as steel. Alternatively, teeth 1322 may be made of a softer material such as teflon while teeth 1326 may be made of a relatively harder material such as brass. Application of excessive torque to cylinder plug 116 such as when a non-conforming thin, elongate object such as the shaft of a screwdriver is forced into keyway 118, will cause the softer teeth 1322, 1326 to strip against the harder teeth, before cam plate 126 rotates. In some of these embodiments, the teeth 1322, 1326 may be used to provide one leg of an electrical path between the key and circuit board 139; consequently, electrically conductive materials of different relative hardness should be used for the teeth 1322, 1326 in order to assure that the teeth concurrently provide a continuous electrical path and strip relative to one another when excessive torque is applied to cylinder plug by a non-conforming object. The disparity in the degree of relative hardness between teeth 1322, 1326 is determined by the desire to have either teeth 1322 or teeth 1326 fail, and shear from the associated gear, before application of the excessive torque to cylinder plug 116 causes sufficient deformity of either fence 1220 or cam locking bolt 1200 to allow rotation of cam plate 126 around axis N.

Figure 72:
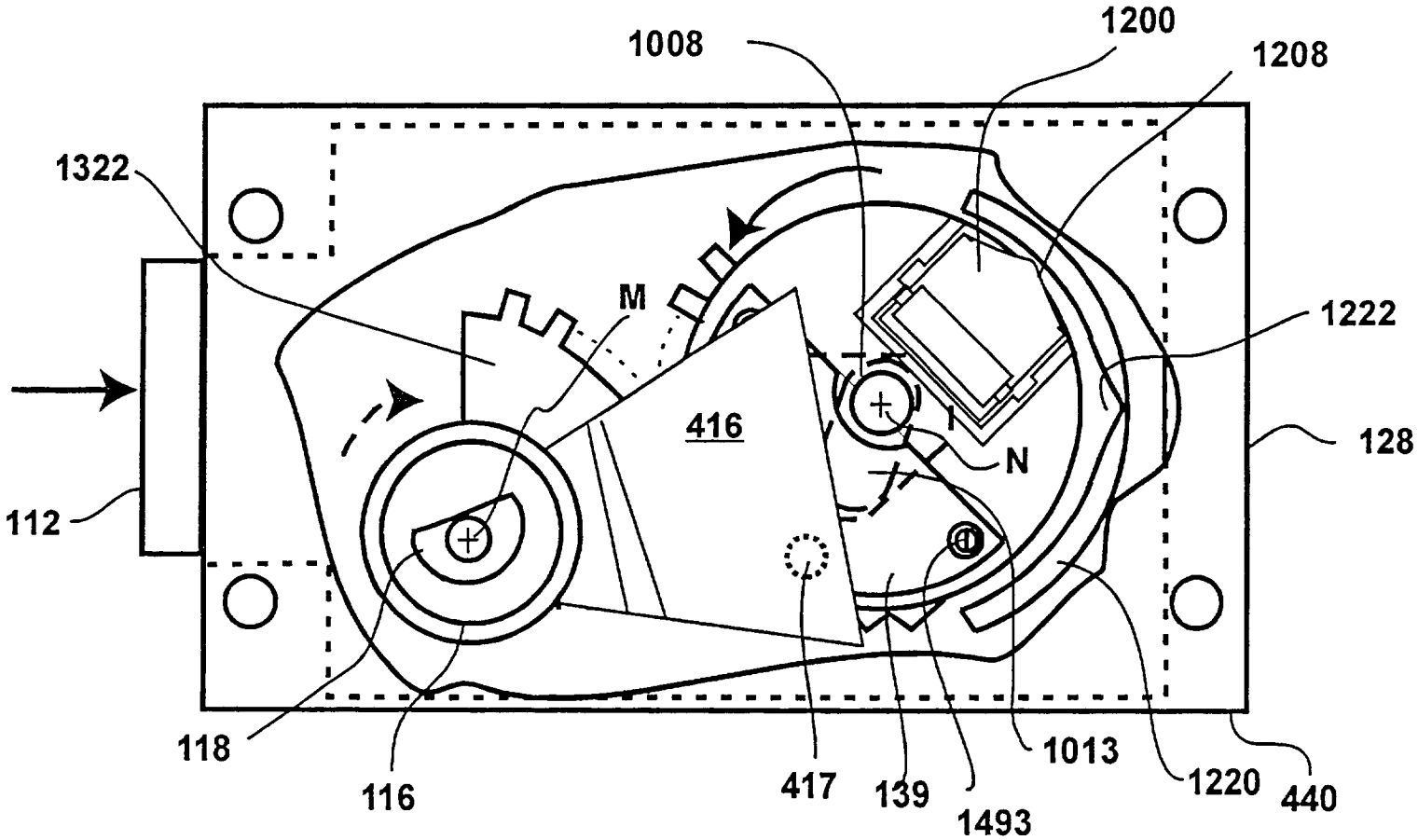
FIG. 72 is a top view of the embodiment of FIG. 70, shown in a partially unassembled, unlocked state.
Figure 73:
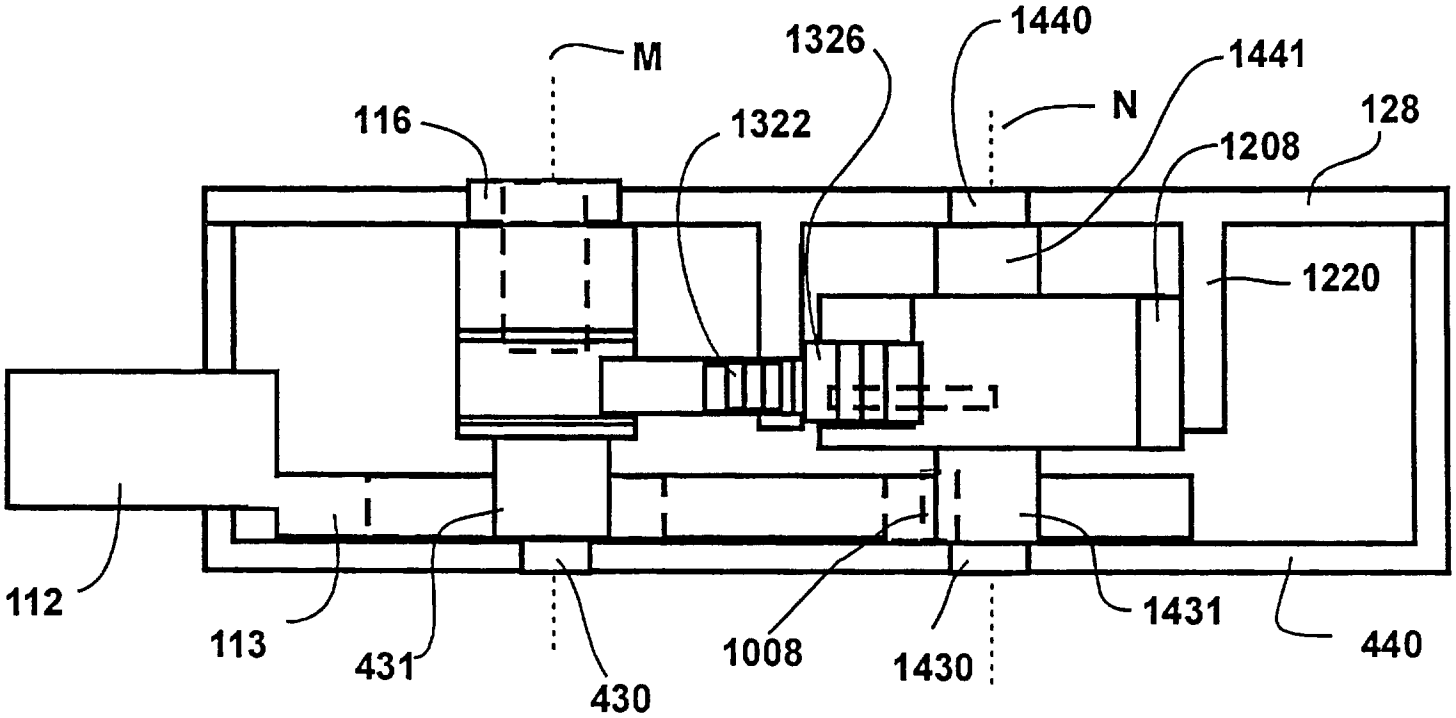
FIG. 73 is a side elevational view taken along the sectional line of FIG. 72.
Figure 73A:
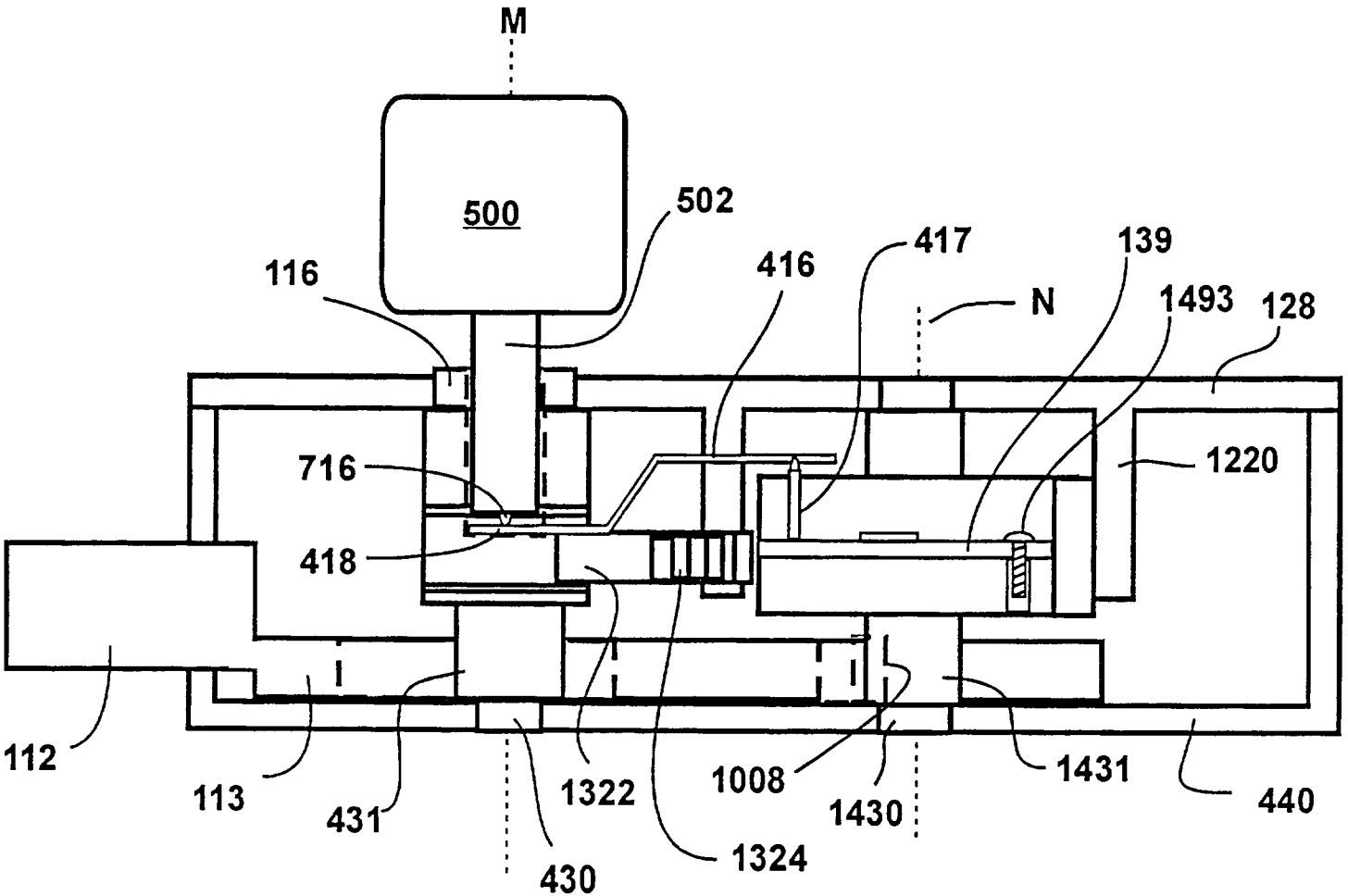
FIG. 73A is a side elevational view taken along the sectional line of FIG. 72, to illustrate the transfer and board mounted spring pin.
Figure 73B:
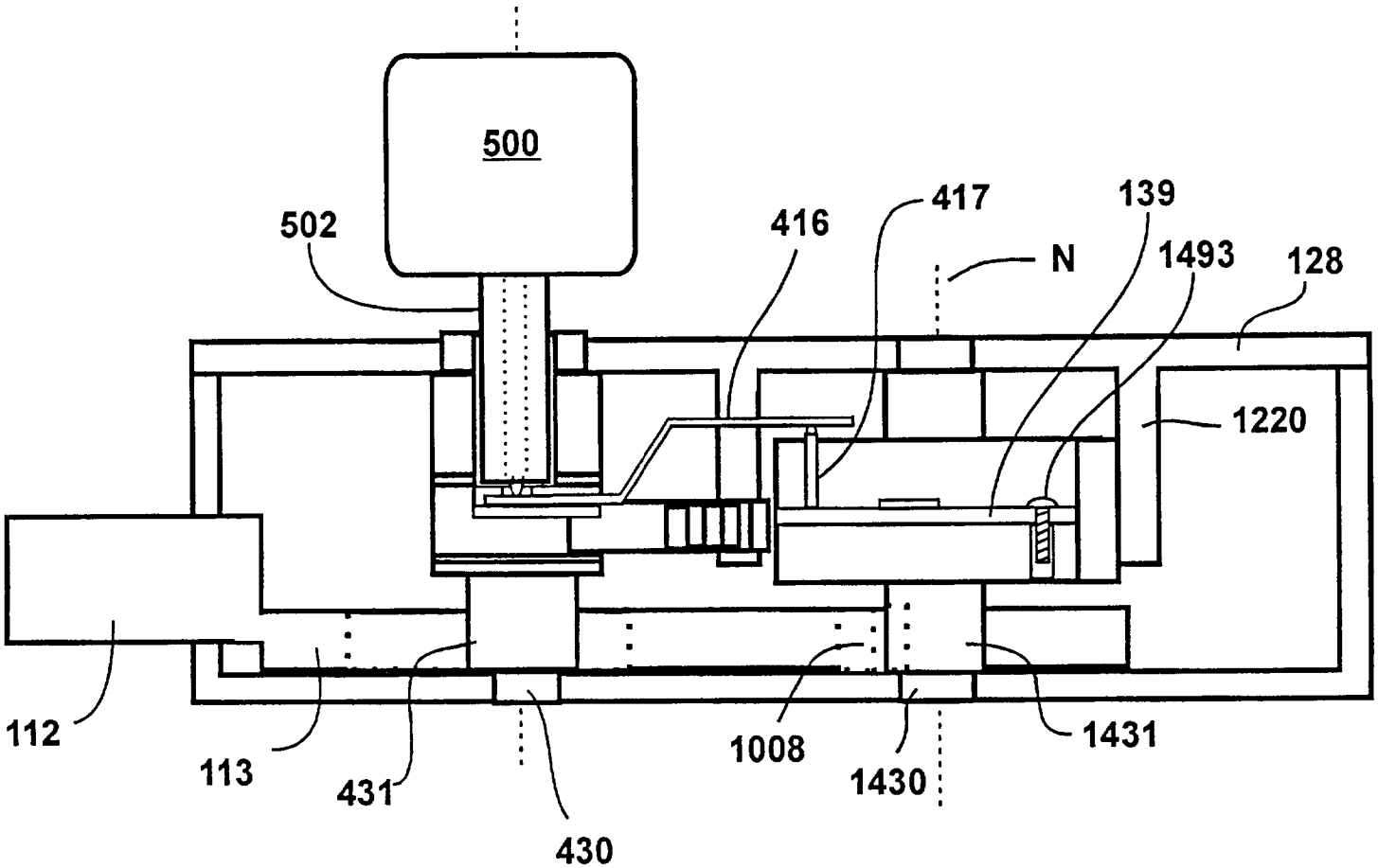
FIG. 73B is an enlarged side elevational view taken along the sectional line of FIG. 72, to illustrate the transfer and board mounted spring pin.
Figure 73C:
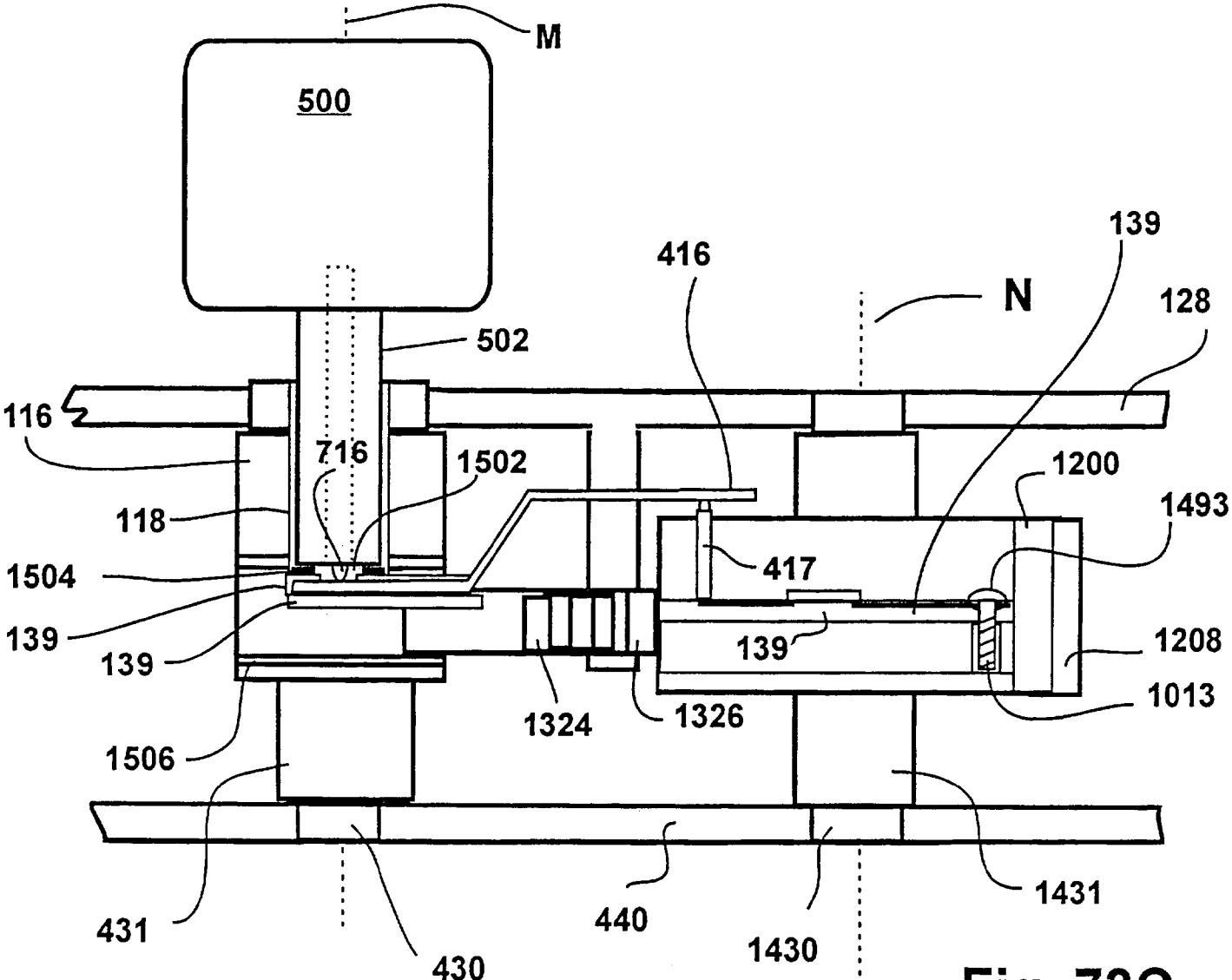
FIG. 73C is an enlarged side elevational view taken along the sectional line of FIG. 72, to illustrate the transfer, insulating material and board mounted spring pin.
Figure 73D:
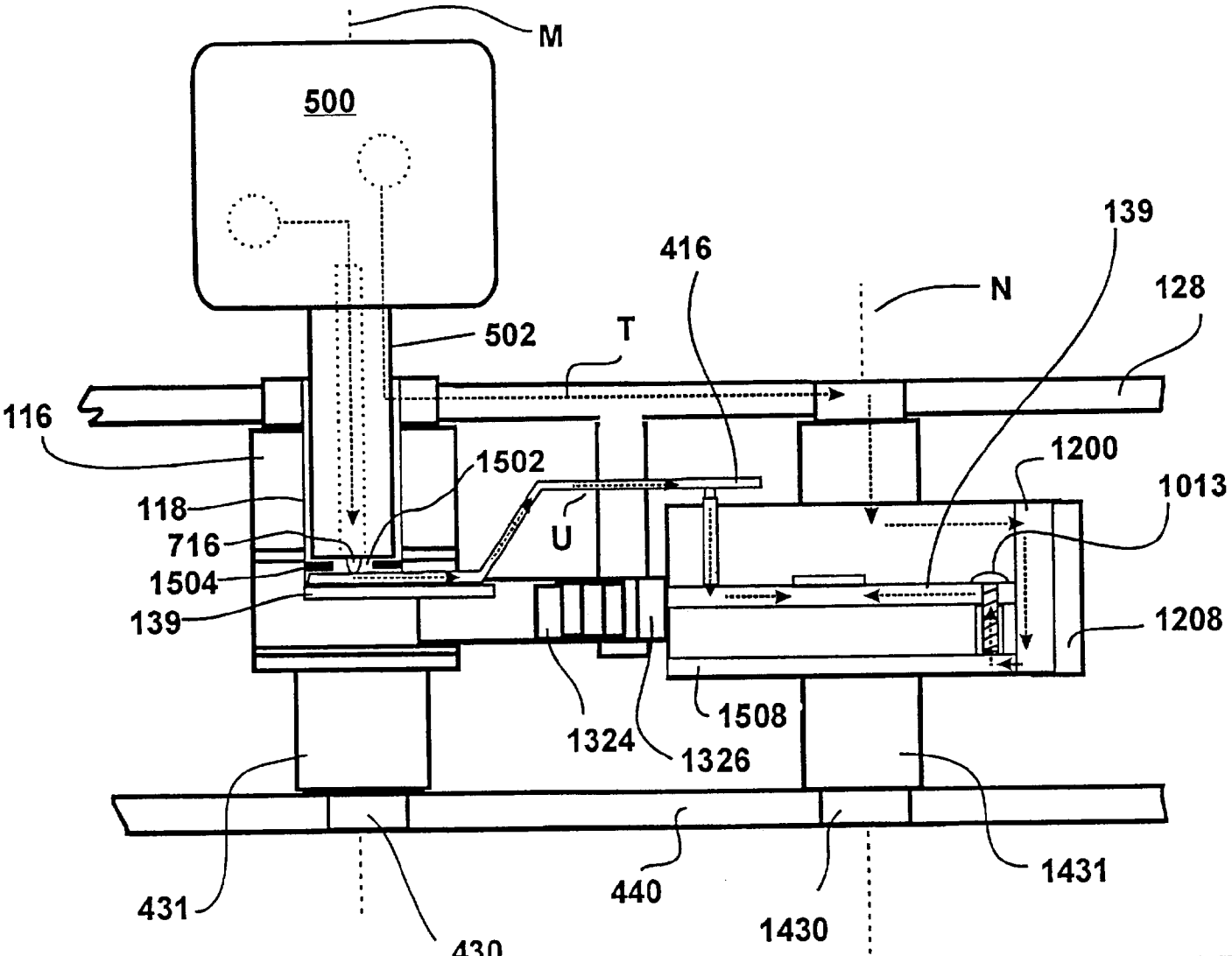
FIG. 73D is a side elevational view showing the electrical and data path through the embodiment of FIG. 70.

Turning now to FIGS. 72 through 73D, an alternative to the embodiments of FIGS. 67 and 70 is shown by FIG. 72 in a partially unassembled, unlocked state, and in FIGS. 73, 73A and 73B, in a locked state. In this embodiment, sector gear 1322 may be electrically insulated, top and bottom, from cylinder plug 116. Consequently, the materials of gear teeth 1322, 1326 do not need to be electrically conducting. An electrical contact 716 extending downwardly beyond the distal end of the blade 502 of key 500, makes an electrical contact with a socket 1502 electrically coupled to one end of an electrically conductive contact wiper 416 that is electrically isolated by electrical insulators 1504, 1506 from the electrically conducting elements of cylinder plug 116. The other end of contact wiper 416 is biased, as a leaf spring, to make continuous contact with a spring loaded electrical contact 417 such as a pogo-pin, mounted upon the circuit board 139 borne by cam plate 126. The dashed lines presented in FIG. 73D trace the arms of electrical current from two electrically isolated parts of key 500, namely blade 502 and terminal 716. Current from the battery side of key 500 traces a path through contact 716 extending, for example, through, but insulated from, the blade 502, through socket 1502, spring contact wiper 416, and spring-loaded contact pin 417 to circuit board 139. Circuit board 139 distributes the battery voltage to the individual components of circuit 130. A return, or local ground path may extend from a surface mount terminal on circuit board 139 that is located beneath the head of threaded fastener 1013, through threaded fastener 1013 and an electrically conducting substrate 1508 beneath cam plate 126 and spacer 1441, through upper pivot post 1440, through casement cover 128, and through cylinder plug 116 to the electrically conducting portion of the blade 502 of key 500. Alternatively, or additionally, a return path may extend between circuit board 139, threaded fastener 1013, substrate 1508, lower spacer 1431, lower pivot 1430, casement 440, and through either cover 128 and cylinder plug 116 or through lower pivot 430, lower spacer 431 and cylinder plug 116, to the electrically conducting portion of the blade of key 502. The flared distal end and spring loading of contact wiper 416 assures the continuity of electrical contact between the cylinder plug and circuit board 139 throughout the rotation between the locked and opened states of the mechanism. In an alternative embodiment, a flexible ribbon cable carrying two or more leads, may extend between one socket mounted upon cylinder plug 116 and a second socket mounted upon circuit board 139.

Figure 74:
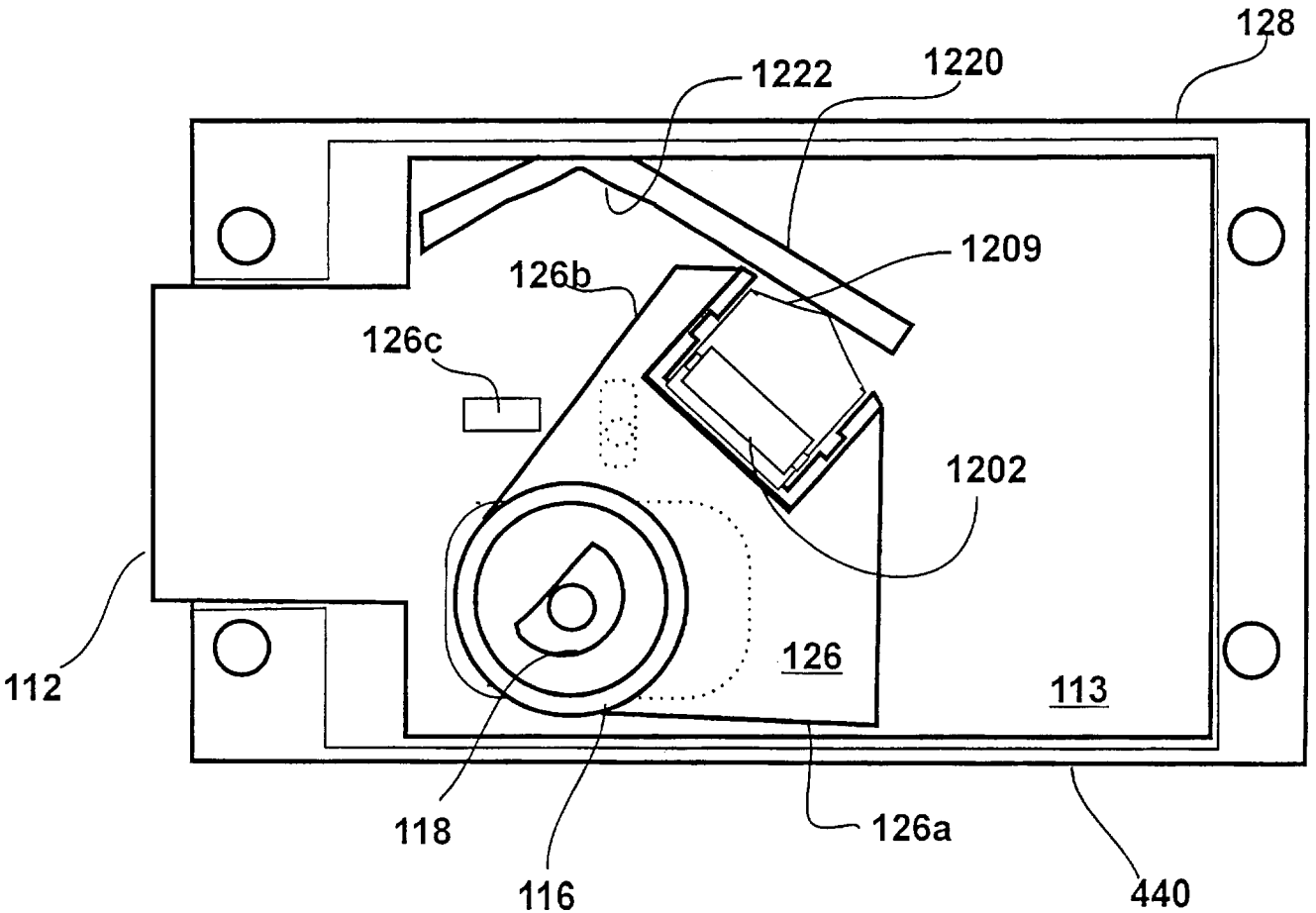
FIG. 74 is a top view of an assembled alternative embodiment while in an unlocked state.
Figure 75:
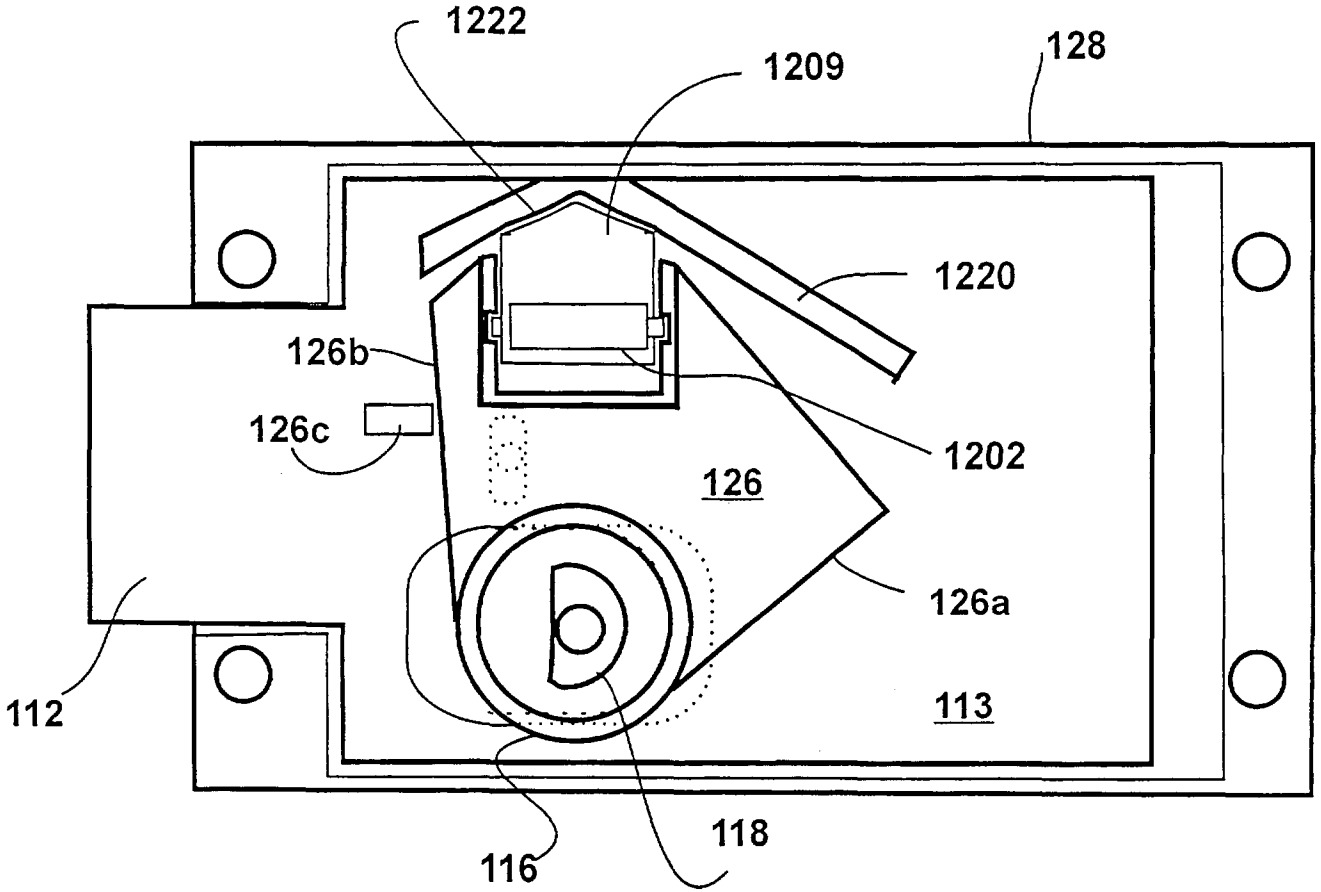
FIG. 75 is a top view of the embodiment illustrated by FIG. 74, while in a locked state.

FIGS. 74 and 75 illustrate a top view of an assembled alternative embodiment, respectively in unlocked and locked states. A trapezoidal shaped cam plate 126 bears an elliptical lobe 1008. Circuit board 139 (not shown in FIG. 75), and cam locking bolt 1200 bearing solenoid 1202, are mounted upon and rotate with cam plate 126. As better illustrated by FIG. 74, cam nose 1209 may be constructed with a multi-sided, or even a polygonal shape, as opposed to an arcuate shape, that generally conforms the concave shape of arch 1222, so that when a key (not shown) providing mechanical conformance when inserted into keyway 118 and electronic conformance of the digital signature held by the key with the memory of circuit 130 (not separately shown) mounted upon circuit board 139 will enable circuit 130 to apply an electrical current to the coil of solenoid 1202, thereby retracting both armatures 1204 against compression spring 1216. This enables the manual torque applied by the key to keyway 118 in a clockwise direction, to cam nose 1209 of cam locking bolt 1200 out of arch 1222 and thus accommodate clockwise rotation of cam plate 126 against the bias force of spring 1206, as shown by FIG. 74. While energized by circuit 130, solenoid 1202 withdraws armatures 1204 by a sufficient distance to allow the distal ends of armatures 1204 to an axial length less the distance between opposite side walls 1212. In a locked, unenergized state solenoid 1202 has armatures 1204 extending to a coaxial length of somewhat less than the separation between opposite side walls 1210; it is the energization of solenoid 1202 that retracts solenoid 1202 to an axial length less than least distance separating side walls 1212.

Cylinder plug 116 and the camming surface 1008 of elliptical lobe 1013 are coaxially mounted to rotate clockwise, as indicated in FIG. 74, when a conforming key is inserted into keyway 118 and rotated clockwise. The distally extending end 1008*a* of lobe 1008 rides along the transverse wall 1010*a* of the recess 1010 formed within shank 113, and the concomitant camming action between end 1008*a* and wall 1010*a* forces shank to the right to withdraw into casement 440. As is shown in FIG. 74, while approaching a fully unlocked orientation, the flat side 126*a* of cam plate 126 will abut the interior side wall of casing 440 and prevent farther rotation of cylinder 116 and elliptical lobe 1008 within recess 1010 formed in shank 113. Either alternatively, or simultaneously, and depending upon the dimensions of recess 1010, shank 113 may engage lobe 1008 to terminate farther travel into casement 440. A detent 126*c* may be formed to extend above the surface of shank 113 to engage an opposite flat side 126*b* of cam plate 126, as shown by FIG. 75, and prevent farther counterclockwise rotation of cam plate 126, lobe 1008 and cylinder plug 116 when the shoulders of cam plate 113 adjacent to bolt 112 abut against the left interior wall of casement 440.

Figure 76:
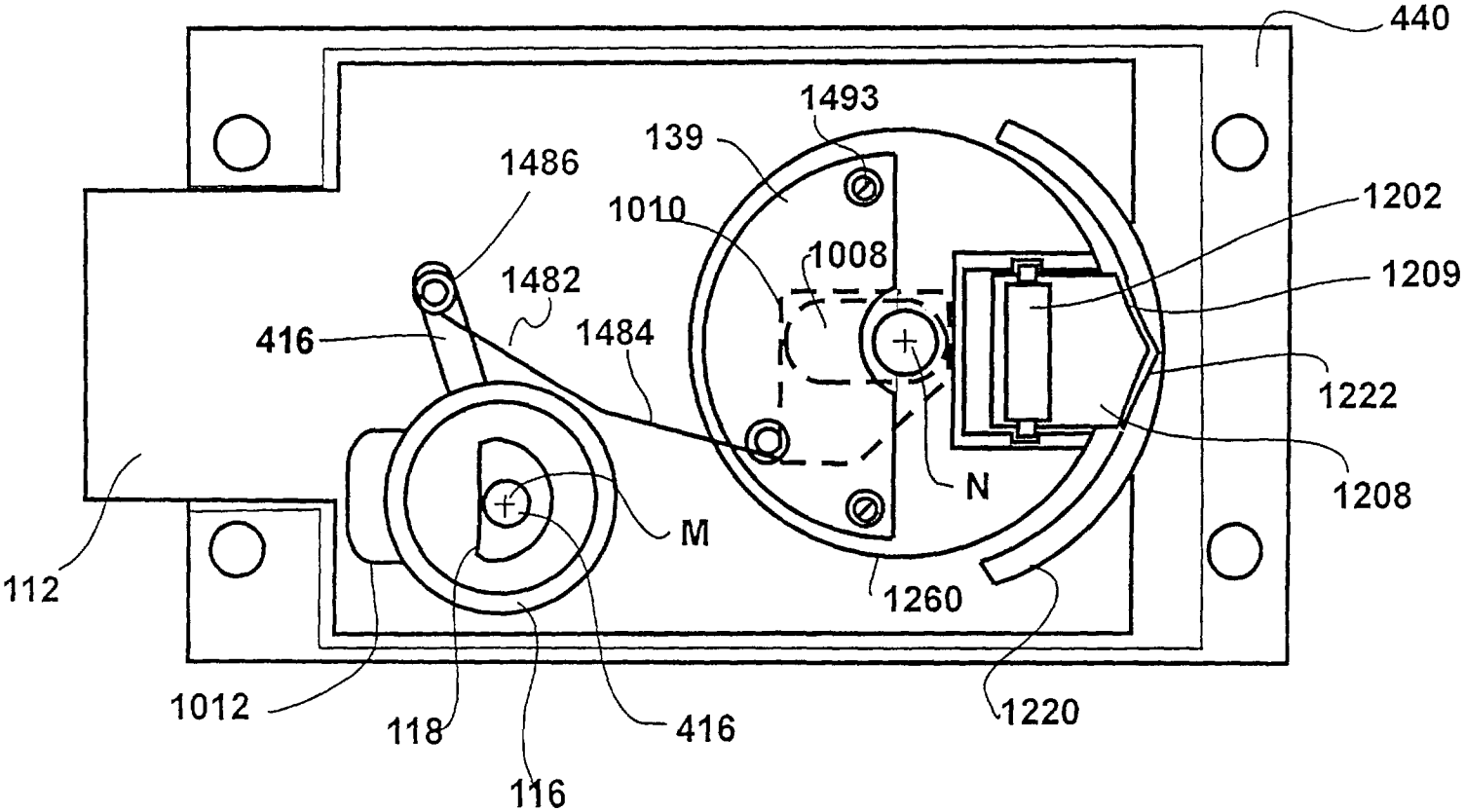
FIG. 76 is a top view of a partially unassembled alternative embodiment, illustrated in the locked state.
Figure 76A:
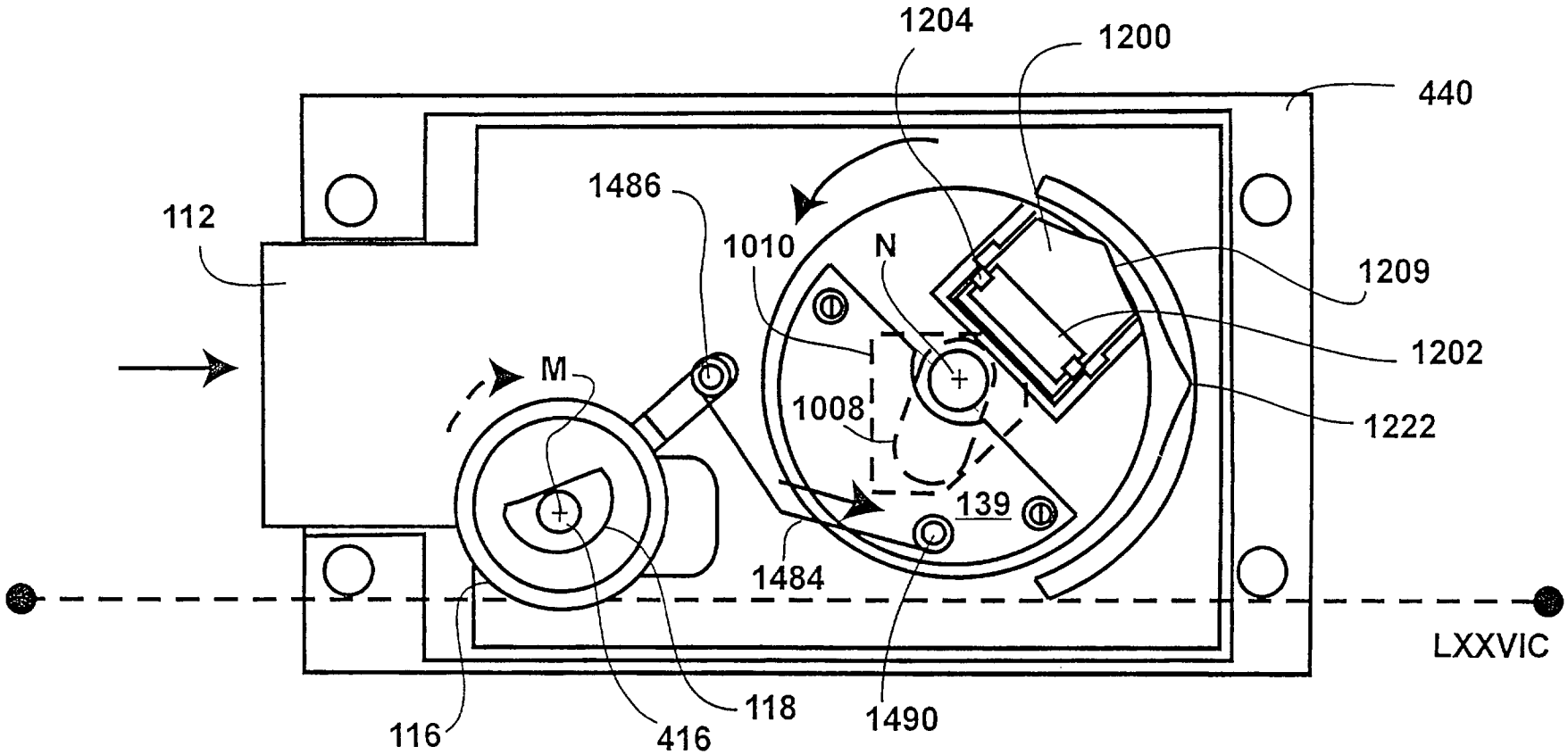
FIG. 76A is a top view of the embodiment illustrated by FIG. 76, while in an unlocked state.
Figure 76B:
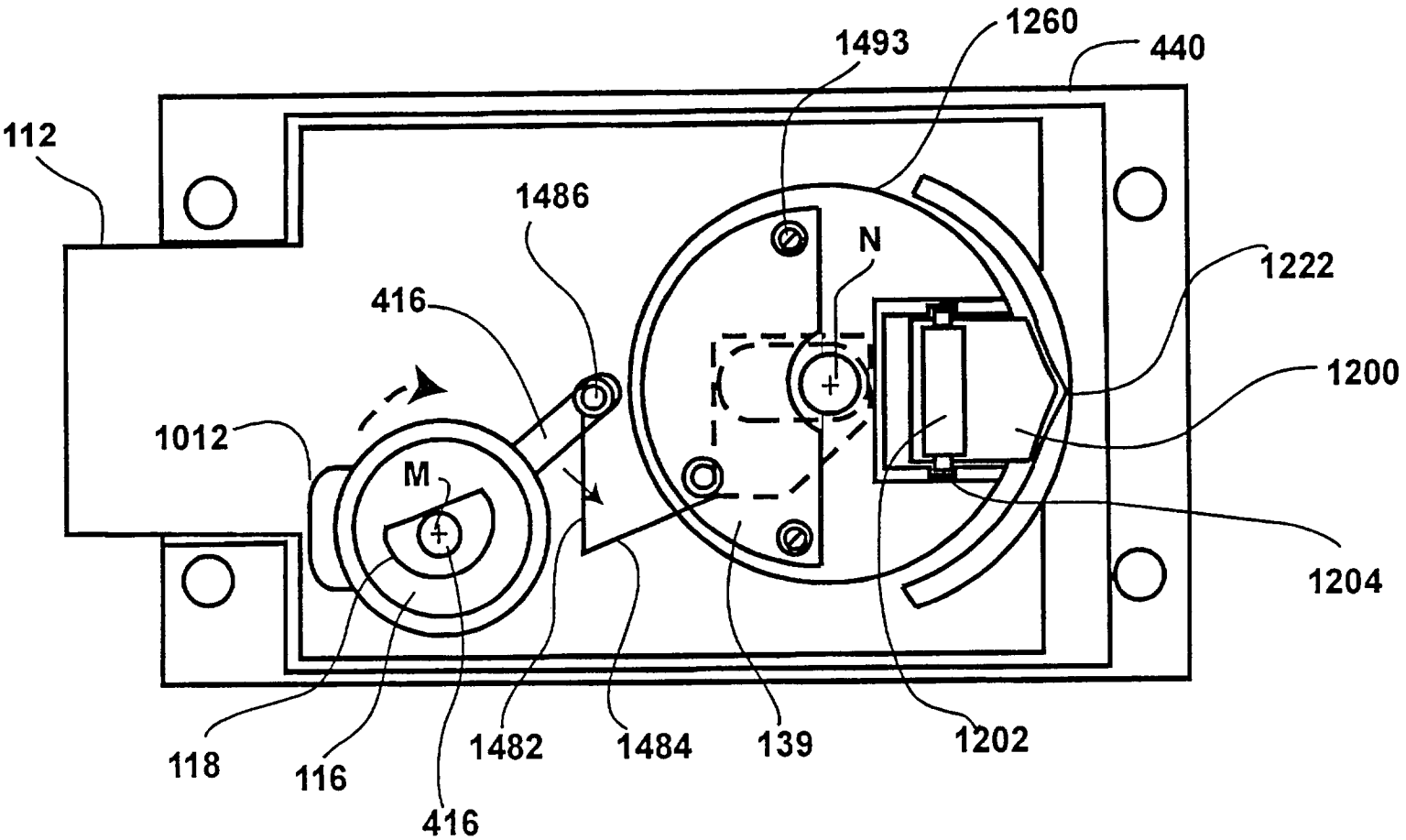
FIG. 76B is a top view of the embodiment of FIG. 76, shown after application of excessive torque to the keyway.
Figure 76C:
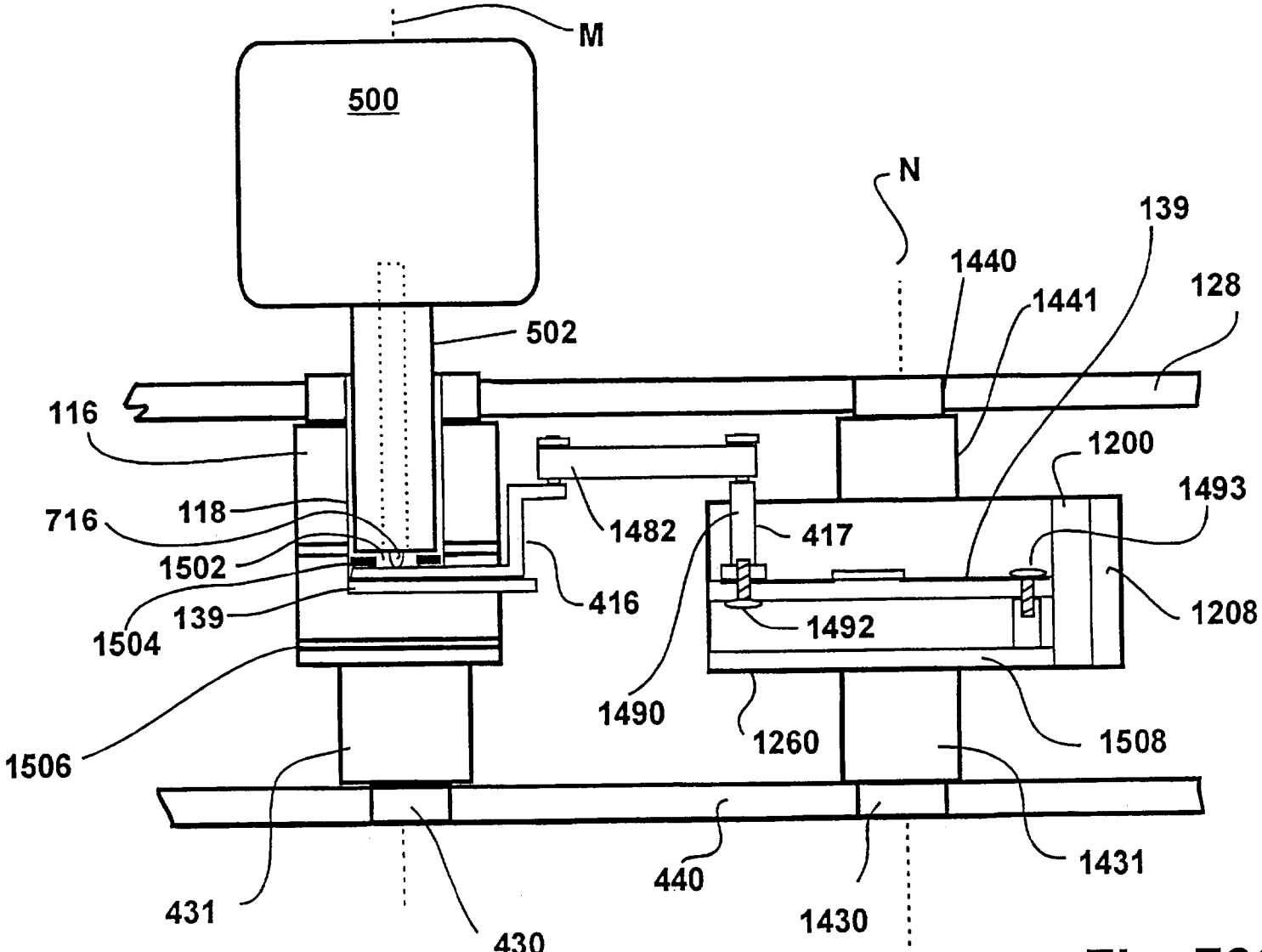
FIG. 76C is an enlarged side elevational view illustrating the electrical contact system and insulating material in the embodiment illustrated by FIG. 76.
Figure 76D:
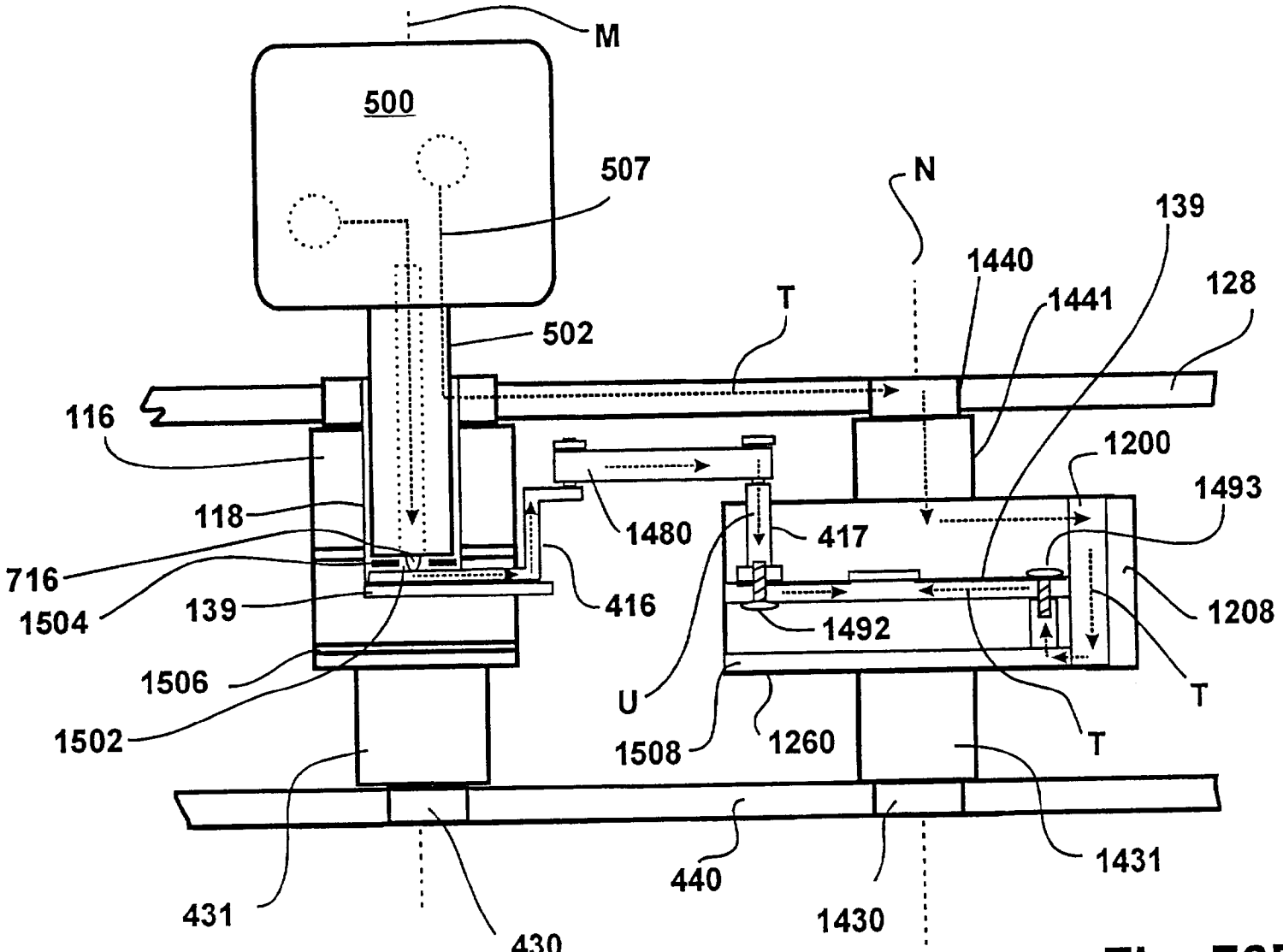
FIG. 76D is an enlarged side elevational view showing the electrical and data path through the embodiment illustrated by FIG. 76.

Turning now to FIGS. 76 through 76D, an alternative embodiment of a cam lock is illustrated with a lever and electrical contact mounted on the exterior of cylinder plug 116, rotating simultaneously with plug 116 while driving both arms 1482, 1484 of a spring that together operationally couple cylinder plug 116 with cam plate 1260. One end of arm 1482 engages a pivot 1486 at the distal end of lever 1480 while the opposite end of the other arm 1484 may engage a second pivot 1490 that may be mounted upon and extend above cam plate 1260. A recess 1012 in shank 113 allows bolt 112 and its accompanying shank 113 to reciprocally travel relative to casement 440 while pivot post 430 anchors cylinder plug 116 coaxially with spacer post 431 within casement 440.

FIG. 76, a top view showing the alternative embodiment is a partially unassembled state, illustrates the bolt 112 and the arms 1482, 1484 in their corresponding positions while the lock is in its locked state with bolt 112 shown extending to the left and beyond casement 440 while the mechanism is in its locked state.

FIG. 76A is a top view of the embodiment illustrated by FIG. 76, while in an unlocked state;

FIG. 76B is a top view of the embodiment of FIG. 76, shown after application of excessive torque to the keyway;

FIG. 76C is an enlarged side elevational view illustrating the electrical contact system and insulating material in the embodiment illustrated by FIG. 76; and FIG. 76D is an enlarged side elevational view showing the electrical and data path through the embodiment illustrated by FIG. 76. Electrical contact 716 extending downwardly beyond the distal end of the blade 502 of key 500, makes an electrical contact with a socket 1502 electrically coupled to one end of an electrically conductive contact wiper 416 that is electrically isolated by electrical insulators 1504, 1506 from the electrically conducting elements of cylinder plug 116. The other end of contact wiper 416 is coupled to spring 1480 that is, in turn, coupled to an electrical contact 417 mounted upon circuit board 139 and borne by cam plate 126. The dashed lines presented in FIG. 76D trace the arms of electrical current from two electrically isolated parts of key 500, namely blade 502 and terminal 716. Current from the battery side of key 500 traces a path through contact 716 extending, for example, through, but insulated from, the blade 502, through socket 1502, spring contact wiper 416, and spring-loaded contact pin 417 to circuit board 139. Circuit board 139 distributes the battery voltage to the individual components of circuit 130. A return, or local ground path may extend from a surface mount terminal on circuit board 139 that is located beneath the head of threaded fastener 1013, through threaded fastener 1013 and an electrically conducting substrate 1508 beneath cam plate 126 and spacer 1441, through upper pivot post 1440, through casement cover 128, and through cylinder plug 116 to the electrically conducting portion of the blade 502 of key 500. Alternatively, or additionally, a return path may extend between circuit board 139, threaded fastener 1013, substrate 1508, lower spacer 1431, lower pivot 1430, casement 440, and through either cover 128 and cylinder plug 116 or through lower pivot 430, lower spacer 431 and cylinder plug 116, to the electrically conducting portion of the blade of key 502. The pivoted mechanical connection between the distal end of spring loading of contact wiper 416 and the distal end of spring 1480 assures the continuity of electrical contact between the cylinder plug and circuit board 139 throughout the rotation between the locked and opened states of the mechanism. In an alternative embodiment, a flexible ribbon cable carrying two or more leads, may extend between one socket mounted upon cylinder plug 116 and a second socket mounted upon circuit board 139.

Figure 77:
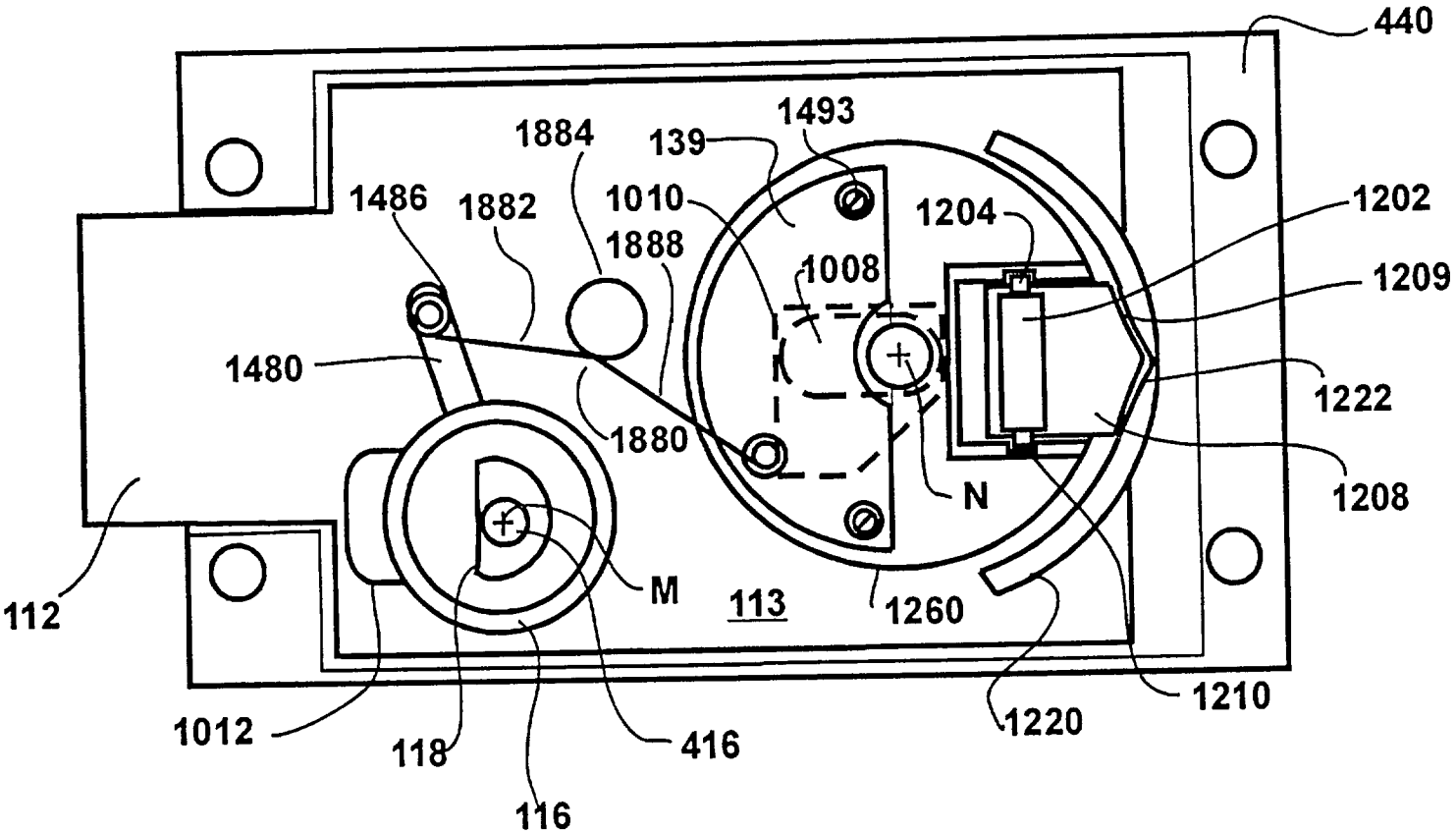
FIG. 77 is a top view of an alternative embodiment.

FIG. 77 illustrates an alternative embodiment with the electrical contacts removed in order to clearly show the details of the mechanical components sited within casement 440. Cylinder plug 116 is mounted within casement 440 to rotate around axis M, while cam 1260 is mounted within casement 440 to rotate around axis N. Axis N and cam 1260 are spaced radially apart from cylinder plug 116 and axis M. In this embodiment, lever 416, in combination with a spring 1880, operationally connects cylinder plug 116 with cam 1260. Lever 1486 extends radially outwardly from cylinder plug 116, and a boss 1486 mounted on the distal end of lever 416 pivotally engages a distal end of arm 1882 of spring 1880. A coiled central length 1884 of spring 1880 joins arm 1882 to a second arm 1888. The distal end of arm 1882 pivotally engages a boss 1262 extending axially outwardly from cam 1260. The relative lengths of the interior of casement 440 and shank 113 restrict the throw of bolt 112, and thereby limit the angular rotation of cylinder plug 116 and cam 1260. Spring 1880 serves as a flexible buffer and torque limiting device between the angular rotation of cylinder plug 116 and cam 1260.

In operation, when a key (not shown) able to demonstrate both mechanical conformance when inserted into keyway 118 and electronic conformance to the digital signature held by the key with the memory of circuit 130 (not separately shown) mounted upon circuit board 139 will enable circuit 130 to apply an electrical current to the coil of solenoid 1202. The electrical current retracts both armatures 1204 radially inwardly and against compression spring 1216. This axial withdrawal of both armatures 1204 enables the manual torque applied by to the key by the user, and by the key to keyway 118 in a clockwise direction, to turn lever 1480 clockwise and, in turn, force arm 1882 toward arm 1888, thus forcing boss 1262 to rotate counter-clockwise around axis N. The rotation forces surface 1209 of cam nose 1208 out of the detent formed by arch 1222 and drives cam nose 1208 to the left, and thus accommodates counter-clockwise rotation of cam plate 126 against the bias force of spring 1206 (not separately shown in FIG. 77). While energized by circuit 130, solenoid 1202 withdraws armatures 1204 in opposite axial directions by a sufficient distance to allow the distal ends of armatures 1204 to extend axially outwardly by an axial length that is less the distance between opposite side walls 1212. In a locked, unenergized state solenoid 1202 has armatures 1204 extending to a coaxial length of somewhat less than the separation between opposite side walls 1212; it is the energization of solenoid 1202 that retracts solenoid 1202 to an axial length less than least distance separating side walls 1212, and permits the manual rotation of cylinder plug 116 to transmit the rotational force to cam 1260 via lever 1480 and spring 1880. Elliptical lobe 1008 may be coaxially mounted with cam 1260 to rotate counter-clockwise around axis N, as indicated in FIG. 77, when a conforming key is inserted into keyway 118 and rotated clockwise. The distally entending end of lobe 1008 rides along the transverse wall of the recess 1010 formed within shank 113, and the concomitant camming action between the distal end of lobe 1008 and the wall of slot 1010 forces shank 113 to the right, thereby withdrawing bolt 112 to withdraw inside casement 440. This places the lock in an unlocked state. Although a key retainer holds the key (not separately shown) within key slot 118, as long as no counter-clockwise force is applied to the key, cam nose 1208 remains outside of arch 1222, and the lock remains in its unlocked state. The lock may be returned to its locked state by a manual application of a counter-clockwise torque to the key and cylinder plug 116, that, in turn, draws lever 1480 counter-clockwise, and pulls arm 1882 away from coil 1884 and arm 1888, causing cam 1260 to rotate clockwise until the spring-loaded nose 1208 is released by fence 1220 to move to the right and into arch 1222. Either a previous, or a subsequent interruption of electrical current to the coil of solenoid 1202 enables armatures 1204 to simultaneously move axially outwardly, in opposite directions, and to extend into the conforming slots 1210 formed in the circumferential wall of cam 126. Completion of the counter-clockwise rotation of the key enables the key to be withdrawn from the retainer and keyway 118.

Should excessive torque be applied to cylinder plug 116 as, for example, an attempt to obtain unauthorized entry to the volume that is being secured by the lock, and if the excessive torque is adequate to rotate cylinder plug 116 around axis M, the combination of the engagement of nose 1209 and arch 1222, and the distal ends of armatures 1204 and slots 1210 prevents spring 1880 from forcing cam 1260 to rotate around axis N. If cylinder plug 116 is completely wrenched out of the cover of the lock in a further effort to obtain unauthorized entry, because of the radial offset between axes M, N, the resulting void created by the absence of cylinder plug 116 does not provide direct access to either cam 1260 or to the components borne by cam 1260. Access to cylinder plug 116 is further restricted by the relative thinness of casement 440.

The electronic cam and its key may be employed as components of a system that uses a process for programming (i.e., in some instances a computer terminal), an optional key programming station, an electronic key, and the electronic cam. Generally, the foregoing paragraphs describe a lock that may be constructed with a housing bearing a hole centered upon a first axis, a bolt supported by the housing and moving transversely relative to the first axis to protrude beyond the housing to and extended position and to retract within the housing to a retracted position, a cylinder plug perforated by a keyway, having an exposed circumferential surface surrounding the keyway rotatably fitted within the hole, and rotating within the hole in response to rotational force applied by a key conformingly corresponding to the lock through an arc centered upon the first axis, a cam positioned to rotate with the cylinder plug as the key conformingly corresponding to the lock manually applies a rotational force to the cylinder plug rotates through the arc, a member eccentrically positioned relative to the axis, extending between the cam and the bolt to drive the bolt between the extended and the retracted positions as the cylinder plug through the arc, an electronic circuit containing a memory and a microprocessor, mounted upon and supported by the cam to rotate with the cam through the arc, the electronic circuit operationally responding to digital data carried by the key conformingly corresponding to the lock when the microprocessor determines that the digital data conformingly corresponds to resident data stored within the memory, a release spaced-apart from the cylinder and eccentrically positioned away from the first axis, the release being functionally activated by the electronic circuit to move between a deployed position preventing rotation of the cam relative to the housing, and a released position accommodating the rotation of the cam relative to the using.

What we claim is:

1. A lock, comprising:

a housing bearing a hole;

a bolt supported by and travelling within a plane between a first position protruding beyond said housing and a second position retracted within said housing, said bolt bearing a guide aperture and a drive aperture;

a cylinder plug perforated by a keyway having an axis transversely oriented relative to said plane, said cylinder plug having an exposed peripherial surface surrounding said keyway;

a cam positioned between said housing and said bolt, to rotate in response to rotation by said cylinder plug and force said bolt to travel between said first position and said second position as a key conformingly corresponding to said cylinder plug manually applies a rotational force to said cylinder plug through an arc centered upon said axis;

an electronic circuit containing a memory, said electronic circuit being mounted within said housing and borne by said cam to rotate with said cam through said arc, said electronic circuit operationally responding to electrical representations of data carried by the key conformingly corresponding to said lock;

a movable blocking member selectively obstructing access to said circuit board via said keyway; and a release mounted upon and borne by said cam, and operationally activated by said electronic circuit to move between a deployed position preventing rotation of said cam relative to said housing, and a released position accommodating said rotation of said cam relative to said housing.

2. An electronic locking system, comprising:

a cylinder housed within and rotatable with respect to a shell;

a key;

at least one of said key and said cylinder being capable of generating a signal when said key is electrically connected with said cylinder;

an electrically powered locking mechanism in said cylinder including a lock member movable between an open position and a locked position, said lock member in said locked position interfering with rotation of said cylinder with respect to said shell; and an anti-tamper mechanism, said anti-tamper mechanism selectively resisting movement of said lock member in response to longitudinal movement of said cylinder.

3. The electronic locking system of claim 2, wherein said locking mechanism further comprises an interfering member selectively interfering with movement of said lock member.

4. The electronic locking system of claim 2, further comprising a biasing mechanism urging said lock member toward a home position.

5. The electronic locking system of claim 2, further comprising a key retention mechanism located at least partially within said cylinder that retains said key when said cylinder is rotated past a home position.

6. The electronic locking system of claim 2, wherein said locking mechanism is rotatable in unison with said cylinder when said lock member is in said open position.

7. The electronic locking system of claim 2, further comprised of:

said locking mechanism comprising a memory storing a code; and said anti-tamper mechanism resisting rotation of said cylinder relative to said shell absence a conformance between said code and said signal generated when said key is electrically connected with said cylinder.

8. An electronic locking system, comprising:

a cylinder rotatably received between interior walls of a shell;

a detent disposed between said cylinder and said shell, said detent engaging the shell while hindering rotation of said cylinder within said shell;

a key engaging surface provided by a face of said cylinder;

a memory borne by said cylinder, storing a code corresponding to said cylinder;

an electrical operator borne by said cylinder and rotating with said cylinder within said shell, said operator responding to a data signal conforming to said code upon reception of said data signal from a key engaging said surface, by releasing said detent to move relative to both said cylinder and the shell when said detent accommodates said rotation upon application of a torque applied by a user manipulating a key while said key engages said surface; and an anti-tamper mechanism selectively resisting said rotation in response to application of a force to said locking system in an absence of a coincidence between said data signal and said code.

9. The electronic locking system of claim 8, wherein said shell further comprises a locking mechanism selectively interfering with said rotation of said cylinder.

10. The electronic locking system of claim 8, further comprising a biasing mechanism urging said detent toward a home position when said cylinder is rotated away from said locked position.

11. The electronic locking system of claim 8, further comprising a key retention mechanism located at least partially within said cylinder that retains said key when said cylinder is rotated past a home position.

12. The electronic locking system of claim 9, wherein said locking mechanism is rotatable in unison with said cylinder when said lock member is in an open position.

13. An electronic locking assembly, comprising:

housing a cylinder plug to rotate within a shell;

providing a key, with at least one of said key and said cylinder being capable of generating a signal when said key is electronically connected with said cylinder;

placing an electrically powered locking mechanism in said cylinder, with said locking mechanism including a lock member movable between an open position and a locked position, and with said lock member interfering with rotation of said cylinder within said shell when said lock member is in said locked position; and incorporating within said assembly an anti-tamper member, said anti-tamper member selectively resisting movement of said lock member in response to longitudinal movement of said cylinder.

14. The electronic locking system of claim 1, further comprised of a key retainer positioned within said cylinder plug to retain a shank of a key inserted within said keyway.

15. The electronic locking system of claim 8, further comprised at least one pin positioned within said cylinder plug to selectively correspond to bitting borne by a key inserted within said key engaging surface.

16. The electronic locking system of claim 13, further comprised of a key retainer positioned within said cylinder plug to retain a shank of a key connected with said cylinder.

17. The electronic locking system of claim 13, further comprised at least one pin positioned within said cylinder plug to selectively correspond to bitting borne by a key connected with said cylinder.

* * * * *